US010140836B2

(12) United States Patent
Takahashi et al.

(10) Patent No.: US 10,140,836 B2
(45) Date of Patent: Nov. 27, 2018

(54) ABNORMALITY DETECTION SYSTEM, DISPLAY DEVICE, ABNORMALITY DETECTION METHOD, AND RECORDING MEDIUM

(71) Applicant: FUJITSU LIMITED, Kawasaki-shi, Kanagawa (JP)

(72) Inventors: Kazuki Takahashi, Wako (JP); Sayaka Suwa, Itabashi (JP); Takehiko Nishimura, Kawasaki (JP); Yoshihiko Nishida, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/723,119

(22) Filed: May 27, 2015

(65) Prior Publication Data

US 2016/0005298 A1 Jan. 7, 2016

(30) Foreign Application Priority Data

Jul. 1, 2014 (JP) ..... 2014-136301

(51) Int. Cl.
*G08B 21/18* (2006.01)

(52) U.S. Cl.
CPC ..... *G08B 21/187* (2013.01)

(58) Field of Classification Search
CPC ..... G08B 21/187; G07C 3/00; F16P 3/14; G03G 15/55; A61M 5/16854
(Continued)

(56) References Cited

U.S. PATENT DOCUMENTS 5,668,741 A * 9/1997 Prigent ..... G07C 3/00 702/182
2003/0150908 A1* 8/2003 Pokorny ..... B23Q 35/12 235/375

(Continued)

FOREIGN PATENT DOCUMENTS

CN 101364069 A 2/2009
CN 101414186 A 4/2009

(Continued)

OTHER PUBLICATIONS

Chinese Office Action dated Nov. 3, 2017 for corresponding Chinese Patent Application No. 201510363674.2, with English Translation, 16 pages.

(Continued)

*Primary Examiner* — Hai Phan
*Assistant Examiner* — Anthony D Afrifa-Kyei
(74) *Attorney, Agent, or Firm* — Fujitsu Patent Center

(57) ABSTRACT

An abnormality detection system includes a processor configured to execute a process. The process includes: storing log data in a storage in which at least a production device number is associated with the event date and time; referring to the log data stored in the storage and calculating a temporal relationship between a first device and a second device that subsequently performs a process after the first device from among a plurality of production devices; detecting elapse of a reference time that is obtained from both the latest log data from among the pieces of log data related to the first device stored in the storage and the temporal relationship calculated at the calculating and that new log data related to the second device is not newly stored in the storage; and displaying an alarm when detection is obtained at the detecting.

10 Claims, 53 Drawing Sheets

(58) Field of Classification Search
USPC ..... 340/679, 681; 382/141, 145, 147, 149, 382/152; 482/12; 702/35; 700/143, 293, 700/294, 110; 324/216, 217, 237, 456, 324/718
See application file for complete search history.

(56) References Cited

U.S. PATENT DOCUMENTS

| | | | | |
|---|---|---|---|---|
| 2007/0192064 | A1* | 8/2007 | Nakamura | G06Q 10/06 702/185 |
| 2008/0219544 | A1* | 9/2008 | Tasaki | G06Q 10/06 382/141 |
| 2009/0041481 | A1* | 2/2009 | Iida | G03G 15/0896 399/12 |

FOREIGN PATENT DOCUMENTS

| | | | |
|---|---|---|---|
| JP | 2006-302096 | A | 11/2006 |
| JP | 2007-140625 | A | 6/2007 |
| JP | 2009-116842 | | 5/2009 |
| JP | 2014-2705 | A | 1/2014 |
| JP | 2014-99075 | A | 5/2014 |

OTHER PUBLICATIONS

Japanese Office Action dated Dec. 26, 2017 for corresponding Japanese Patent Application 2014-136301, with English Translation, 6 pages.
Japanese Office Action dated Apr. 10, 2018 for corresponding Japanese Patent Application No. 2014-136301, with English Translation, 6 pages.

* cited by examiner

121

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | 9:07:30 | 9:08:30 |
| SN0002 | 9:03:35 | 9:04:05 | 9:05:35 | 9:07:05 | 9:07:35 | 9:10:05 | 9:11:05 | 9:12:05 |
| SN0003 | 9:07:05 | 9:07:35 | 9:10:05 | 9:11:35 | 9:12:05 | 9:13:35 | 9:14:35 | 9:15:35 |
| ⋮ | ⋮ | ⋮ | ⋮ | ⋮ | ⋮ | ⋮ | ⋮ | ⋮ |

FIG.6

1

| NO | STATE | | PROCESS |
|---|---|---|---|
| 1 | START TIME AND END TIME OF ALL STEPS ARE STORED. | | DISPLAY IN NORMAL COLOR. |
| 2 | START TIME OF STEP OF PRODUCT IS NOT STORED. | DIFFERENCE BETWEEN END TIME OF IMMEDIATELY PREVIOUS STEP AND CURRENT TIME IS SMALLER THAN WAITING PERIOD LEVEL1. | DISPLAY START TIME AND END TIME OF STORED STEPS BY STRIP IN NORMAL COLOR. DISPLAY PORTION OF NOT-STORED STEP BY DOTTED LINE STRIP. |
| 3 | | DIFFERENCE BETWEEN END TIME OF IMMEDIATELY PREVIOUS STEP AND CURRENT TIME IS EQUAL TO OR GREATER THAN WAITING PERIOD LEVEL1 AND IS SMALLER THAN WAITING PERIOD LEVEL2. | DISPLAY START TIME AND END TIME OF STORED STEPS BY STRIP IN NORMAL COLOR. DISPLAY PORTION OF NOT-STORED STEP BY YELLOW STRIP. |
| 4 | | DIFFERENCE BETWEEN END TIME OF IMMEDIATELY PREVIOUS STEP AND CURRENT TIME IS EQUAL TO OR GREATER THAN WAITING PERIOD LEVEL2. | DISPLAY START TIME AND END TIME OF STORED STEPS BY STRIP IN NORMAL COLOR. DISPLAY PORTION OF NOT-STORED STEP BY RED STRIP. |
| 5 | END TIME OF STEP OF PRODUCT IS NOT STORED. | DIFFERENCE BETWEEN START TIME OF STEP IN WHICH END TIME IS NOT STORED AND CURRENT TIME IS SMALLER THAN PROCESSING PERIOD LEVEL1. | DISPLAY START TIME AND END TIME OF STORED STEPS BY STRIP IN NORMAL COLOR. DISPLAY PORTION OF NOT-STORED STEP BY DOTTED LINE STRIP. |
| 6 | | DIFFERENCE BETWEEN START TIME OF STEP IN WHICH END TIME IS NOT STORED AND CURRENT TIME IS EQUAL TO OR GREATER THAN PROCESSING PERIOD LEVEL1 AND IS SMALLER THAN PROCESSING PERIOD LEVEL2. | DISPLAY START TIME AND END TIME OF STORED STEPS BY STRIP IN NORMAL COLOR. DISPLAY PORTION OF NOT-STORED STEP BY YELLOW STRIP. |
| 7 | | DIFFERENCE BETWEEN START TIME OF STEP IN WHICH END TIME IS NOT STORED AND CURRENT TIME IS EQUAL TO OR GREATER THAN WAITING PERIOD LEVEL2. | DISPLAY START TIME AND END TIME OF STORED STEPS BY STRIP IN NORMAL COLOR. DISPLAY PORTION OF NOT-STORED STEP BY RED STRIP. |

121a

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | 9:07:30 | 9:08:30 |

121b

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121b

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121b

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121c

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121c

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121c

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121d

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121d

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121d

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121e

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121e

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121e

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121f

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121f

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121f

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121g

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121g

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121g

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121h

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121h

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121h

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121i

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121i

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121i

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121j

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121j

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121j

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121k

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121k

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121k

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121l

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121I

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121l

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | | | |

121m

| PRODUCT NUMBER | START OF STEP 1 | END OF STEP 1 | START OF STEP 2 | END OF STEP 2 | START OF STEP 3 | END OF STEP 3 | START OF STEP 4 | END OF STEP 4 |
|---|---|---|---|---|---|---|---|---|
| SN0001 | 9:00:00 | 9:00:30 | 9:02:00 | 9:03:30 | 9:04:00 | 9:06:30 | | |

121n

| PRODUCT NUMBER | START OF STEP 1 | START OF STEP 2 | START OF STEP 3 | START OF STEP 4 |
|---|---|---|---|---|
| SN0001 | 9:00:00 | 9:02:00 | 9:04:00 | |

121n

| PRODUCT NUMBER | START OF STEP 1 | START OF STEP 2 | START OF STEP 3 | START OF STEP 4 |
|---|---|---|---|---|
| SN0001 | 9:00:00 | 9:02:00 | 9:04:00 | |

ABNORMALITY DETECTION SYSTEM, DISPLAY DEVICE, ABNORMALITY DETECTION METHOD, AND RECORDING MEDIUM

CROSS-REFERENCE TO RELATED APPLICATION

This application is based upon and claims the benefit of priority of the prior Japanese Patent Application No. 2014-136301, filed on Jul. 1, 2014, the entire contents of which are incorporated herein by reference.

FIELD

The embodiments discussed herein are related to an abnormality detection system, a display device, an abnormality detection method, and an abnormality detection program.

BACKGROUND

In production systems that produce products through multiple steps, there are devices that support estimation of the cause of an abnormality that has occurred. Such devices visualize the transition of steps by displaying the relationship between steps related to the amount of variation that varies in each step, where the steps are indicated on the horizontal axis.

Patent Document 1: Japanese Laid-open Patent Publication No. 2009-116842

However, with the related technology described above, there is a problem in that it is not possible to detect an abnormality related to the production system in real time. For example, with the related technology described above, for the amount of variation that varies in each step, because the relationship between the steps is displayed after all of the steps have been ended, if an abnormality occurs in each of the steps, it is not possible to detect the abnormality in real time.

SUMMARY

According to an aspect of the embodiments, an abnormality detection system includes: a processor configured to execute a process including: storing log data in a storage, which is related to each of a plurality of production devices that are included in a production line and that produce a product by sequentially performing processes, and in which, for a process related to the production of the product performed by each of the production devices, at least a production device number is associated with the event date and time; referring to the log data stored in the storage and calculating a temporal relationship, of the production of the same product, between a first device and a second device that subsequently performs a process after the first device from among the plurality of production devices; detecting elapse of a reference time that is obtained from both the latest log data from among the pieces of log data related to the first device stored in the storage and the temporal relationship calculated at the calculating and that new log data related to the second device is not newly stored in the storage; and displaying an alarm when detection is obtained at the detecting.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 6 is a schematic diagram for explaining a real time display of the graph;

DESCRIPTION OF EMBODIMENTS

Preferred embodiments will be explained with reference to accompanying drawings. The present invention is not limited to these embodiments. The embodiments can be appropriately used in combination as long as the processes do not conflict with each other.

[a] First Embodiment

Functional Configuration of an Abnormality Detecting Device

Figure 1:
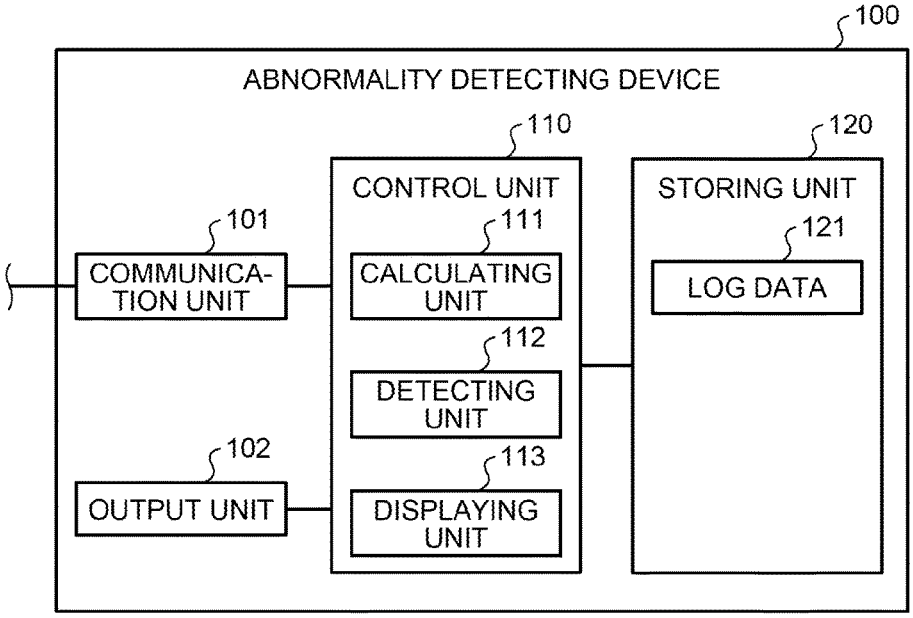
FIG. 1 is a functional block diagram illustrating the configuration of an abnormality detecting device according to a first embodiment.
Figure 2:
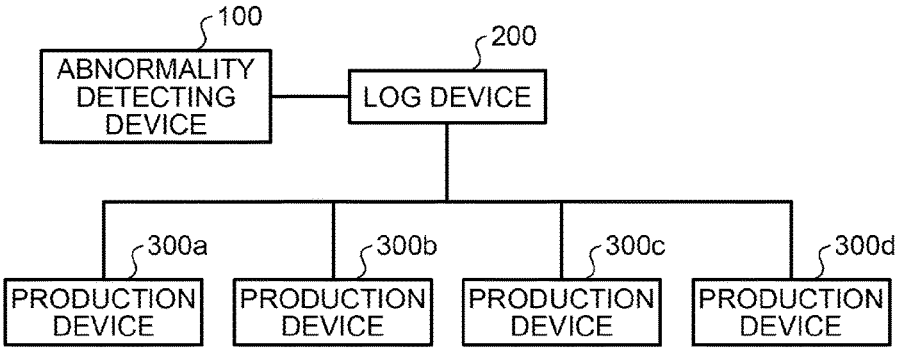
FIG. 2 is a schematic diagram illustrating an example of a system configuration of the entire abnormality detection system.

FIG. 1 is a functional block diagram illustrating the configuration of an abnormality detecting device according to a first embodiment. Furthermore, FIG. 2 is a schematic diagram illustrating an example of a system configuration of the entire abnormality detection system. An abnormality detecting device 100 includes a communication unit 101, an output unit 102, a control unit 110, and a storing unit 120.

The communication unit 101 is implemented by, for example, a network interface card (NIC) or the like. The communication unit 101 is a communication interface that is connected to a log device 200, which will be described later, via a network in a wired or wireless manner and manages communication of information with the log device 200.

The output unit 102 is a processing unit that outputs a graph created by the control unit 110 to various kinds of output media, such as a monitor, a printer, or the like. The output unit 102 may change a display format of a graph in accordance with the operation performed in a user interface, which will be described later.

The abnormality detecting device 100 according to the first embodiment is connected to the log device 200 via the communication unit 101 such that the abnormality detecting device 100 and the log device 200 can communicate with each other. Furthermore, the log device 200 is connected to production devices 300*a* to 300*d* such that they can communicate with each other.

The production devices 300*a* to 300*d* perform, for example, processes 1 to 4 and produce a product. The production device 300*a* performs a step 1 on the product. The production device 300*a* outputs the log data that includes therein the start time and the end time of the step 1 to the log device 200. A production device 300*b* performs a step 2 on the product. The production device 300*b* outputs the log data that includes therein the start time and the end time of the step 2 to the log device 200. A production device 300*c* performs a step 3 on the product. The production device 300*c* outputs the log data that includes therein the start time and the end time of the step 3 to the log device 200. The production device 300*d* performs a step 4 on the product. The production device 300*d* outputs the log data that includes therein the start time and the end time of the step 4 to the log device 200.

The log device 200 collects the logs that are output from the production devices 300*a* to 300*d* and creates log data 121 based on the collected logs. The log device 200 sends the created log data 121 to the abnormality detecting device 100. The abnormality detecting device 100 stores, in the storing unit 120, the log data 121 received via the communication unit 101. The data structure of the log data 121 will be described later. The abnormality detecting device 100 may also collect logs that are directly output from the production devices 300*a* to 300*d* without passing through the log device 200 and create the log data 121 based on the collected logs.

Each Configuration of the Storing Unit

The storing unit 120 includes the log data 121 created by the log device 200. The storing unit 120 corresponds to, for example, a semiconductor memory device, such as a random access memory (RAM), a read only memory (ROM), a flash memory, and the like, or a storage device, such as such as a hard disk, an optical disk, or the like.

Figures 3, 4:
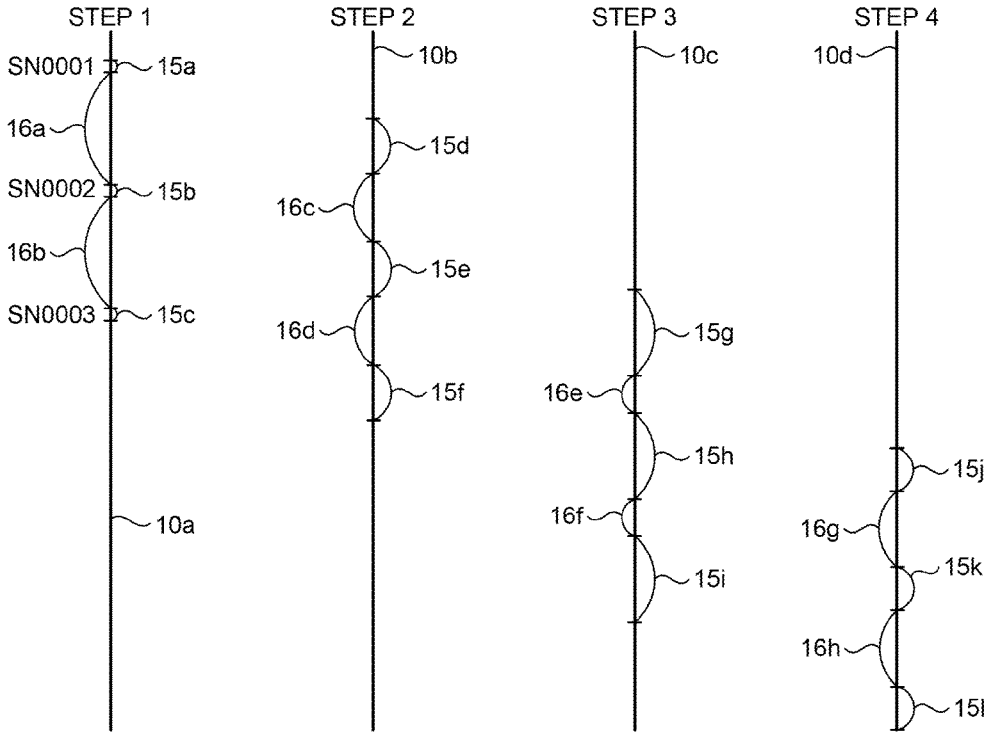
FIG. 3 is a schematic diagram illustrating an example of the data structure of log data.
FIG. 4 is a first diagram for explaining the creation of a graph.

The log data 121 holds the start time and the end time of each of the steps. FIG. 3 is a schematic diagram illustrating an example of the data structure of log data. As indicated by the example illustrated in FIG. 3, for each of the products in the log data 121, the start time and the end time of each step are associated with each other. For example, the log data 121 associates, for the product number of "SN0001", the start time "9:00:00" of the step 1, the end time "9:00:30" of the step 1, the start time "9:02:00" of the step 2, the end time "9:03:30" of the step 2, the start time "9:04:00" of the step 3, and the end time "9:06:30" of the step 3. Furthermore, for the step 4 of the product number "SN0001", the log data 121 associates the start time "9:07:30" with the end time "9:08:30". For the product numbers "SN0002" and "SN0003", similarly to the product number "SN0001", the log data 121 also associates the start time and the end time of each of the steps. FIG. 3 illustrates an example of a case in which pieces of data in each item are associated as records; however, the data may also be stored by using another method as long as the relationship between the items associated with each other described above is maintained.

Each Configuration of the Control Unit

The control unit 110 includes a calculating unit 111, a detecting unit 112, and a displaying unit 113. The function of the control unit 110 can be implemented by, for example, a central processing unit (CPU) executing a predetermined program. Furthermore, the function of the control unit 110 can be implemented by an integrated circuit, such as an application specific integrated circuit (ASIC), a field programmable gate array (FPGA), or the like.

The abnormality detecting device 100 includes the storing unit 120 that stores therein log data, which is related to each of the production devices that are included in a production line and that produce a product by sequentially performing processes, and in which, for a process related to the production of a product performed by each of the production devices, at least a production device number is associated with the event date and time. The abnormality detecting device 100 includes the calculating unit 111 that refers to the log data stored in the storing unit 120 and that calculates temporal relationship, which is used when the same product is produced, between a first device and a second device that subsequently performs a process after the first device from among the plurality of the production devices. The abnormality detecting device 100 includes the detecting unit 112 that detects elapse of a reference time that is obtained from both the latest log data from among the pieces of log data related to the first device stored in the storing unit 120 and the temporal relationship calculated by the calculating unit 111 and that detects that new log data related to the second device is not stored in the storing unit 120. The abnormality detecting device 100 includes the displaying unit 113 that displays an alarm when detection is obtained by the detecting unit 112. The abnormality detecting device 100 is an example of an abnormality detection system.

In addition to the production device number and the event date and time, information indicating the distinction between a start and an end may also be included in the log data 121.

The calculating unit 111 calculates one or a plurality of a time difference between the time at which the first device starts the production and the time at which the second device starts the production, a time difference between the time at which the first device ends the production and the time at which the second device ends the production, and a time difference between the time at which the first device ends the production and the time at which the second device starts the production.

The calculating unit 111 further calculates a time difference between the time at which the first device starts the production and the time at which the first device ends the production. The detecting unit 112 further detects that timing, which is obtained from both start log data from among the pieces of the log data related to the first device stored in the storing unit 120 and the time difference calculated by the calculating unit 111, has elapsed and detects that end log data related to the first device is not updated in the storing unit 120.

The detecting unit 112 detects the elapse of the timing based on the comparison between the timing and the current time.

The displaying unit 113 includes a creating unit that creates, based on the log data stored in the storing unit 120, on the time axis each of which disposed for the production devices 300*a* to 300*d*, a visible display object that indicates a processing period or a waiting period of the product in each of the production devices 300*a* to 300*d*. The displaying unit 113 displays the display object created by the creating unit. Furthermore, the displaying unit 113 displays, on the time axis associated with the second device, a display object, in a state in which the created display object can be distinguished from the display object, that indicates the time range of the processing period of the product in the second device when the processing period in the second device is started or ended within the reference time that is obtained from both the latest processing period in the first device included in the log data and the temporal relationship. The display object is, for example, a strip shaped area indicating a processing period or a waiting period. The strip shaped will be described later.

The displaying unit 113 displays an alarm in accordance with the difference between the timing and the current time. The displaying unit 113 may display a diagram whose area is increased or a line whose thickness is increased as the difference between the timing and the current time is increased.

The displaying unit 113 may also display a different alarm depending on an update of log data on a start or an end of the production performed by a device.

Based on a log output in accordance with execution of a process event related to a specific product in the first device, the displaying unit 113 performs a display associated with the process event performed in the first device by associating the display with the first time on the time axis. The displaying unit 113 updates, in accordance with elapse of time, a display that indicates the current time on the time axis such that a gap between the first time and the current time is increased. Before the reference time calculated based on the log output from the first device exceeds, if a log associated with the execution of the process event related to the specific product is not output from the second device that subsequently performs a process after the process related to the specific product performed in the first device, the displaying unit 113 performs a display associated with a planned process event by associating the display with an estimated occurrence time of the planned process event in the second device related to the specific product. Before the reference time calculated based on the log output from the first device exceeds, if the log associated with the execution of the process event related to the specific product is output from the second device, instead of performing the display associated with the planned process event that is associated with the reference time in the second device related to the specific product, the displaying unit 113 performs a display associated with the process event performed in the second device by associating the display with a second time on the time axis based on the log output from the second device.

In the following, a process performed by each of the units included in the control unit 110 will be described in detail.

The calculating unit 111 refers to the log data 121 and calculates a temporal relationship, which is used when the same product is produced, between, the step performed by the first device and a step performed by the second device that subsequently performs a process after the first device from among the plurality of the production devices 300*a* to 300*d*.

The temporal relationship mentioned here indicates, in the first embodiment, a time difference between the time at which the first device ends the production and the time at which the second device starts the production. The temporal relationship may also be a time difference between the time at which the first device starts the production and the time at which the second device starts the production or may also be a time difference between the time at which the first device ends the production and the time at which the second device ends the production.

Furthermore, the calculating unit 111 may also calculate a plurality of temporal relationships. For example, in the first embodiment, the calculating unit 111 calculates two relationships, i.e., LEVEL1 and LEVEL2, as the temporal relationships. The calculating unit 111 calculates, for example, the average of the differences between the start time and the end time in each step and sets the average as LEVEL1. The calculating unit 111 creates, for example, a probability distribution of the differences of the start time and the end time in each step and sets the difference corresponding to the value of the $80^{th}$ percentile in the probability distribution as LEVEL2. The setting method of LEVEL1 and LEVEL2 described above is only an example and the setting may also be performed based on another reference.

The detecting unit 112 calculates timing from both the latest log data from among the pieces of the log data related to the first device stored in the storing unit 120 and the temporal relationship calculated by the calculating unit 111. The timing mentioned here is the time that can be obtained by adding, for example, the temporal relationship calculated by the calculating unit 111 to the start time or the end time of the step included in the latest log data. The timing is used as a threshold that is used to determine, for example, whether an alarm is to be displayed. The detecting unit 112 detects, for example, that log data related to the second device is not updated even if the timing has elapsed after the latest log data related to the first device was updated. The detecting unit 112 notifies the displaying unit 113 of a detection result.

In response to the detection result from the detecting unit 112, the displaying unit 113 displays an alarm. The alarm mentioned here is a notification, related to a certain product, that is used to notifying a user of a delay of the production at a certain step. For example, in the first embodiment, the displaying unit 113 displays a graph and then displays an alarm in the graph. An example of displaying the alarm will be described later.

The displaying unit 113 displays a graph based on the log data 121 as follows. For example, the displaying unit 113 receives the log data on the process performed in the first device that is included in the production line. The displaying unit 113 specifies a processing period in the first device based on the log data. The processing period mentioned here is the time period for which a product is produced in a device. Then, the displaying unit 113 disposes the processing period on the first time axis of the first device.

The displaying unit 113 receives the log data on the process in the second device that is included in the production line. The displaying unit 113 specifies a processing period in the second device based on the log data. Then, the displaying unit 113 disposes a processing period on the second time axis of the second device.

The displaying unit 113 couples, between the processing periods disposed on the first time axis and the second time axis, processing periods related to the common product, forms a first band, and displays the first band. The band mentioned here is a region that indicates a processing period or a waiting period. Namely, the band is an example of a strip, which will be described later.

After the latest log data related to the first device has been updated by the detecting unit 112, if it is detected that the log data 121 related to the second device is not updated even if the timing has elapsed, the displaying unit 113 performs the following process. The displaying unit 113 forms a second band that connects a first processing period disposed on the first time axis and the position indicating the timing on the second time axis and then displays the second band. By using a different color for the second band from the first band, the displaying unit 113 displays an alarm in a graph. The method of displaying an alarm is not limited to a case of displaying the alarm in a graph. For example, in addition to the screen on which a graph is displayed as an alarm, the displaying unit 113 may also display a popup window.

Display Example of a Graph

The displaying unit 113 performs a process of creating a graph based on the log data 121. An example of displaying a graph created by the displaying unit 113 will be described with reference to FIGS. 4 and 5. FIG. 4 is a first diagram for explaining the creation of a graph. As illustrated in the example in FIG. 4, the displaying unit 113 disposes time axes 10*a* to 10*d* that are extended in parallel. The time axes 10*a*, 10*b*, 10*c*, and 10*d* are associated with a step 1, a step 2, a step 3, and a step 4, respectively.

The displaying unit 113 disposes, based on the log data 121, processing periods and waiting periods of each product on the time axes 10*a* to 10*d*. The waiting period mentioned here is the time period from when a certain product is produced in a step until when the subsequent product is produced.

The processing period is disposed based on the start time and the end time of each step related to the same product stored in the log data 121. In contrast, the waiting period is disposed based on the end time of the step related to a certain product stored in the log data 121 and based on the start time of the step related to the subsequent product.

For example, the displaying unit 113 disposes the processing periods and the waiting periods on the time axis 10*a* as follows. The displaying unit 113 disposes, for example, a processing period 15*a* based on the start time "9:00:00" and the end time "9:00:30" of the step 1 related to "SN0001". Furthermore, the displaying unit 113 disposes a processing period 15*b* based on the start time "9:03:35" and the end time "9:04:05" of the step 1 related to "SN0002". Furthermore, the displaying unit 113 disposes a waiting period 16*a* based on the end time "9:00:30" of the step 1 related to "SN0001" and the start time "9:03:35" of the step 1 related to "SN0002". Furthermore, the displaying unit 113 similarly disposes a processing period 15*c* and a waiting period 16*b*.

Furthermore, the displaying unit 113 disposes the processing periods and the waiting periods on the time axis 10*b* as follows. The displaying unit 113 disposes, for example, a processing period 15*d* based on the start time "9:02:00" and the end time "9:03:30" of the step 2 related to "SN0001". Furthermore, the displaying unit 113 disposes a processing period 15*e* based on the start time "9:05:35" and the end time "9:07:05" of the step 2 related to "SN0002". Furthermore, the displaying unit 113 disposes a waiting period 16*c* based on the end time "9:03:30" of the step 2 related to "SN0001" and the start time "9:05:35" of the step 2 related to "SN0002". Furthermore, the displaying unit 113 similarly disposes a processing period 15*f* and a waiting period 16*d*.

Furthermore, similarly to the time axis 10*a* and the time axis 10*b*, the displaying unit 113 disposes, on the time axis 10*c*, processing periods 15*g* to 15*i* and waiting periods 16*e* and 16*f*. Furthermore, the displaying unit 113 disposes, on the time axis 10*d*, processing periods 15*j* to 15*l* and waiting periods 16*g* and 16*h*.

Then, the displaying unit 113 creates a line connecting the starting points of the processing period of the same product on the adjacent time axis and creates a strip shaped region by creating a line connecting the end points of the processing period of the same product. In the following, the created strip shaped region is referred to as a "strip".

Figure 5:
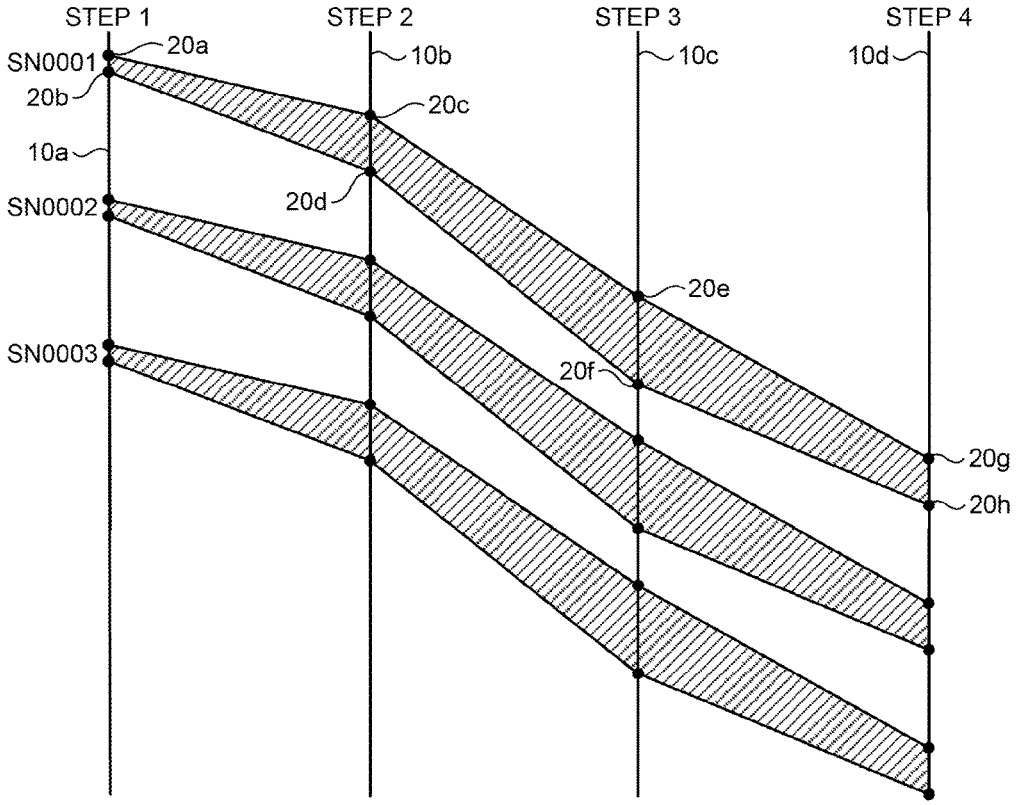
FIG. 5 is a second diagram for explaining the creation of a graph.

FIG. 5 is a second diagram for explaining the creation of a graph. For example, as illustrated in the example in FIG. 5, the displaying unit 113 creates a line connecting points 20*a*, 20*c*, 20*e*, and 20*g* associated with the starting points of the processing periods of the steps of "SN0001". Furthermore, the displaying unit 113 creates a line connecting points 20*b*, 20*d*, 20*f*, and 20*h* associated with the end points of the processing periods of step of "SN0001". Consequently, the displaying unit 113 creates a strip representing the processing periods of the steps of "SN0001". The displaying unit 113 adds a predetermined color to the strip related to "SN0001" such that the strip can be distinguished from the surrounding region. The displaying unit 113 also performs the process of creating a strip for "SN0002" and "SN0003".

Furthermore, the displaying unit 113 may also add a color to a region corresponding to a gap between the strips. For example, in order to distinguish the strip from the region other than the strip, the displaying unit 113 may also add a dark color to the strip and add a light color or a white color to a region corresponding to a gap between the strips.

Each of the strips created by the displaying unit 113 represents the processing period of each step. In contrast, the region corresponding to a gap between the strips represents a waiting period of each step. By outputting this type of graph, the displaying unit 113 can visually display, for each product, the processing period and the waiting period of each step. Furthermore, the information displayed on the graph created by the displaying unit 113 is stored in, for example, a memory in the storing unit 120 or the control unit 110 as image information. However, the information stored as line information is not limited to the image information. For example, the information may also be information that indicates the coordinates on which a line is disposed in an image displayed by the displaying unit 113.

Display Example of a Graph

The displaying unit 113 displays, related to each product, a graph indicated by the example illustrated in FIG. 5 based on the log data 121 in which the start time and the end time of all of the steps are stored. Namely, in the example illustrated in FIG. 5, the displaying unit 113 displays the graph when the production of all products has been completed. In the example illustrated in FIG. 5, the strips related to "SN0001", "SN0002", and "SN0003" are displayed on the graph based on the log data 121 indicated by the example illustrated in FIG. 3.

(Real Time Display in a Graph)

Creating a graph at each stage will be described with reference to FIG. 6. FIG. 6 is a schematic diagram for explaining a real time display of the graph. Table 1 indicated in the example illustrated in FIG. 6 indicates a method of creating a graph in accordance with a storing state of data in the log data 121. Table 1 associates items of NO, a state, and a process with each other. The item of "NO" indicates the number attached to each state. The "state" indicates each state in the log data 121. The "process" indicates a method of displaying a graph in accordance with each state.

For example, The "state" is roughly classified into three states: a case in which the start time and the end time of all steps are stored (NO. 1), a case in which the start time of a step of a product is not stored (NO. 2 to 4), a case in which the end time of a step of a product is not stored (NO. 5 to 7). In the following, these three cases will be described. For the display example of a graph in accordance with each state will be described later.

First, the case in which "the start time and the end time of all steps are stored", which corresponds to "NO. 1", is a state in which, for example, the start time and the end time of all of the steps related to each product in the log data 121 are stored. If the start time and the end time of all of the steps are stored (NO. 1), the displaying unit 113 displays processing periods of each product by a normal color strip.

At this point, the "normal color" that represents inside the strip may appropriately be set. Any type may be used as long as at least inside a closed shape representing the strip is filled with a color or is shaded that can be distinguished from the background color representing a display region and, furthermore, as long as the state of the color can be distinguished from the color that indicates an alarm, which will be described later. An example of the normal color includes blue or green.

In the following, a description will be given of a case in which the start time of a step of a product is not stored, which corresponds to NO. 2 to 4). The case in which the start time of a step of a product is not stored is the state in which, for a certain product stored in the log data 121, the start time and the end time of the immediately previous step is stored but the start time and the subsequent time of the step subsequent to the immediately previous step is not stored. For example, this log data appears in a case in which a problem occurs in conveyance between an immediately previous step and a certain step or appears in a case in which a queued product is retained because the product is not entered due to a problem in a production process of the certain step. The case in which the start time of a step of a product is not stored is further classified into three cases, i.e., NO. 2 to 4, in accordance with the magnitude of the difference between the end time of the step, which is the immediately previous to the step in which log data is not stored, and the current time.

Namely, the case is classified into three cases: a case in which a difference between the end time of the immediately previous step and the current time is smaller than the waiting period LEVEL1 (NO. 2), a case in which a difference is equal to or greater than the waiting period LEVEL1 and is smaller than the waiting period LEVEL2 (NO. 3), and a case in which a difference is equal to or greater than the waiting period LEVEL2 (NO. 4). Here, the waiting period LEVEL1 and the waiting period LEVEL2 are thresholds that are used to determine the magnitude of the difference between the end time of the step, which is immediately previous to the step in which log data is not stored, and the current time. The waiting period LEVEL1 and the waiting period LEVEL2 are calculated by the calculating unit 111.

The waiting period LEVEL1 is the average value of the differences between, for example, the end time of the process at the immediately previous step and the start time of the process at the subsequent step. In other words, the waiting period LEVEL1 is the average value of the waiting periods at each step. The waiting period LEVEL2 is, for example, the value of the $80^{th}$ percentile in the probability distribution of the difference or the waiting time. The above described reference of each of the waiting period LEVEL1 and the waiting period LEVEL2 is only an example. The reference of the waiting period LEVEL1 and the waiting period LEVEL2 may also appropriately be changed.

For any one of these three cases (NO. 2 to 4), the displaying unit 113 displays the start time and the end time of each of the steps stored in the log data 121 by a normal color strip. In contrast, if the difference between the end time of the step, which is immediately previous to the step in which the log data 121 is not stored, and the current time is smaller than the waiting period LEVEL1 (NO. 2), the displaying unit 113 displays, in a graph, the portion of a not-stored step by a dotted-line strip. A display example will be described later.

Furthermore, if the difference between the end time of the step, which is immediately previous to the step in which the log data 121 is not stored, and the current time is equal to or greater than the waiting period LEVEL1 and is smaller than the waiting period LEVEL2 (NO. 3), the displaying unit 113 displays, in a graph, the inside of the strip indicating the portion of the not-stored step in yellow. A display example will be described later.

Furthermore, if the difference between the end time of the step, which is immediately previous to the step in which the log data 121 is not stored, and the current time is equal to or greater than the waiting period LEVEL2 (NO. 4), the displaying unit 113 displays, in a graph, the inside of the strip indicating the portion of the not-stored step in red. A display example will be described later.

In the following, a description will be given of a case in which "the end time of a step of a product is not stored", which corresponds to "NO. 5 to 7". The case in which "the end time of a step of a product is not stored" is the state in which, for a certain product stored in the log data 121, the start time of a certain step is stored but the end time is not stored. For example, this log data appears in a case in which a process takes a long time due to a problem being present in a production process in the certain step. In a case in which "the end time of a step of a product is not stored" is further classified into three cases, i.e., NO. 5 to 7, in accordance with the magnitude of the difference between the start time of the step, in which the end time is not stored, and the current time.

Namely, the case in which "the end time of a step of a product is not stored" is classified into three cases: a case in which a difference between the start time of the step in which the end time is not stored and the current time is smaller than the processing period LEVEL1 (NO. 5), a case in which a difference is equal to or greater than the processing period LEVEL1 and is smaller than the processing period LEVEL2 (NO. 6), and a case in which a difference is equal to or greater than the processing period LEVEL2 (NO. 7). Here, the processing period LEVEL1 and the processing period LEVEL2 are thresholds that are used to determine the magnitude of the difference between the start time of the step in which the end time is stored and the current time. The calculating unit 111 calculates the processing period LEVEL1 and the processing period LEVEL2.

The processing period LEVEL1 is the average value of, for example, the processing periods of the steps. Furthermore, the processing period LEVEL2 is, for example, the value of the $80^{th}$ percentile in the probability distribution of the waiting periods created in the steps. The above described reference of each of the processing period LEVEL1 and the processing period LEVEL2 is only an example. The reference of each of the processing period LEVEL1 and the processing period LEVEL2 may also appropriately be changed.

The displaying unit 113 displays, in all of the three cases (NO. 5 to 7), the start time and the end time of the steps stored in the log data 121 by using the normal color strip. In contrast, if the difference between the start time of the step in which the end time is not stored and the current time is smaller than the processing period LEVEL1 (NO. 5), the displaying unit 113 displays the portion of the not-stored step by using a dotted line strip. A display example will be described later.

Furthermore, if the difference between the start time of the step in which the end time is not stored and the current time is equal to or greater than the processing period LEVEL1 and is smaller than the processing period LEVEL2 (NO. 6), the displaying unit 113 displays the inside of the strip indicating the portion of the not-stored step in yellow. A display example will be described later.

Furthermore, if the difference between the start time of the step in which the end time is not stored and the current time is equal to or greater than the processing period LEVEL2 (NO. 7), the displaying unit 113 displays the inside of the strip indicating the portion of the not-stored step in red. A display example will be described later. The method of displaying the strip described above is an example. The displaying unit 113 may also display the strip by using another method or another color.

(Specific Example of a Real Time Display of a Graph)

For the real time display of each of the graphs NO. 1 to 7 indicated by the examples illustrated in FIG. 6, specific example indicated by FIG. 7 to FIG. 13 will be described. FIGS. 7 to 13 each illustrates, for convenience, the strip of the product with the product number "SN0001" and a display of each of the strips of the other products will be omitted.

Figure 7:
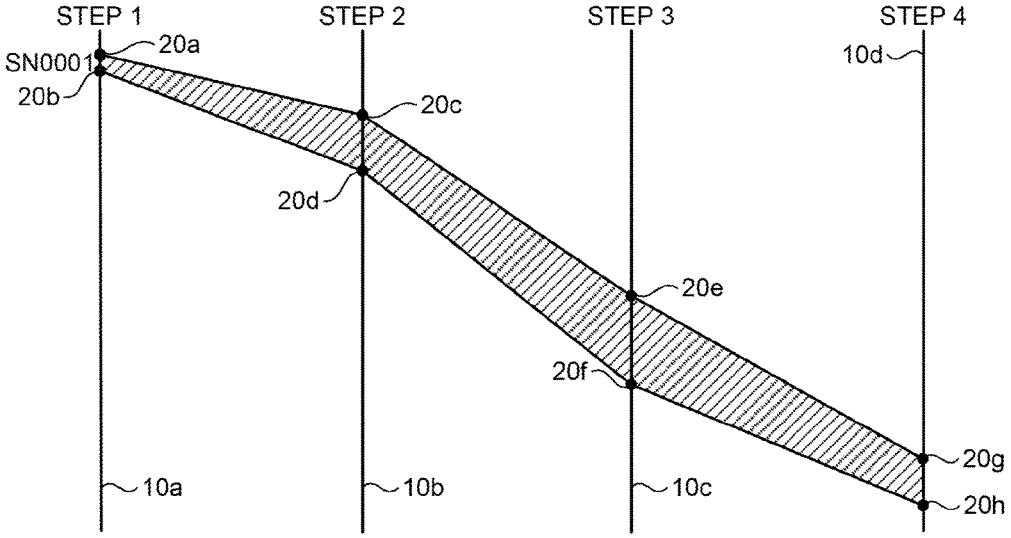
FIG. 7 is a schematic diagram illustrating a first example of a real time display of a graph according to the first embodiment.

FIG. 7 is a schematic diagram illustrating a first example of a real time display of a graph. FIG. 7 is a display example associated with NO. 1 in Table 1 illustrated in FIG. 6. In Log data 121*a* indicated by the example illustrated in FIG. 7, for the product number "SN0001", the start time and the end time of all of the steps 1 to 4 are stored. The displaying unit 113 disposes, on the time axis 10*a* of the step 1, the starting point 20*a* and the end point 20*b* of the processing period based on the log data 121*a*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes, on the time axis 10*d* of the step 4, the starting point 20*g* and the end point 20*h* of the processing period.

The displaying unit 113 creates the line connecting points 20*a*, 20*c*, 20*e*, and 20*g* associated with the starting point of the processing periods of the steps of "SN0001". Furthermore, the displaying unit 113 creates the line connecting 20*b*, 20*d*, 20*f*, and 20*h* associated with the end point of the processing periods of the steps of "SN0001". Consequently, the displaying unit 113 creates a strip shaped region representing the processing periods of the steps of "SN0001". The region created by connecting the processing periods or connecting a processing period and the position corresponding to the current time performed for the same product is referred to as a "strip". The displaying unit 113 adds a normal color to the strip related to "SN0001" such that the region can be distinguished from the surrounding region.

Figure 8:
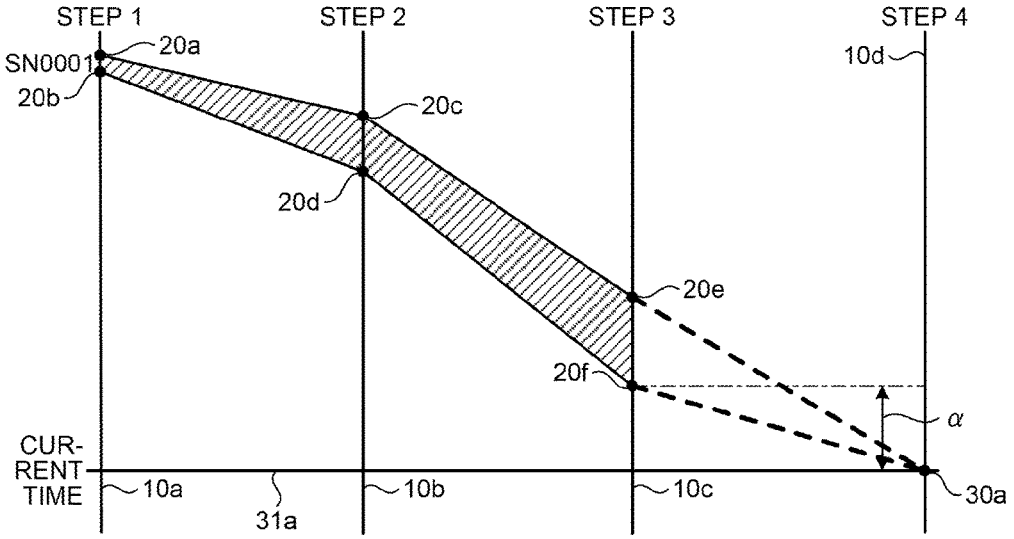
FIG. 8 is a schematic diagram illustrating a second example of a real time display of a graph according to the first embodiment.

FIG. 8 is a schematic diagram illustrating a second example of a real time display of a graph. FIG. 8 is a display example associated with NO. 2 in Table 1 in FIG. 6. In log data 121*b* indicated by the example illustrated in FIG. 8, for the product number "SN0001", the start time and the end time of all of the steps 1 to 3 are stored, but the start time and the end time of the step 4 is not stored. The displaying unit 113 disposes, on the time axis 10*a* of the step 1, the starting point 20*a* and the end point 20*b* of the processing period based on the log data 121*b*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30*a* of a line 31*a* representing the current time and the time axis 10*d* of the step 4.

The displaying unit 113 displays the strip that is formed by the line connecting the starting points 20*a*, 20*c*, and 20*e* of the processing periods of each of the steps and the line connecting the end points 20*b*, 20*d*, and 20*f* of the processing periods of each of the steps. The displaying unit 113 adds the normal color in the strip.

Because a difference α between the end point 20*f* of the processing period associated with the step 3 and the line 31*a* representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. The displaying unit 113 displays, based on the determination result, the strip that is formed by the dotted line connecting the starting point 20*e* of the processing period of the step 3 and the intersection point 30*a* and the dotted line connecting the end point 20*f* and the intersection point 30*a*.

Figure 9:
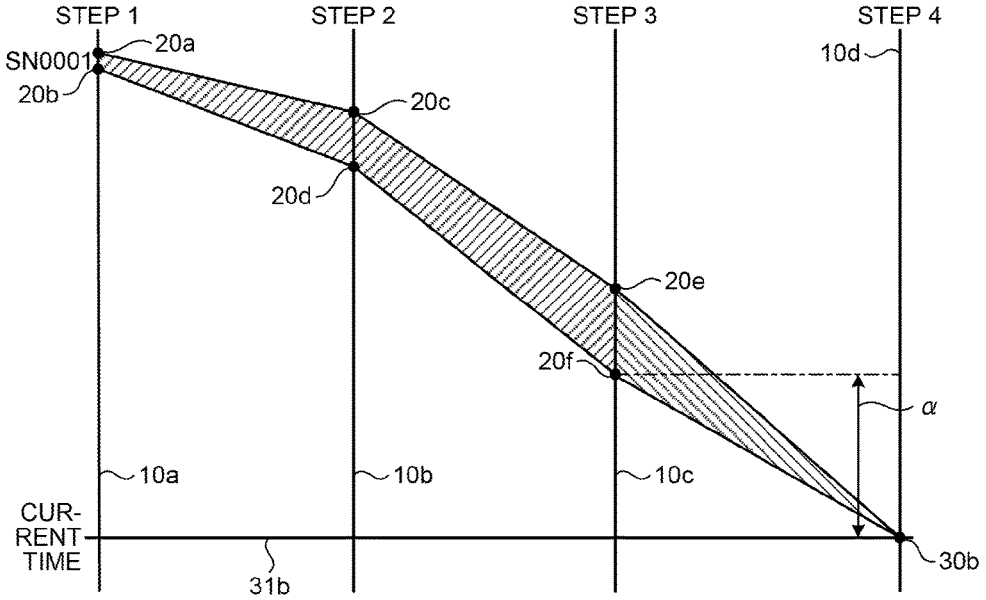
FIG. 9 is a schematic diagram illustrating a third example of a real time display of a graph according to the first embodiment.

FIG. 9 is a schematic diagram illustrating a third example of a real time display of a graph. FIG. 9 is a display example associated with NO. 3 in Table 1 illustrated in FIG. 6. In the example illustrated in FIG. 9, the same log data 121*b* as that used in the example illustrated in FIG. 8 is used. Similarly to the example illustrated in FIG. 8, the displaying unit 113 disposes the starting points 20*a*, 20*c*, and 20*e* of the processing periods of each of the steps, the end points 20*b*, 20*d*, and 20*f* of the processing periods of each of the steps, and an intersection point 30*b*. Furthermore, the displaying unit 113 adds the normal color to the strip formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*b* representing the current time is equal to or greater than the waiting period LEVEL1 and is smaller than the waiting period LEVEL2. In response to the notification from the detecting unit 112, the displaying unit 113 adds yellow to the strip that is formed by the line connecting the starting point 20*e* of the processing period of the step 3 and the intersection point 30*b* and the line connecting the end point 20*f* of the processing period of the step 3 and the intersection point 30*b*. In this case, the shape of the strip represented in yellow is a triangle. Yellow is only an example and any color or any type of shading may also be used for representing inside the strip as long as an alarm state can be identified.

Figure 10:
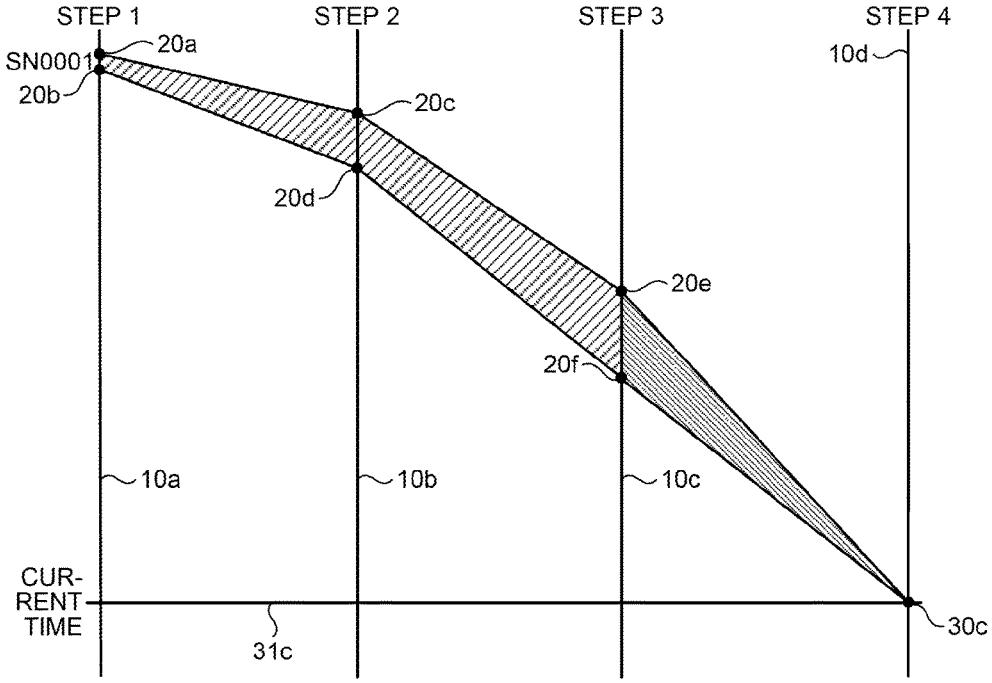
FIG. 10 is a schematic diagram illustrating a fourth example of a real time display of a graph according to the first embodiment.

FIG. 10 is a schematic diagram illustrating a fourth example of a real time display of a graph. FIG. 10 is a display example associated with NO. 4 in Table 1 illustrated in FIG. 6. In the example illustrated in FIG. 10, the same log data 121*b* as that used in the example illustrated in FIG. 8 is used. Similarly to the example illustrated in FIG. 8, the displaying unit 113 disposes the starting points 20*a*, 20*c*, and 20*e* of the processing periods of each of the steps, the end points 20*b*, 20*d*, and 20*f* of the processing periods of each of the steps, and an intersection point 30*c*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*c* representing the current time is equal to or greater than the waiting period LEVEL2. In response to the notification from the detecting unit 112, the displaying unit 113 adds red to the strip that is formed by the line connecting the starting point 20*e* of the processing period of the step 3 and the intersection point 30*c* and the line connecting the end point 20*f* thereof and the intersection point 30*c*. In this case, the shape of the strip represented in red is a triangle. Red is only an example and any color or any type of shading may also be used for representing inside the strip as long as an alarm state in which the degree of abnormality is greater than that in the state of NO. 3 can be identified.

Figure 11:
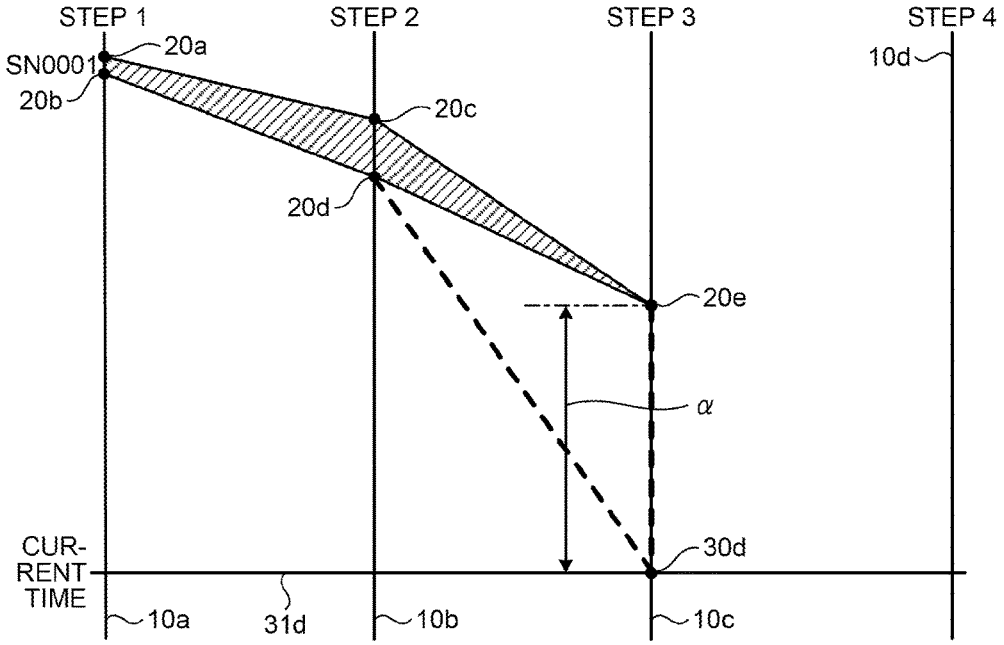
FIG. 11 is a schematic diagram illustrating a fifth example of a real time display of a graph according to the first embodiment.

FIG. 11 is a schematic diagram illustrating a fifth example of a real time display of a graph. FIG. 11 is a display example associated with NO. 5 in Table 1 illustrated in FIG. 6. In log data 121*c* indicated by the example illustrated in FIG. 11, for the product number "SN0001", the start time and the end time of the step 1 and the step 2 and the start time of the step 3 are stored, but the end time of the step 3 and the subsequent data are not stored.

The displaying unit 113 disposes, on the time axis 10*a* of the step 1, the starting point 20*a* and the end point 20*b* of the processing period based on the log data 121*c*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* of the processing period. The displaying unit 113 disposes an intersection point 30*d* of a line 31*d* representing the current time and the time axis 10*c* of the step 3.

The displaying unit 113 displays the strip that is formed by the line connecting the starting points 20*a*, 20*c*, and 20*e* of the processing periods of each of the steps and the line connecting the end points 20*b* and 20*d* and the starting point 20*e* of the processing periods of each of the steps. The displaying unit 113 adds the normal color to the strip.

Because the difference α between the starting point 20*e* of the processing period associated with the step 3 and the line 31*d* representing the current time is smaller than the processing period LEVEL1, the detecting unit 112 does not send a notification to the displaying unit 113. Because no notification is sent from the detecting unit 112, the displaying unit 113 determines that the difference α is smaller than the processing period LEVEL1. The displaying unit 113 displays, based on the determination result, the strip that is formed by the dotted line connecting the starting point 20*e* of the processing period of the step 3 and the intersection point 30*d* and the dotted line connecting the end point 20*d* of the processing period of the step 2 and the intersection point 30*d*.

Figure 12:
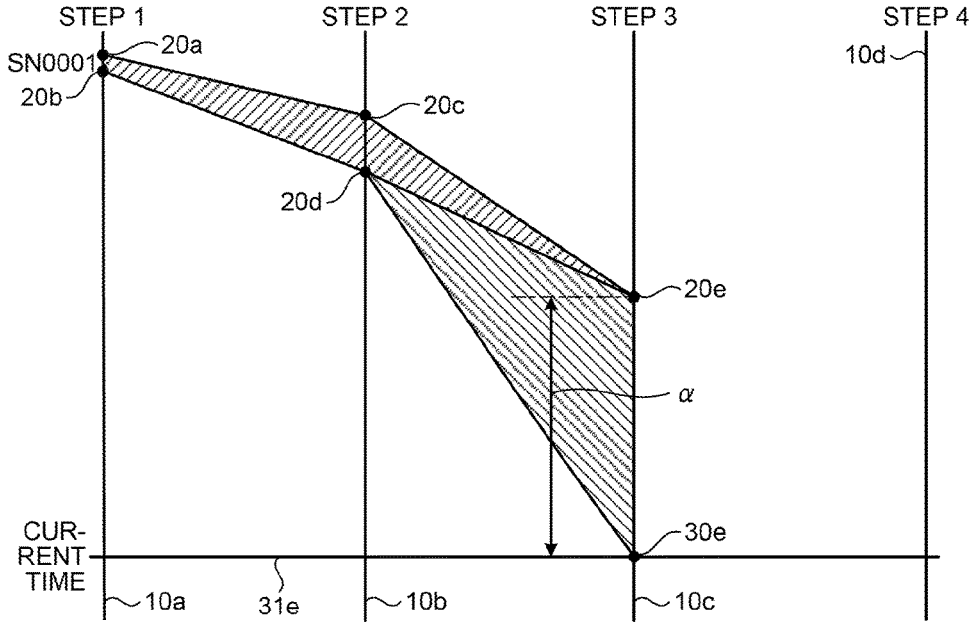
FIG. 12 is a schematic diagram illustrating a sixth example of a real time display of a graph according to the first embodiment.

FIG. 12 is a schematic diagram illustrating a sixth example of a real time display of a graph. FIG. 12 is a display example associated with NO. 6 in Table 1 illustrated in FIG. 6. In the example illustrated in FIG. 12, the same log data 121*c* as that used in the example illustrated in FIG. 11 is used. Similarly to the example illustrated in FIG. 11, the displaying unit 113 disposes the starting points 20*a*, 20*c*, and 20*e* of the processing periods of each of the steps, the end points 20*b* and 20*d* of the processing periods of each of the steps, and an intersection point 30*e*. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference α between the starting point 20*e* of the processing period associated with the step 3 and a line 31*e* representing the current time is equal to or greater than the processing period LEVEL1 and is smaller than the processing period LEVEL2. In response to the notification from the detecting unit 112, the displaying unit 113 adds yellow to the strip that is formed by the line connecting the starting point 20*e* of the processing period of the step 3 and the intersection point 30*e* and the line connecting the end point 20*d* of the step 2 and the intersection point 30*e*. In this case, the shape of the strip represented in yellow is a triangle. Yellow is only an example and any color or any type of shading may also be used for representing inside the strip as long as an alarm state can be identified.

Figure 13:
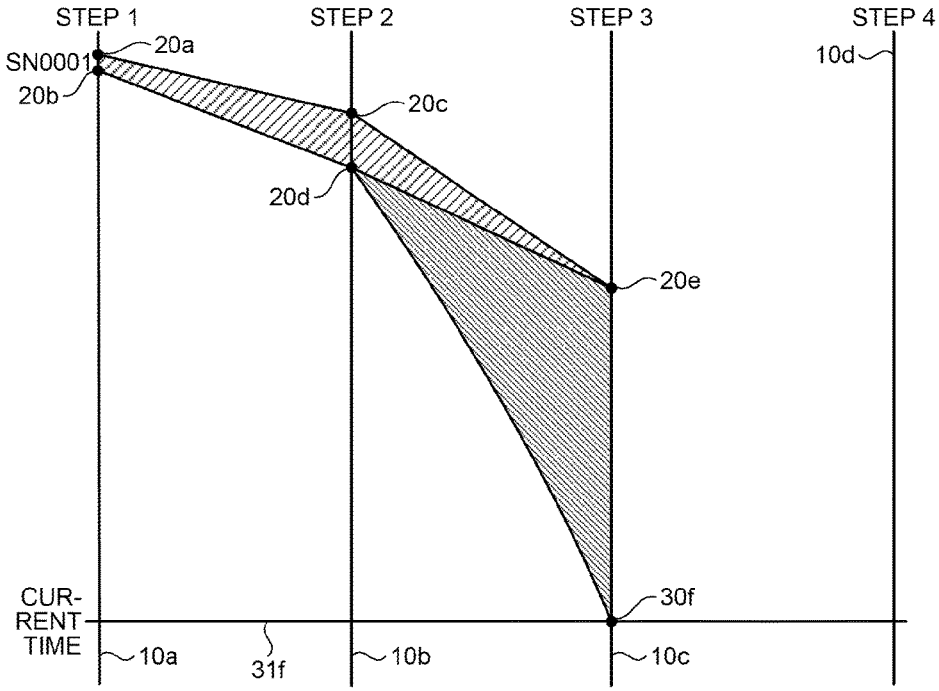
FIG. 13 is a schematic diagram illustrating a seventh example of a real time display of a graph according to the first embodiment.

FIG. 13 is a schematic diagram illustrating a seventh example of a real time display of a graph. FIG. 13 is a display example associated with NO. 7 in Table 1 illustrated in FIG. 6. In the example illustrated in FIG. 13, the same log data 121*c* as that used in the example illustrated in FIG. 11 is used. Similarly to the example illustrated in FIG. 11, the displaying unit 113 disposes the starting points 20*a*, 20*c*, and 20*e* of the processing periods of each of the steps, the end points 20*b* and 20*d* of the processing periods of each of the steps, and an intersection point 30*f*. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference α between the starting point 20*e* of the processing period associated with the step 3 and a line 31*f* representing the current time is equal to or greater than the processing period LEVEL2. In response to the notification from the detecting unit 112, the displaying unit 113 adds red to the strip that is formed by the line connecting the starting point 20*e* of the processing period of the step 3 and the intersection point 30*f* and the line connecting the end point 20*d* of the step 2 and the intersection point 30*f*. In this case, the shape of the strip represented in red is a triangle. Red is only an example and any color or any type of shading may also be used for representing inside the strip as long as an alarm state in which the degree of abnormality is greater than that in the state of NO. 6 can be identified.

Process Flow of a Real Time Display

Figure 14:
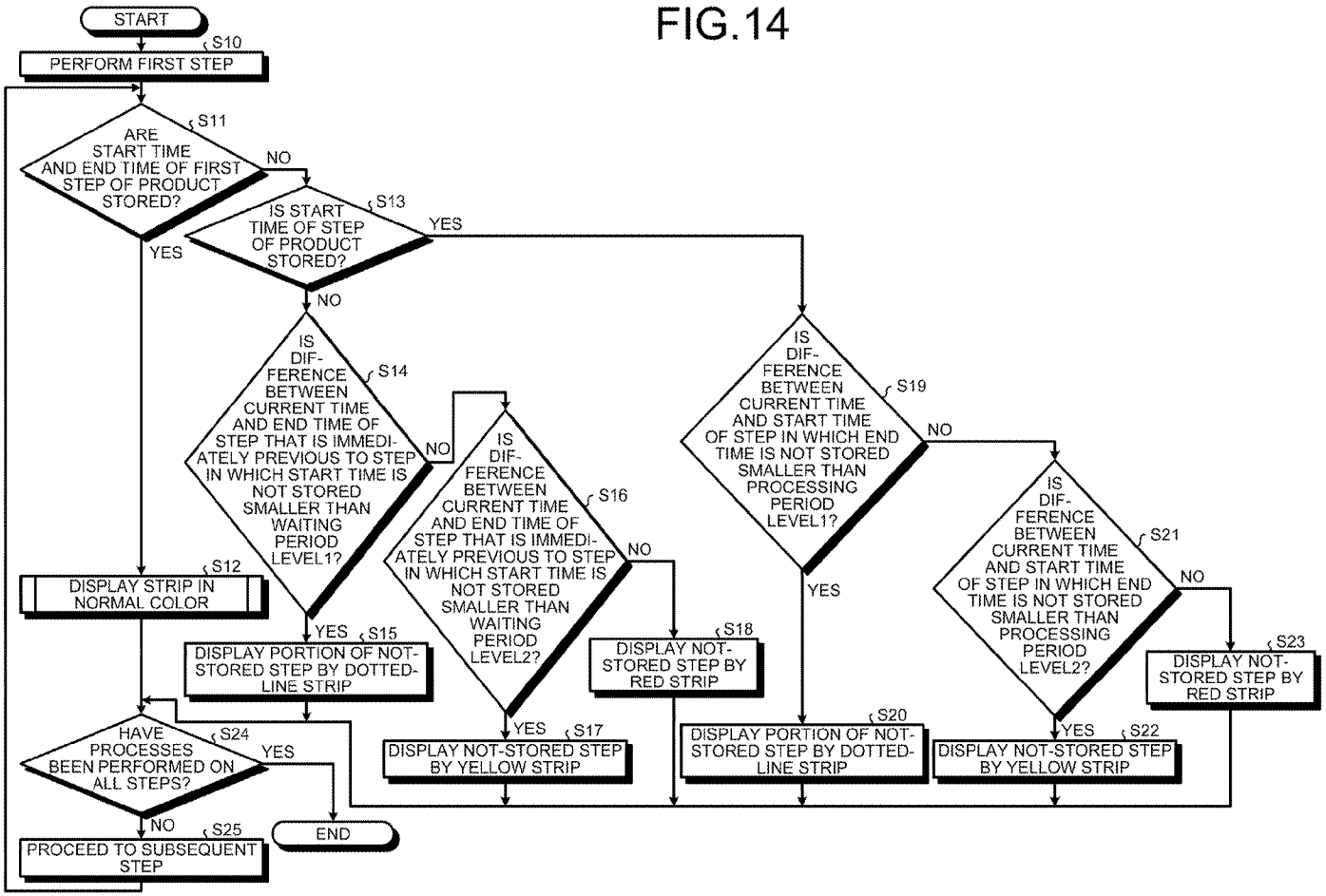
FIG. 14 is a flow chart illustrating the process flow of the real time display of the graph according to the first embodiment.

FIG. 14 is a flow chart illustrating the process flow of the real time display of the graph. The example illustrated in FIG. 14 indicates the flow of a process in which the displaying unit 113 displays a strip of the processing periods related to a certain product. If several products are present, the displaying unit 113 performs the flow of the process illustrated in FIG. 14 on each of the products.

First, the displaying unit 113 performs a first step (Step S10). The displaying unit 113 refers to the log data 121 and determines whether the start time and the end time of the first step of the product are stored (Step S11). If the start time and the end time of the first step of the product is stored (Yes at Step S11), the displaying unit 113 displays a normal color strip (Step S12). For the process at Step S12 will be described later in the sub flow.

In contrast, if the start time and the end time of the first step of the product is not stored (No at Step S11), the displaying unit 113 proceeds to Step S13. At Step S13, the displaying unit 113 determines whether the start time of the step of the product is stored (Step S13). If the start time of the step of the product is not stored (No at Step S13), the displaying unit 113 proceeds to the process at Step S14. In contrast, if the start time of the step of the product is stored (Yes at Step S13), the displaying unit 113 proceeds to Step S19.

At Step S14, the displaying unit 113 determines whether the difference between the end time of the step, which is immediately previous to the step in which the start time is not stored, and the current time is smaller than the waiting period LEVEL1 (Step S14). If the difference is smaller than the waiting period LEVEL1 (Yes at Step S14), the displaying unit 113 displays the portion of the not-stored step by a dotted-line strip (Step S15). In contrast, if the difference is equal to or greater than the waiting period LEVEL1 (No at Step S14), the displaying unit 113 proceeds to Step S16.

At Step S16, the displaying unit 113 determines whether the difference between the end time of the step, which is immediately previous to the step in which the start time is not stored, and the current time is smaller than the waiting period LEVEL2 (Step S16). If the difference is smaller than the waiting period LEVEL2 (Yes at Step S16), the displaying unit 113 the portion of the not-stored step by a yellow strip (Step S17). In contrast, if the difference is equal to or greater than the waiting period LEVEL2 (No at Step S16), the displaying unit 113 displays the not-stored step by a red strip (Step S18).

At Step S19, the displaying unit 113 determines whether the difference between the start time of the step in which the end time is not stored and the current time is smaller than the processing period LEVEL1 (Step S19). If the difference is smaller than the processing period LEVEL1 (Yes at Step S19), the displaying unit 113 displays the portion of the not-stored step by a dotted-line strip (Step S20). In contrast, if the difference is equal to or greater than the processing period LEVEL1 (No at Step S19), the displaying unit 113 proceeds to the process at Step S21.

At Step S21, the displaying unit 113 determines whether the difference between the start time of the step in which the end time is not stored and the current time is smaller than the processing period LEVEL2 (Step S21). If the difference is smaller than the processing period LEVEL2 (Yes at Step S21), the displaying unit 113 displays the portion of the not-stored step by a yellow strip (Step S22). In contrast, if the difference is equal to or greater than the processing period LEVEL2 (No at Step S21), the displaying unit 113 displays the not-stored step by a red strip (Step S23).

Then, the displaying unit 113 determines whether the processes have been performed on all of the steps (Step S24). If an unprocessed step is present (No at Step S24), the displaying unit 113 proceeds to the subsequent step (Step S25), returns to Step S11, and performs the process on the subsequent step. In contrast, if the displaying unit 113 has completed the processes on all of the steps (Yes at Step S24), the displaying unit 113 ends the processes.

If another product to be processed is present, the displaying unit 113 also performs the flow of the process illustrated in FIG. 14 on the other product that is targeted for the process.

Process Flow of Displaying a Strip

Figure 15:
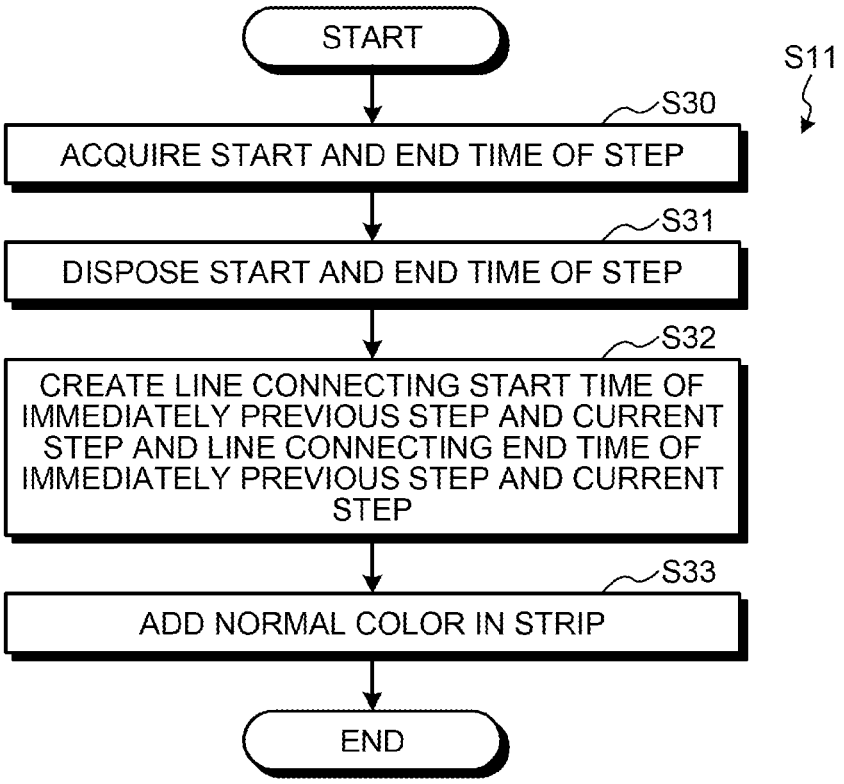
FIG. 15 is a flow chart illustrating the process flow of displaying a strip on a graph.

FIG. 15 is a flow chart illustrating the process flow of displaying a strip on a graph. The example illustrated in FIG. 15 is associated with the process at Step S11.

The displaying unit 113 acquires the start time and the end time of a certain step (Step S30). The displaying unit 113 disposes, on the time axis associated with the step, the start time and the end time (Step S31). Disposing the start time and the end time on the time axis also means that the displaying unit 113 disposes, on the time axis associated with the step, the processing period (the time period from the start time to the end time) and the waiting period (the time period from the end time and the subsequent start time).

The displaying unit 113 creates the line connecting the start time of the immediately previous step and the current step and the line connecting the end time of the immediately previous step and the current step (Step S32). The displaying unit 113 adds the normal color to the strip represented by the created two lines (Step S33).

Another Example of a Real Time Display (1)

Figure 16:
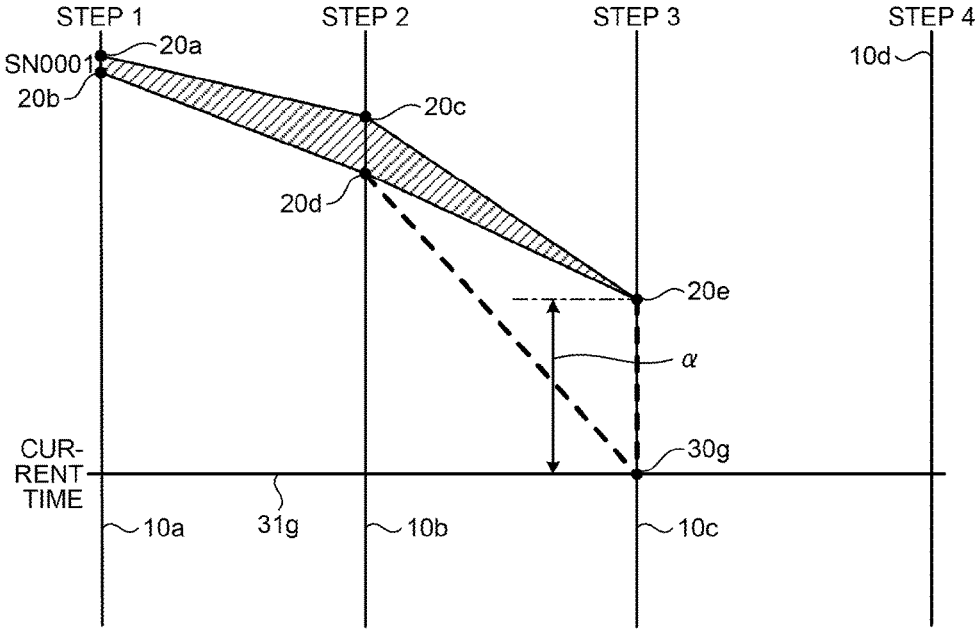
FIG. 16 is a schematic diagram illustrating an eighth example of a real time display of a graph according to the first embodiment.

Another example of a real time display according to the first embodiment will be described. FIG. 16 is a schematic diagram illustrating an eighth example of a real time display of a graph according to the first embodiment. FIG. 16 is a display example associated with NO. 5 in Table 1 illustrated in FIG. 6. Log data 121*d* indicated by the example illustrated in FIG. 16 is the same as the log data 121*c* related to FIG. 11.

The displaying unit 113 disposes, on the time axis 10*a* of the step 1, the starting point 20*a* and the end point 20*b* of the processing period based on the log data 121*d*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* of the processing period. The displaying unit 113 disposes an intersection point 30*g* of a line 31*g* that represents the current time and the time axis 10*c* of the step 3.

The displaying unit 113 displays the strip that is formed by the line connecting the starting points 20*a*, 20*c*, and 20*e* of the processing periods and the line connecting the end points 20*b* and 20*d* and the starting point 20*e* of the processing periods. The displaying unit 113 adds the normal color to the strip.

Because the difference $\alpha$ between the starting point 20*e* of the processing period associated with the step 3 and the line 31*g* representing the current time is smaller than the processing period LEVEL1, the detecting unit 112 does not send a notification to the displaying unit 113. Because no notification is sent from the detecting unit 112, the displaying unit 113 determines that the difference $\alpha$ is smaller than the processing period LEVEL1. The displaying unit 113 displays, based on the determination result, the strip that is formed by the dotted line connecting the starting point 20*e* of the processing period of the step 3 and the intersection point 30*g* and the dotted line connecting the end point 20*d* of the processing period of the step 2 and the intersection point 30*g*.

Figure 17:
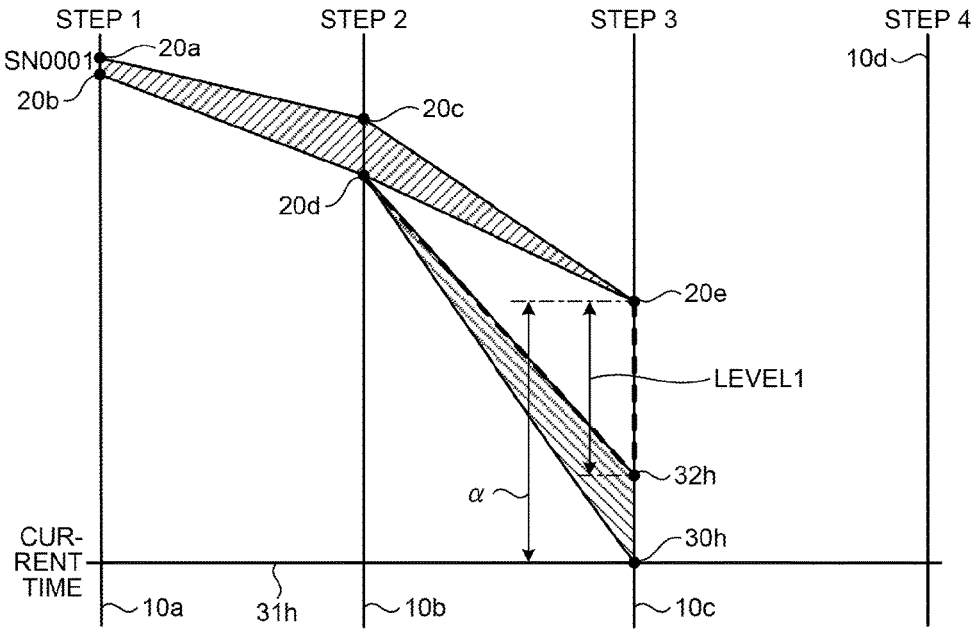
FIG. 17 is a schematic diagram illustrating a ninth example of a real time display of a graph according to the first embodiment.

FIG. 17 is a schematic diagram illustrating a ninth example of a real time display of a graph. FIG. 17 is a display example associated with NO. 6 in Table 1 illustrated in FIG. 6. In the example illustrated in FIG. 17, the same log data 121*d* as that used in the example illustrated in FIG. 16 is used. Similarly to the example illustrated in FIG. 16, the displaying unit 113 disposes the starting points 20*a*, 20*c*, and 20*e* of the processing periods, the end points 20*b* and 20*d* of the processing periods, and an intersection point 30*h*. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference $\alpha$ between the starting point 20*e* of the processing period associated with the step 3 and a line 31*h* representing the current time is equal to or greater than the processing period LEVEL1 and is smaller than the processing period LEVEL2. In response to the notification from the detecting unit 112, the displaying unit 113 performs the following process. First, the displaying unit 113 disposes, on the time axis 10*c*, a point 32*h* at the position obtained by adding the processing period LEVEL1 to the start time of the step 3.

The displaying unit 113 displays the dotted line connecting the starting point 20*e* of the processing period of the step 3 and the intersection point 32*h* and the dotted line connecting the end point 20*d* of the step 2 and the point 32*h*. The displaying unit 113 adds yellow to the triangular strip that is formed by the line connecting the end point 20*d* of the step 2 and the point 32*h* and the line connecting the end point 20*d* of the step 2 and the intersection point 30*h*. Consequently, the displaying unit 113 can display the graph such that the length of time elapsed from the processing period LEVEL1 can be displayed in an easily understandable manner.

Figure 18:
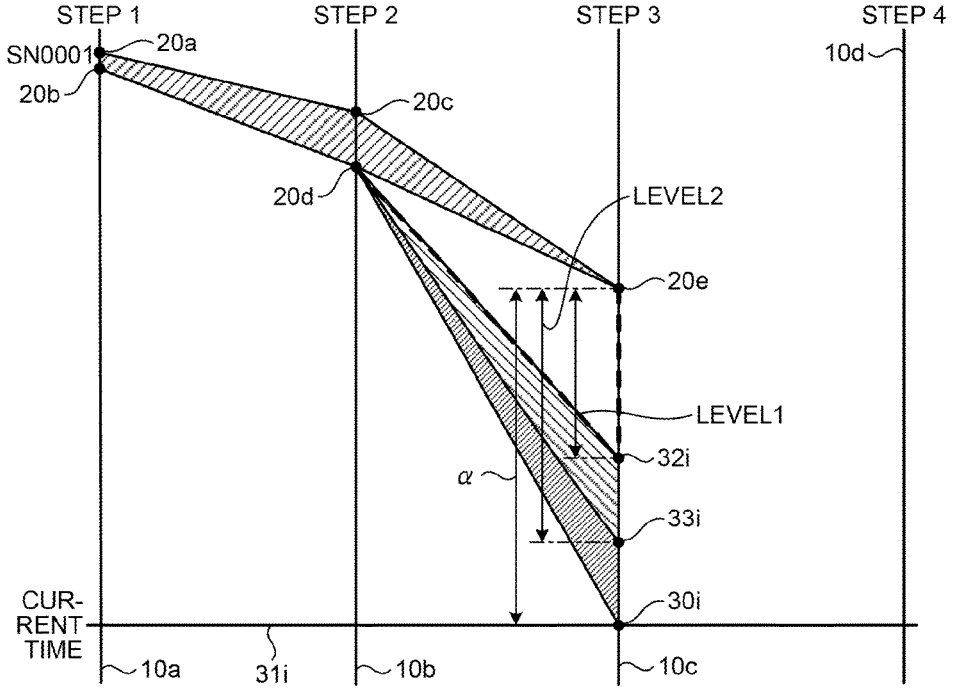
FIG. 18 is a schematic diagram illustrating a tenth example of a real time display of a graph according to the first embodiment.

FIG. 18 is a schematic diagram illustrating a tenth example of a real time display of a graph. FIG. 18 is a display example associated with NO. 7 in Table 1 illustrated in FIG. 6. In the example illustrated in FIG. 18, the same log data 121*d* as that used in the example illustrated in FIG. 16 is used. Similarly to the example illustrated in FIG. 16, the displaying unit 113 disposes the starting points 20*a*, 20*c*, and 20*e* of the processing periods, the end points 20*b* and 20*d* of the processing periods, and an intersection point 30*i*. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference α between the starting point 20*e* of the processing period associated with the step 3 and a line 31*i* representing the current time is equal to or greater than the processing period LEVEL2. In response to the notification from the detecting unit 112, the displaying unit 113 performs the following process. First, the displaying unit 113 disposes, on the time axis 10*c*, a point 32*i* at the position obtained by adding the processing period LEVEL1 to the start time of the step 3. Namely, the point 32*i* is disposed at the same position of the point 32*h* illustrated in FIG. 17. Furthermore, the displaying unit 113 disposes, on the time axis 10*c*, a point 33*i* at the position obtained by adding the processing period LEVEL2 to the start time of the step 3.

The displaying unit 113 displays the dotted line connecting the starting point 20*e* of the processing period of the step 3 and the point 32*i* and the line connecting the dotted line connecting the end point 20*d* of the step 2 and the point 32*i*. The displaying unit 113 adds yellow to the triangular strip that is formed by the line connecting the end point 20*d* of the step 2 and the point 32*i* and the line connecting the end point 20*d* of the step 2 and the point 33*i*. Furthermore, the displaying unit 113 adds red to the triangular strip that is formed by the line connecting the end point 20*d* of the step 2 and the point 33*i* and the line connecting the end point 20*d* of the step 2 and the intersection point 30*i*. Consequently, the displaying unit 113 can display the graph such that the length of time elapsed from the processing period LEVEL2 can be displayed in an easily understandable manner.

Another Example of a Real Time Display (2)

Figure 19:
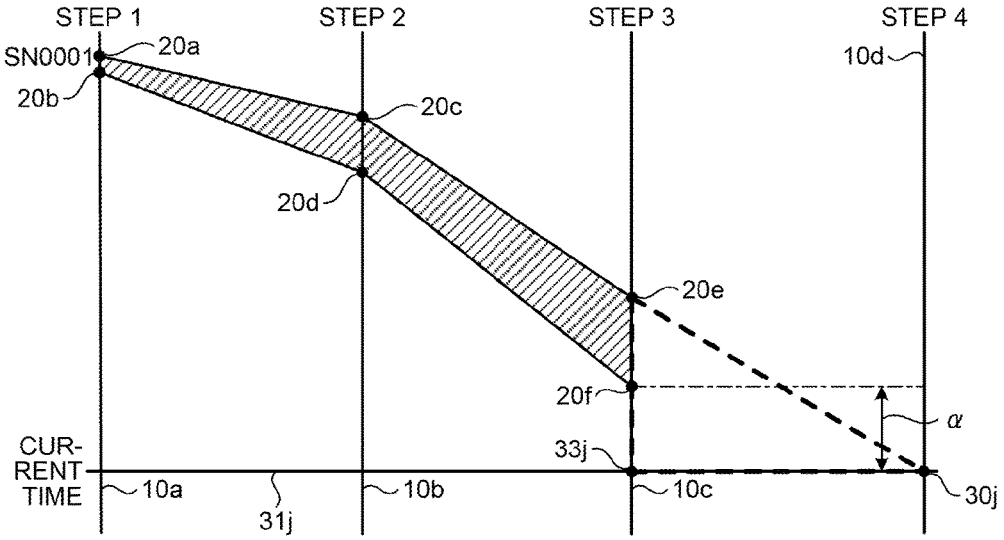
FIG. 19 is a schematic diagram illustrating an $11^{th}$ example of a real time display of a graph according to the first embodiment.

FIG. 19 is a schematic diagram illustrating an $11^{th}$ example of a real time display of a graph. FIG. 19 is a display example associated with NO. 2 in Table 1 illustrated in FIG. 6. Log data 121*e* illustrated in FIG. 19 is the same as the log data 121*b* related to FIG. 8.

The displaying unit 113 disposes, on the time axis 10*a* of the step 1, the starting point 20*a* and the end point 20*b* of the processing period based on the log data 121*e*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30*j* of a line 31*j* representing the current time and the time axis 10*d* of the step 4. The displaying unit 113 disposes an intersection point 33*j* of the line 31*j* representing the current time and the time axis 10*c* of the step 3.

The displaying unit 113 displays the strip that is formed by the line connecting the starting points 20*a*, 20*c*, and 20*e* of the processing periods and the line connecting the end points 20*b*, 20*d*, and 20*f* of the processing periods. The displaying unit 113 adds the normal color to the strip.

Because the difference α between the end point 20*f* of the processing period associated with the step 3 and the line 31*j* representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. The displaying unit 113 connects, based on the determination result, the starting point 20*e* of the processing period of the step 3, the intersection point 30*j*, and the intersection point 33*j* by the dotted line and displays the triangle with the vertices of the starting point 20*e*, the intersection point 30*j*, and the intersection point 33*j*.

Figure 20:
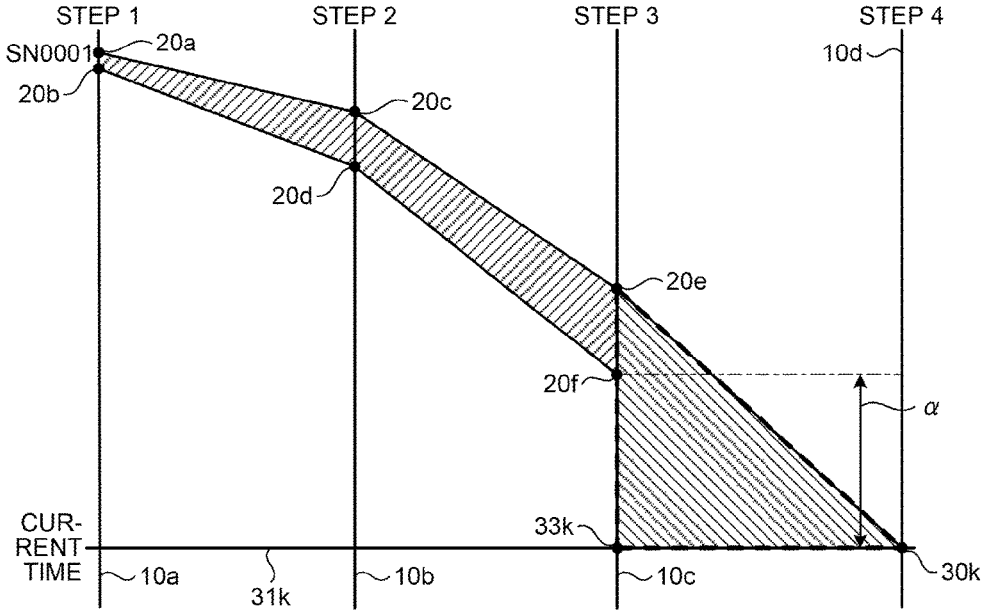
FIG. 20 is a schematic diagram illustrating a $12^{th}$ example of a real time display of a graph according to the first embodiment.

FIG. 20 is a schematic diagram illustrating a $12^{th}$ example of a real time display of a graph. FIG. 20 is a display example associated with NO. 3 in Table 1 illustrated in FIG. 6. The log data 121*e* indicated by the example illustrated in FIG. 20 is the same as the log data 121*e* related to in FIG. 19. Similarly to the example illustrated in FIG. 19, the displaying unit 113 disposes the starting points 20*a*, 20*c*, and 20*e* of the processing periods, the end points 20*b*, 20*d*, 20*f* of the processing periods, an intersection point 30*k*, and an intersection point 33*k*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*k* representing the current time is equal to or greater than the waiting period LEVEL1 and is smaller than the waiting period LEVEL2. In response to the notification from the detecting unit 112, the displaying unit 113 connects the starting point 20*e* of the processing period of the step 3, the intersection point 30*k*, and the intersection point 33*k* by the dotted line and displays the triangle with the vertices of the starting point 20*e*, the intersection point 30*k*, and the intersection point 33*k*. The displaying unit 113 adds yellow to the displayed triangle.

Figure 21:
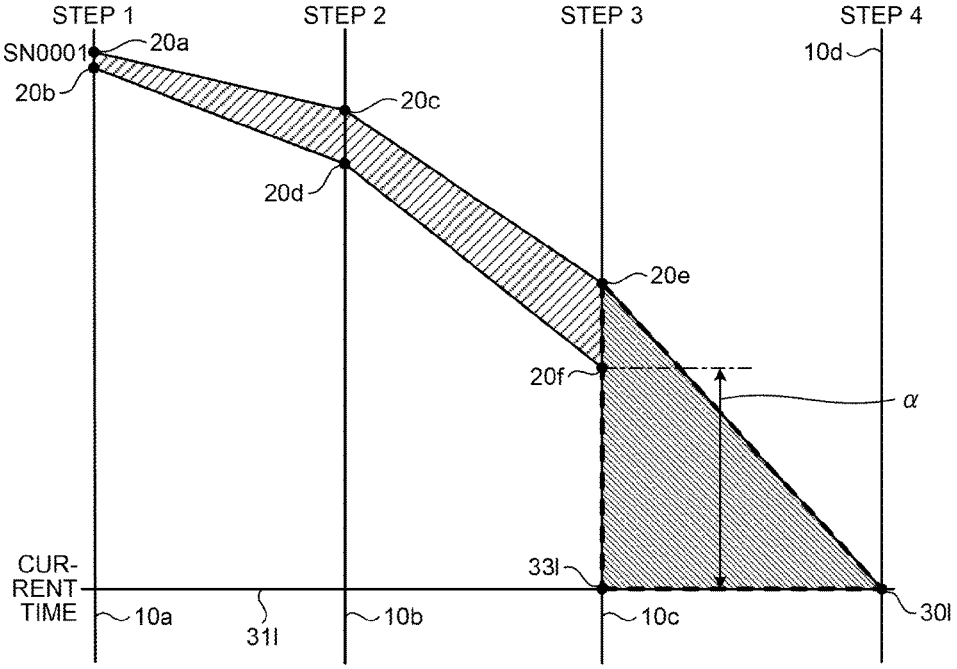
FIG. 21 is a schematic diagram illustrating a $13^{th}$ example of a real time display of a graph according to the first embodiment.

FIG. 21 is a schematic diagram illustrating a $13^{th}$ example of a real time display of a graph. FIG. 21 is a display example associated with NO. 4 in Table 1 illustrated in FIG. 6. The log data 121*e* indicated by the example illustrated in FIG. 21 is the same as the log data 121*e* related to FIG. 19. Similarly to the example illustrated in FIG. 19, the displaying unit 113 disposes the starting points 20*a*, 20*c*, 20*e* of the processing periods, the end points 20*b*, 20*d*, and 20*f* of the processing periods, an intersection point 30*l*, and an intersection point 33*l*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*l* representing the current time is equal to or greater than the waiting period LEVEL2. In response to the notification from the detecting unit 112, the displaying unit 113 connects the starting point 20*e* of the processing period of the step 3, the intersection point 30*l*, and the intersection point 33*l* by the dotted line and displays the triangle with the vertices of the starting point 20*e*, the intersection point 30*l*, and the intersection point 33*l*. The displaying unit 113 adds red to the displayed triangle.

Another Example of a Real Time Display (3)

Figure 22:
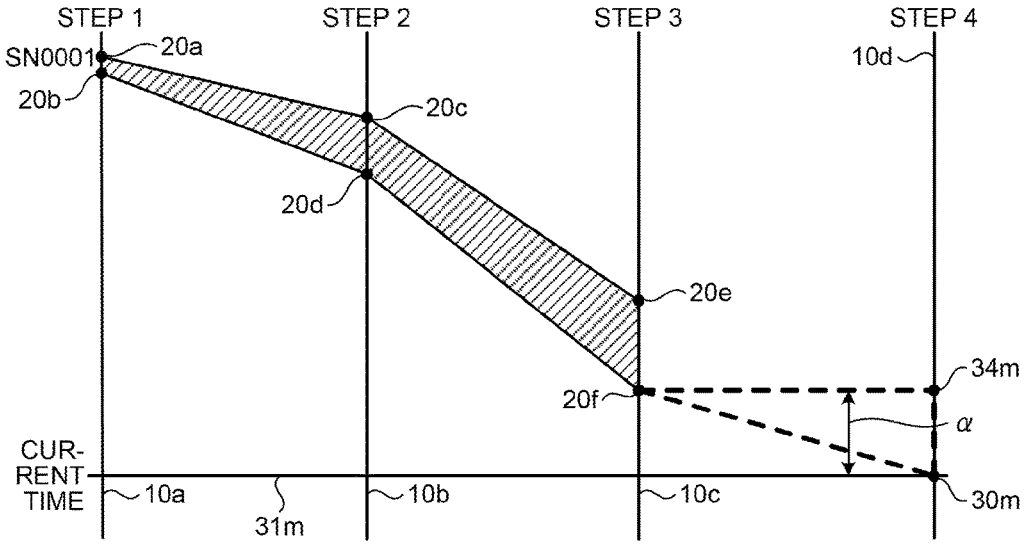
FIG. 22 is a schematic diagram illustrating a 14$^{th}$ example of a real time display of a graph according to the first embodiment.

FIG. 22 is a schematic diagram illustrating a 14$^{th}$ example of a real time display of a graph. FIG. 22 is a display example associated with NO. 2 in Table 1 illustrated in FIG. 6. Log data 121*f* indicated by the example illustrated in FIG. 22 is the same as the log data 121*b* related to FIG. 8.

The displaying unit 113 disposes, on the time axis 10*a* of the step 1, the starting point 20*a* and the end point 20*b* of the processing period based on the log data 121*f*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30*m* of a line 31*m* representing the current time and the time axis 10*d* of the step 4. The displaying unit 113 disposes an intersection point 34*m* of the perpendicular line extending from the end point 20*f* of the processing period of the step 3 to the time axis 10*d* and the time axis 10*d*.

The displaying unit 113 displays the strip that is formed by the line connecting the starting points 20*a*, 20*c*, and 20*e* of the processing periods and the line connecting the end points 20*b*, 20*d*, and 20*f* of the processing periods. The displaying unit 113 adds the normal color in the strip.

Because the difference α between the end point 20*f* of the processing period associated with the step 3 and the line 31*m* representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. The displaying unit 113 connects, based on the determination result, the end point 20*f* of the processing period of the step 3, the intersection point 30*m*, and the intersection point 34*m* by the dotted line and displays the triangle with the vertices of the end point 20*f*, the intersection point 30*m*, and the intersection point 34*m*.

Figure 23:
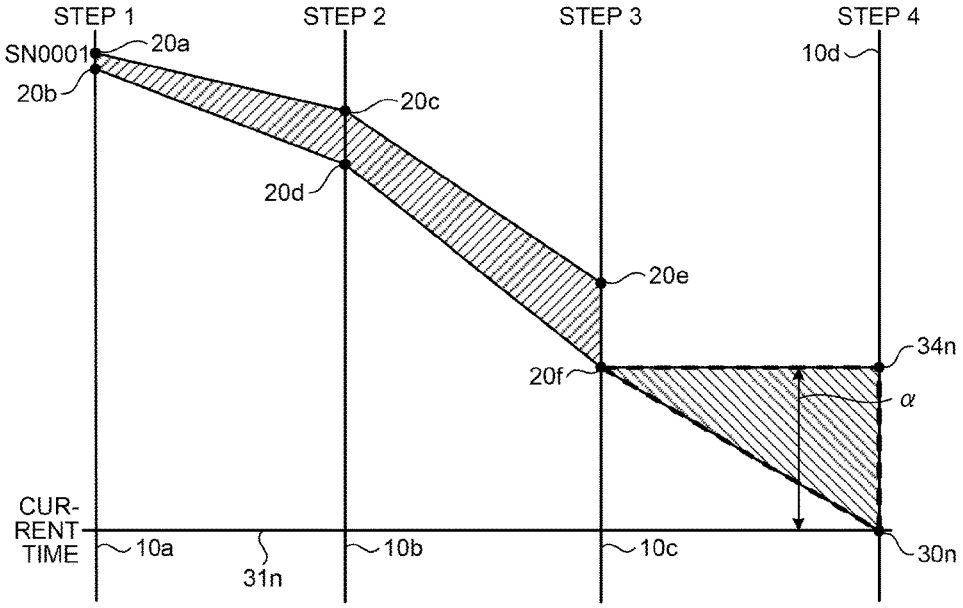
FIG. 23 is a schematic diagram illustrating a 15$^{th}$ example of a real time display of a graph according to the first embodiment.

FIG. 23 is a schematic diagram illustrating a 15$^{th}$ example of a real time display of a graph. FIG. 23 is a display example associated with NO. 3 in Table 1 illustrated in FIG. 6. The log data 121*f* indicated by the example illustrated in FIG. 23 is the same as the log data 121*f* related to FIG. 22. Similarly to the example illustrated in FIG. 22, the displaying unit 113 disposes the starting points 20*a*, 20*c*, and 20*e* of the processing periods, the end points 20*b*, 20*d*, and 20*f* of the processing periods, an intersection point 30*n*, and an intersection point 34*n*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*n* representing the current time is equal to or greater than the waiting period processing period LEVEL1 and is smaller than the waiting period LEVEL2. In response to the notification from the detecting unit 112, the displaying unit 113 connects the end point 20*f* of the processing period of the step 3, the intersection point 30*n*, and the intersection point 34*n* by the dotted line and displays the triangle with the vertices of the end point 20*f*, the intersection point 30*n*, and the intersection point 34*n*. The displaying unit 113 adds yellow to the displayed triangle.

Figure 24:
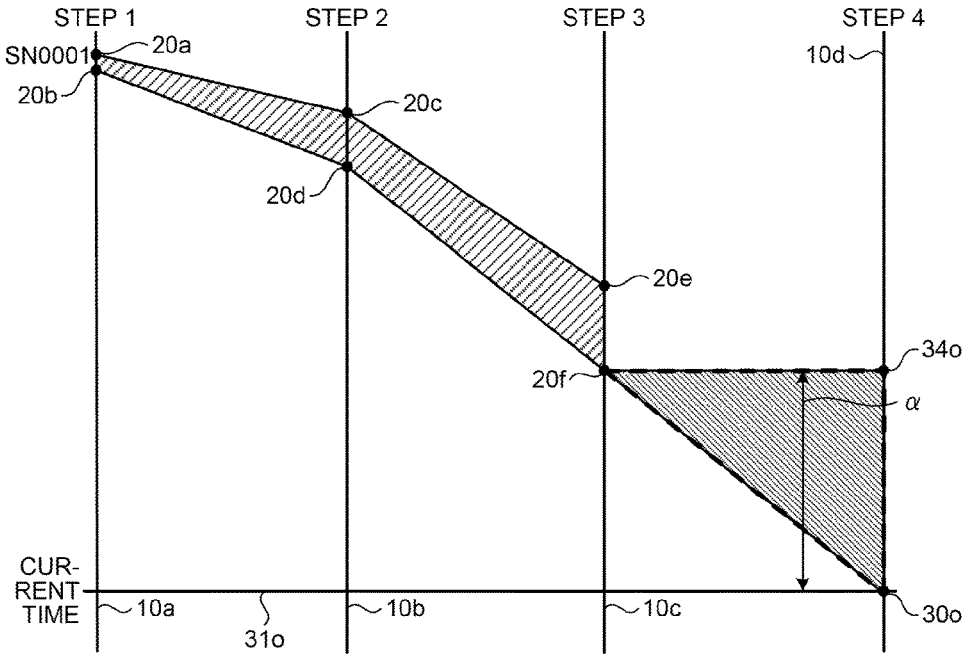
FIG. 24 is a schematic diagram illustrating a 16$^{th}$ example of a real time display of a graph according to the first embodiment.

FIG. 24 is a schematic diagram illustrating a 16$^{th}$ example of a real time display of a graph. FIG. 24 is a display example associated with NO. 4 in Table 1 illustrated in FIG. 6. The log data 121*f* indicated by the example illustrated in FIG. 24 is the same as the log data 121*f* related to FIG. 22. Similarly to the example illustrated in FIG. 22, the displaying unit 113 disposes the starting point 20*a*, 20*c*, and 20*e* of the processing periods, the end points 20*b*, 20*d*, and 20*f* of the processing periods, and an intersection point 30*o*, and an intersection point 34*o*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 310 representing the current time is equal to or greater than the waiting period LEVEL2. In response to the notification from the detecting unit 112, the displaying unit 113 connects the end point 20*f* of the processing period of the step 3, the intersection point 30*o*, and the intersection point 34*o* by the dotted line and displays the triangle with the vertices of the end point 20*f*, the intersection point 30*o*, and the intersection point 34*o*. The displaying unit 113 adds red in the displayed triangle.

Another Example of a Real Time Display (4)

Figure 25:
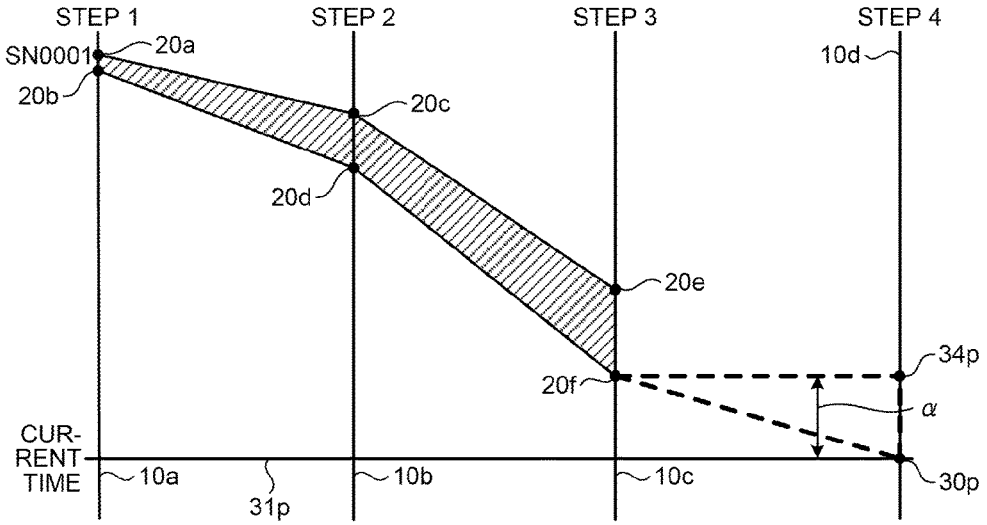
FIG. 25 is a schematic diagram illustrating a 17$^{th}$ example of a real time display of a graph according to the first embodiment.

FIG. 25 is a schematic diagram illustrating a 17$^{th}$ example of a real time display of a graph. FIG. 25 is a display example associated with NO. 2 in Table 1 illustrated in FIG. 6. Log data 121*g* indicated by the example illustrated in FIG. 25 is the same as the log data 121*b* related to FIG. 8.

The displaying unit 113 disposes, on the time axis 10*a* of the step 1, the starting point 20*a* and the end point 20*b* of the processing period based on the log data 121*g*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30*p* of a line 31*p* representing the current time and the time axis 10*d* of the step 4. The displaying unit 113 disposes an intersection point 34*p* of the perpendicular line extending from the end point 20*f* of the processing period of the step 3 to the time axis 10*d* and the time axis 10*d*.

The displaying unit 113 displays the strip that is formed by the line connecting the starting points 20*a*, 20*c*, and 20*e* of the processing periods and the line connecting the end points 20*b*, 20*d*, and 20*f* of the processing periods. The displaying unit 113 adds the normal color to the strip.

Because the difference α between the end point 20*f* of the processing period associated with the step 3 and the line 31*p* representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. The displaying unit 113 connects, based on the determination result, the end point 20*f* of the processing period of the step 3, the intersection point 30*p*, and the intersection point 34*p* by the dotted line and displays the triangle with the vertices of the end point 20*f*, the intersection point 30*p*, and the intersection point 34*p*.

Figure 26:
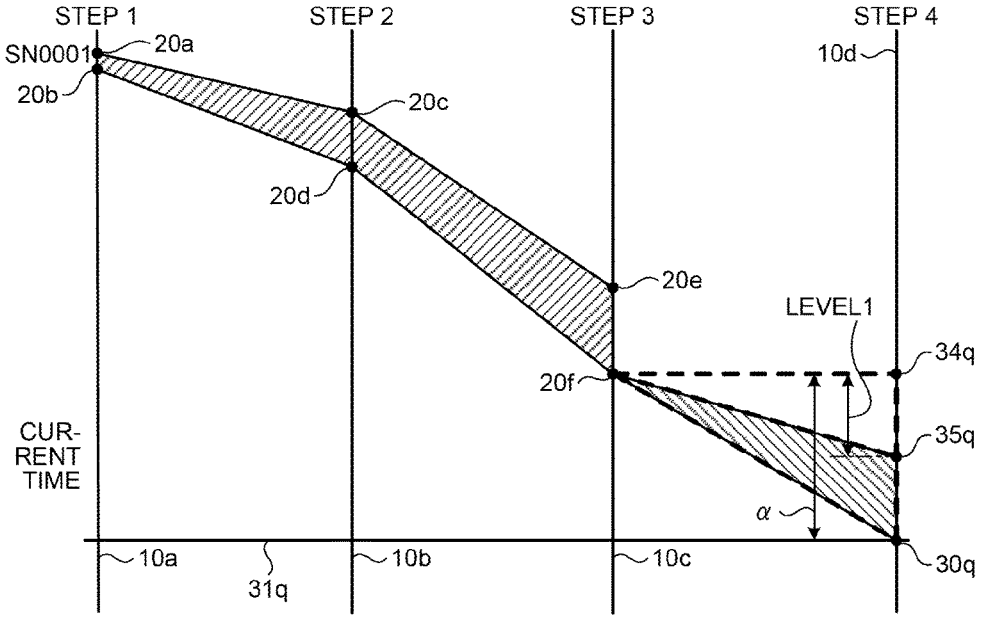
FIG. 26 is a schematic diagram illustrating an 18$^{th}$ example of a real time display of a graph according to the first embodiment.

FIG. 26 is a schematic diagram illustrating an $18^{th}$ example of a real time display of a graph. FIG. 26 is a display example associated with NO. 3 in Table 1 illustrated in FIG. 6. In the example illustrated in FIG. 26, the same log data 121*g* as that used in the example illustrated in FIG. 25 is used. Similarly to the example illustrated in FIG. 25, the displaying unit 113 disposes the starting points 20*a*, 20*c*, and 20*e* of the processing periods, the end points 20*b*, 20*d*, and 20*f* of the processing periods, and an intersection point 30*q*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*q* representing the current time is equal to or greater than the waiting period LEVEL1 and is smaller than the waiting period LEVEL2. In response to the notification from the detecting unit 112, the displaying unit 113 performs the following process. First, the displaying unit 113 disposes, on the time axis 10*d*, a point 35*q* at the position obtained by adding the waiting period LEVEL1 to the end time of the step 3.

The displaying unit 113 displays the dotted line connecting the end point 20*f* of the processing period of the step 3 and a point 34*q* and the dotted line connecting the end point 20*f* of the step 2 and the point 35*q*. The displaying unit 113 adds yellow to the strip that is formed by the dotted line connecting the end point 20*f* of the step 2 and the point 35*q* and the dotted line connecting the end point 20*f* of the step 2 and the intersection point 30*q*. Consequently, the displaying unit 113 can display the graph such that the length of time elapsed from the waiting period LEVEL1 can be displayed in an easily understandable manner.

Figure 27:
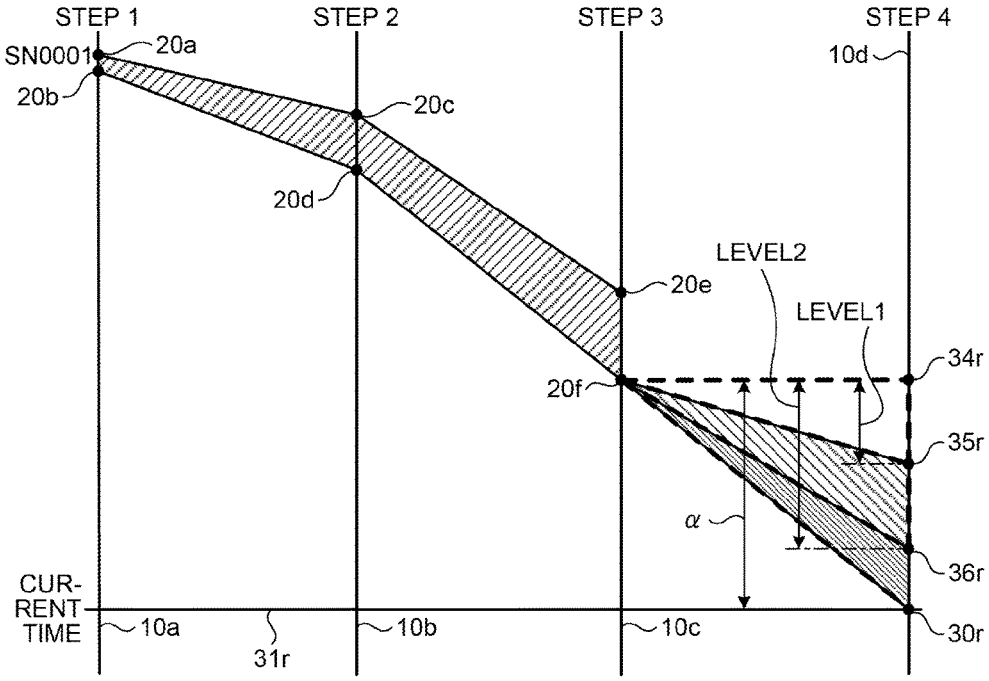
FIG. 27 is a schematic diagram illustrating a 19$^{th}$ example of a real time display of a graph according to the first embodiment.

FIG. 27 is a schematic diagram illustrating a $19^{th}$ example of a real time display of a graph. FIG. 27 is a display example associated with NO. 4 in Table 1 illustrated in FIG. 6. In the example illustrated in FIG. 27, the same log data 121*g* as that used in the example illustrated in FIG. 25 is used. Similarly to the example illustrated in FIG. 27, the displaying unit 113 disposes the starting point 20*a*, 20*c*, and 20*e* of the processing periods, the end points 20*b*, 20*d*, and 20*f* of the processing periods, and an intersection point 30*r*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*r* representing the current time is equal to or greater than the waiting period LEVEL2. In response to the notification from the detecting unit 112, the displaying unit 113 performs the following process. First, the displaying unit 113 disposes, on the time axis 10*d*, a point 35*r* at the position obtained by adding the waiting period LEVEL1 to the end time of the step 3. The displaying unit 113 disposes, on the time axis 10*d*, a point 36*r* at the position obtained by adding the waiting period LEVEL2 to the end time of the step 3.

The displaying unit 113 displays the dotted line connecting the end point 20*f* of the processing period of the step 3 and a point 34*r*, the dotted line connecting the end point 20*f* of the step 3 and the point 35*r*, the dotted line connecting the end point 20*f* of the step 3 and the point 36*r*, and the dotted line connecting the end point 20*f* of the step 3 and the intersection point 30*r*. The displaying unit 113 adds yellow to the strip that is formed by the line connecting the end point 20*f* of the step 3 and the point 35*r* and the line connecting the end point 20*f* of the step 2 and the point 36*r*. Furthermore, the displaying unit 113 adds red to the strip that is formed by the line connecting the end point 20*f* of the step 3 and the point 36*r* and the line connecting the end point 20*f* of the step 3 and the intersection point 30*r*. Consequently, the displaying unit 113 can display the graph such that the length of time elapsed from the waiting period LEVEL2 can be displayed in an easily understandable manner.

Another Example of a Real Time Display (5)

Figure 28:
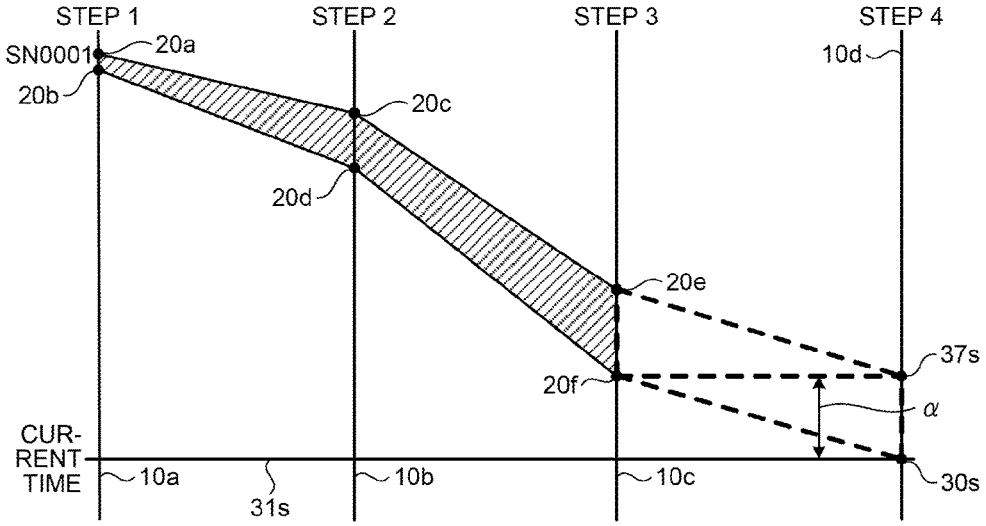
FIG. 28 is a schematic diagram illustrating a 20$^{th}$ example of a real time display of a graph according to the first embodiment.

FIG. 28 is a schematic diagram illustrating a $20^{th}$ example of a real time display of a graph. FIG. 28 is a display example associated with NO. 2 in Table 1 illustrated in FIG. 6. Log data 121*h* indicated by the example illustrated in FIG. 28 is the same as the log data 121*b* related to FIG. 8.

The displaying unit 113 disposes, on the time axis 10*a* of the step 1, the starting point 20*a* and the end point 20*b* of the processing period based on the log data 121*h*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30*s* of a line 31*s* representing the current time and the time axis 10*d* of the step 4. The displaying unit 113 disposes an intersection point 37*s* of the perpendicular line extending from the end point 20*f* of the processing period of the step 3 to the time axis 10*d* and the time axis 10*d*.

The displaying unit 113 displays the strip that is formed by the line connecting the starting points 20*a*, 20*c*, and 20*e* of the processing periods and the line connecting the end points 20*b*, 20*d*, and 20*f* of the processing periods. The displaying unit 113 adds the normal color to the strip.

Because the difference α between the end point 20*f* of the processing period associated with the step 3 and the line 31*s* representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. Based on the determination result, the displaying unit 113 connects the starting point 20*e* of the processing period of the step 3 and the intersection point 37*s* by the dotted line, connects the starting point 20*e* of the processing period of the step 3 and the end point 20*f* by the dotted line, and connects the end point 20*f* of the processing period of the step 3 and the intersection point 37*s* by the dotted line. The displaying unit 113 connects the end point 20*f* of the processing period of the step 3 and the intersection point 30*s* by the dotted line and connects the intersection point 30*s* and the intersection point 37*s* by the dotted line. Consequently, the displaying unit 113 displays the trapezoid with the vertices of the starting point 20*e* of the processing period of the step 3, the end point 20*f* of the step 3, the intersection point 37*s*, and the intersection point 30*s*.

Figure 29:
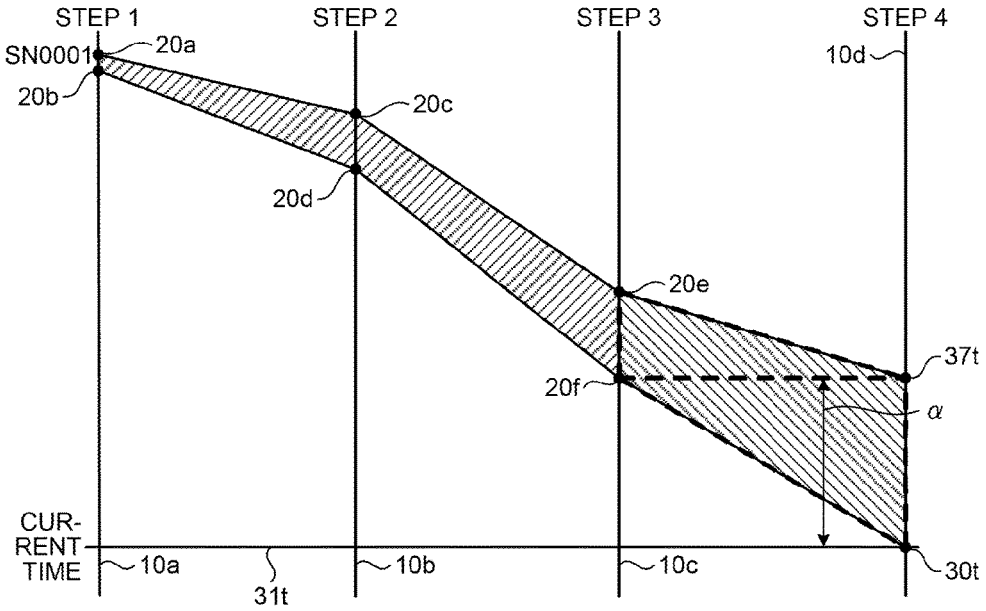
FIG. 29 is a schematic diagram illustrating a 21$^{th}$ example of a real time display of a graph according to the first embodiment.

FIG. 29 is a schematic diagram illustrating a 21$^{th}$ example of a real time display of a graph. FIG. 29 is a display example associated with NO. 3 in Table 1 illustrated in FIG. 6. The log data 121*h* indicated by the example illustrated in FIG. 29 is the same as the log data 121*h* related to FIG. 28. Similarly to the example illustrated in FIG. 28, the displaying unit 113 disposes the starting points 20*a*, 20*c*, and 20*e* of the processing periods, the end points 20*b*, 20*d*, and 20*f* of the processing periods, an intersection point 30*t*, and an intersection point 37*t*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*t* representing the current time is equal to or greater than the waiting period LEVEL1 and is smaller than the waiting period LEVEL2. In response to the notification from the detecting unit 112, similarly to the case related to FIG. 28, the displaying unit 113 connects the starting point 20*e* of the processing period of the step 3, the end point 20*f* of the processing period of the step 3, the intersection point 37*t*, and the intersection point 30*t* by the dotted line and displays the trapezoid with the vertices of the starting point 20*e*, the end point 20*f*, the intersection point 37*t*, and the intersection point 30*t*. The displaying unit 113 adds yellow to the displayed trapezoid.

Figure 30:
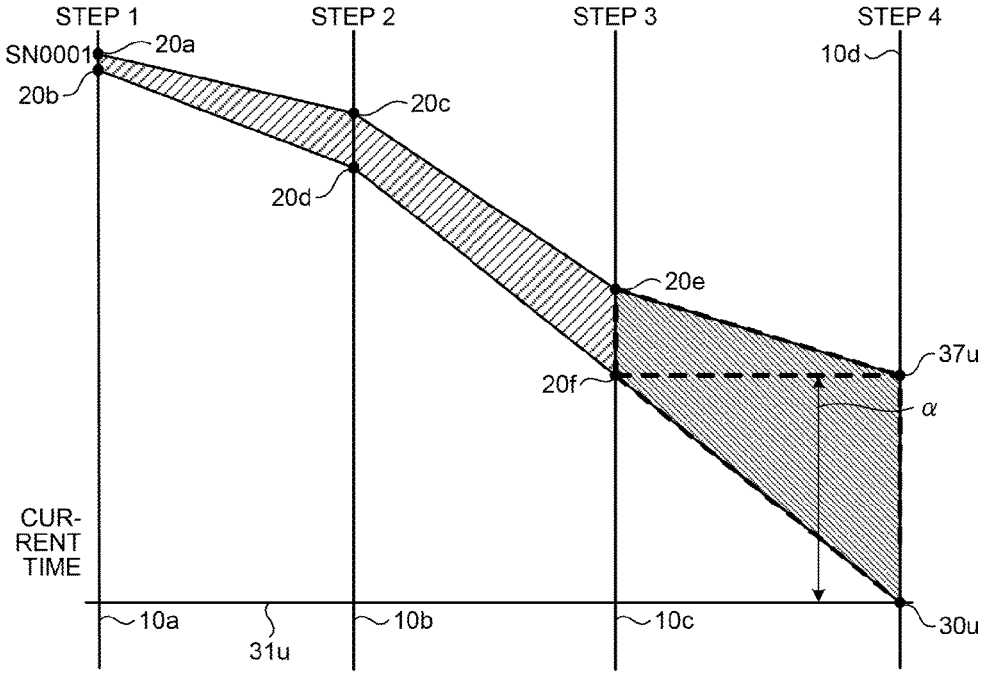
FIG. 30 is a schematic diagram illustrating a 22$^{th}$ example of a real time display of a graph according to the first embodiment.

FIG. 30 is a schematic diagram illustrating a 22$^{th}$ example of a real time display of a graph. FIG. 30 is a display example associated with NO. 4 in Table 1 illustrated in FIG. 6. The log data 121*h* indicated by the example illustrated in FIG. 30 is the same as the log data 121*h* related to FIG. 28. Similarly to the example illustrated in FIG. 28, the displaying unit 113 disposes the starting points 20*a*, 20*c*, and 20*e* of the processing periods, the end points 20*b*, 20*d*, and 20*f* of the processing periods, an intersection point 30*u*, and an intersection point 37*u*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*u* representing the current time is equal to or greater than the waiting period LEVEL2. In response to the notification from the detecting unit 112, similarly to the case related to FIG. 28, the displaying unit 113 connects the starting point 20*e* of the processing period of the step 3, the end point 20*f* of the processing period of the step 3, the intersection point 37*u*, and the intersection point 30*u* by the dotted line and displays the trapezoid with the vertices of the starting point 20*e*, the end point 20*f*, the intersection point 37*u*, and the intersection point 30*u*. The displaying unit 113 adds red to the displayed trapezoid.

Another Example of a Real Time Display (6)

Figure 31:
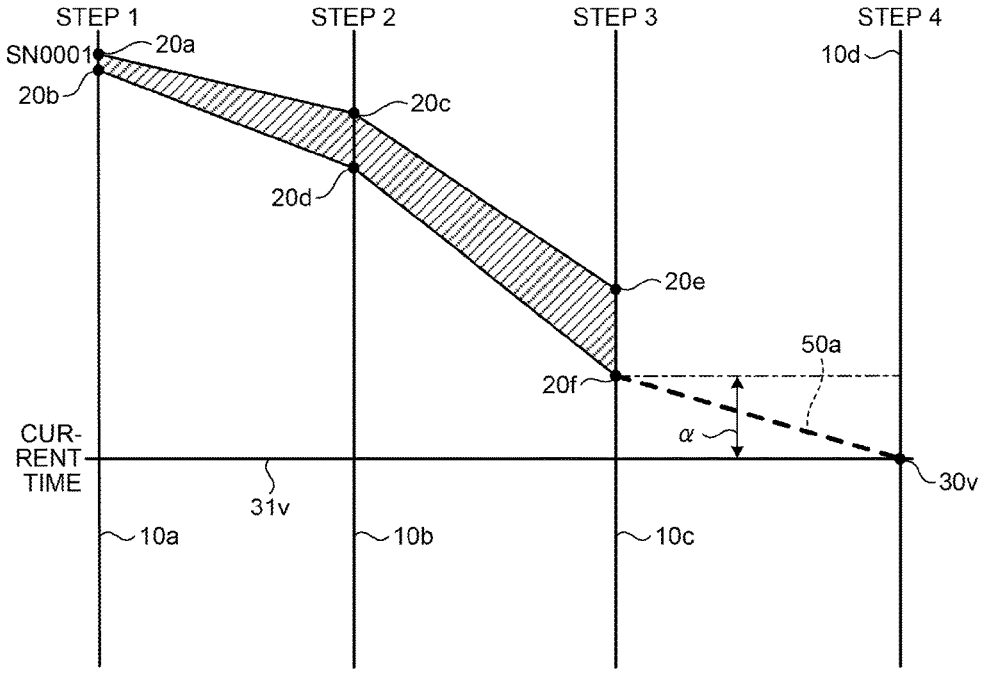
FIG. 31 is a schematic diagram illustrating a 23$^{th}$ example of a real time display of a graph according to the first embodiment.

FIG. 31 is a schematic diagram illustrating a 23$^{th}$ example of a real time display of a graph. FIG. 31 is a display example associated with NO. 2 in Table 1 illustrated in FIG. 6. Log data 121*i* indicated by the example illustrated in FIG. 31 is the same as the log data 121*b* related to FIG. 8.

The displaying unit 113 disposes, on the time axis 10*a* of the step 1, the starting point 20*a* and the end point 20*b* of the processing period based on the log data 121*i*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30*v* of a line 31*v* representing the current time and the time axis 10*d* of the step 4.

The displaying unit 113 displays the strip formed by the line connecting the starting points 20*a*, 20*c*, and 20*e* of the processing periods and the line connecting the end points 20*b*, 20*d*, and 20*f* of the processing periods. The displaying unit 113 adds the normal color to the strip.

Because the difference α between the end point 20*f* of the processing period associated with the step 3 and the line 31*v* representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. The displaying unit 113 displays, based on the determination result, a dotted line 50*a* connecting the end point 20*f* of the processing period of the step 3 and the intersection point 30*v*.

Figure 32:
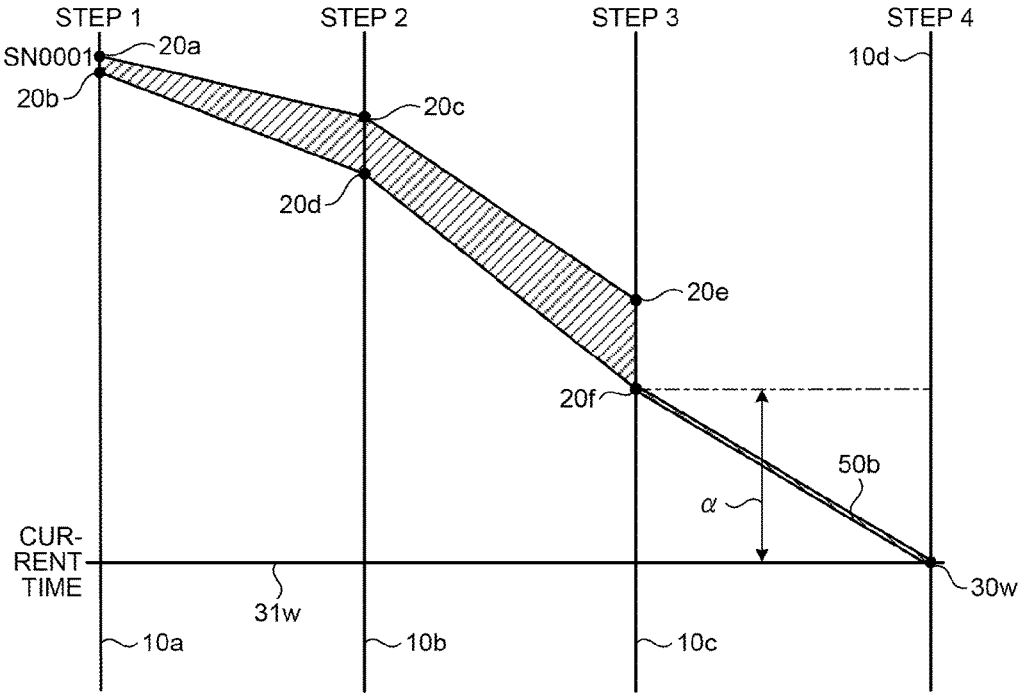
FIG. 32 is a schematic diagram illustrating a 24$^{th}$ example of a real time display of a graph according to the first embodiment.

FIG. 32 is a schematic diagram illustrating a 24$^{th}$ example of a real time display of a graph. FIG. 32 is a display example associated with NO. 3 in Table 1 illustrated in FIG. 6. The log data 121*i* indicated by the example illustrated in FIG. 32 is the same as the log data 121*i* related to FIG. 31. Similarly to the example illustrated in FIG. 32, the displaying unit 113 disposes the starting points 20*a*, 20*c*, and 20*e* of the processing periods, the end points 20*b*, 20*d*, and 20*f* of the processing periods, and an intersection point 30*w*. Furthermore, the displaying unit 113 adds the normal color to the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31*w* representing the current time is equal to or greater than the waiting period LEVEL1 and is smaller than the waiting period LEVEL2. In response to the notification from the detecting unit 112, the displaying unit 113 displays a yellow line 50*b* connecting the end point 20*f* of the processing period of the step 3 and the intersection point 30*w*. The displaying unit 113 displays the yellow line 50*b* in accordance with the magnitude of the difference α such that the thickness of the yellow line 50*b* is increased as the magnitude of difference α is increased.

Figure 33:
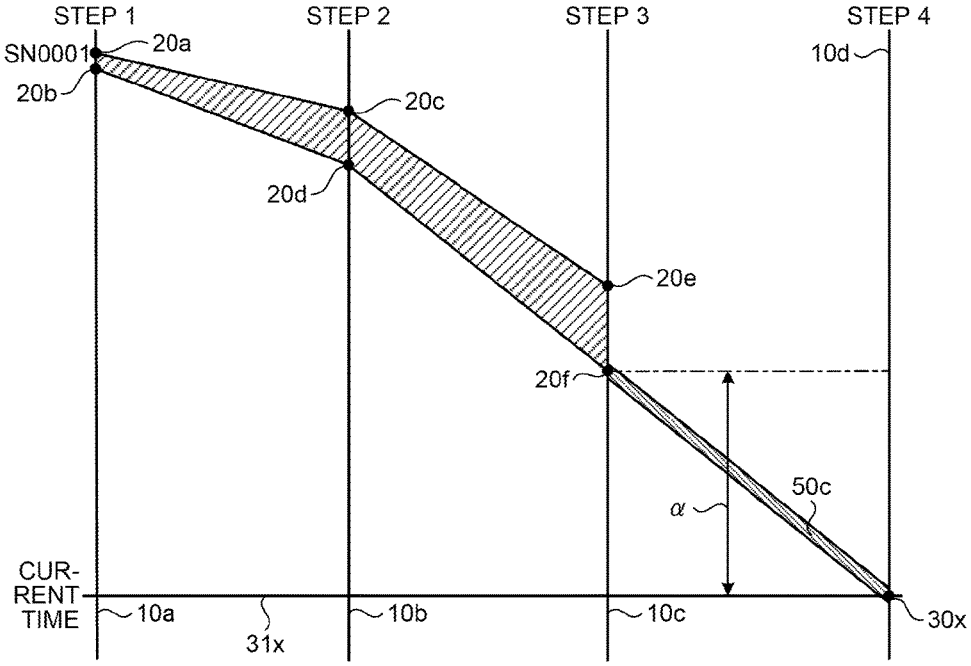
FIG. 33 is a schematic diagram illustrating a 25$^{th}$ example of a real time display of a graph according to the first embodiment.

FIG. 33 is a schematic diagram illustrating a 25$^{th}$ example of a real time display of a graph. FIG. 33 is a display example associated with NO. 4 in Table 1 illustrated in FIG. 6. The log data 121*i* indicated by the example illustrated in FIG. 33 is the same as the log data 121*i* related to FIG. 31. Similarly to the example illustrated in FIG. 33, the displaying unit 113 disposes the starting points 20*a*, 20*c*, and 20*e* of the processing periods, the end points 20*b*, 20*d*, and 20*f* of the processing periods, and an intersection point 30*x*. Furthermore, the displaying unit 113 adds the normal color to the strip formed by the line connecting the starting points 20*a*, 20*c*, and 20*e* of the processing periods and the line connecting the end points 20*b*, 20*d*, and 20*f* of the processing periods.

The detecting unit 112 sends a notification indicating the difference α between the end point 20*f* of the processing period associated with the step 3 and a line 31*x* representing the current time is equal to or greater than the waiting period LEVEL2. In response to the notification from the detecting unit 112, the displaying unit 113 displays a red line 50*c* connecting the end point 20*f* of the processing period of the step 3 and the intersection point 30*x*. The displaying unit 113 displays the red line 50*c* in accordance with the magnitude of the difference α such that the thickness of the red line 50*c* is increased as the magnitude of the difference α is increased.

Because the magnitude of the difference α is increased in the order of the examples illustrated in FIGS. 31, 32, and 33, the displaying unit 113 accordingly displays the line by increasing the thickness of the dotted line 50*a*, the yellow line 50*b*, and the red line 50*c* in this order. Consequently, the displaying unit 113 can display the degree of delay of the end time of a certain step in an easily and visually understandable manner.

Another Example of a Real Time Display (7)

Figure 34:
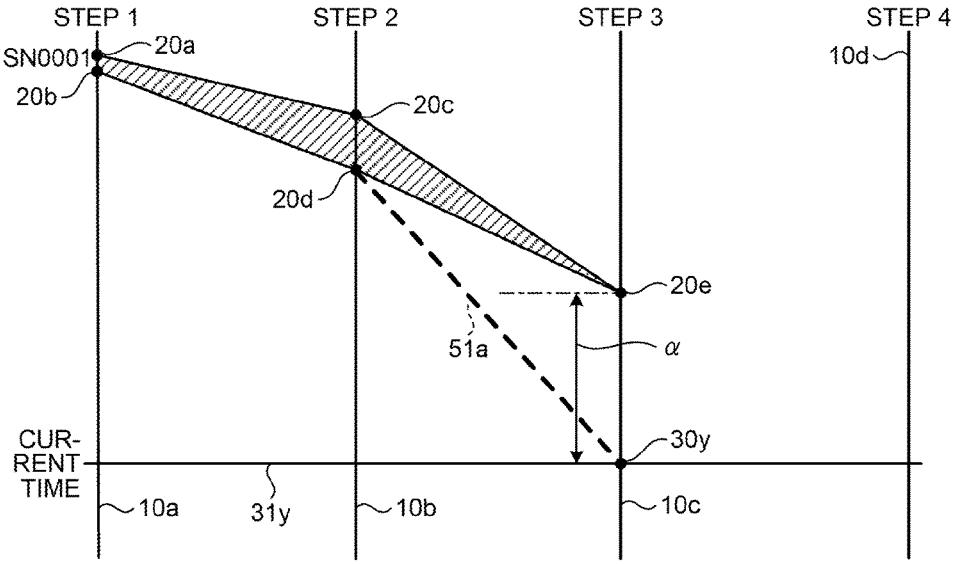
FIG. 34 is a schematic diagram illustrating a 26$^{th}$ example of a real time display of a graph according to the first embodiment.

FIG. 34 is a schematic diagram illustrating a 26$^{th}$ example of a real time display of a graph. FIG. 34 is a display example associated with NO. 5 in Table 1 illustrated in FIG. 6. Log data 121*j* indicated by the example illustrated in FIG. 34 is the same as the log data 121*c* related to FIG. 11.

The displaying unit 113 disposes, on the time axis 10*a* of the step 1, the starting point 20*a* and the end point 20*b* of the processing period based on the log data 121*j*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* of the processing period. The displaying unit 113 disposes an intersection point 30*y* of a line 31*y* representing the current time and the time axis 10*c* of the step 3.

The displaying unit 113 displays the strip that is formed by the line connecting the starting points 20*a*, 20*c*, and 20*e* of the processing periods and the line connecting the end points 20*b* and 20*d* and the starting point 20*e* of the processing periods. The displaying unit 113 adds the normal color to the strip.

Because the difference α between the starting point 20*e* of the processing period associated with the step 3 and the line 31*y* representing the current time is smaller than the processing period LEVEL1, the detecting unit 112 does not send a notification to the displaying unit 113. Because no notification is sent from the detecting unit 112, the displaying unit 113 determines that the difference α is smaller than the processing period LEVEL1. The displaying unit 113 displays, based on the determination result, a dotted line 51*a* connecting the end point 20*d* of the processing period of the step 2 and the intersection point 30*y*.

Figure 35:
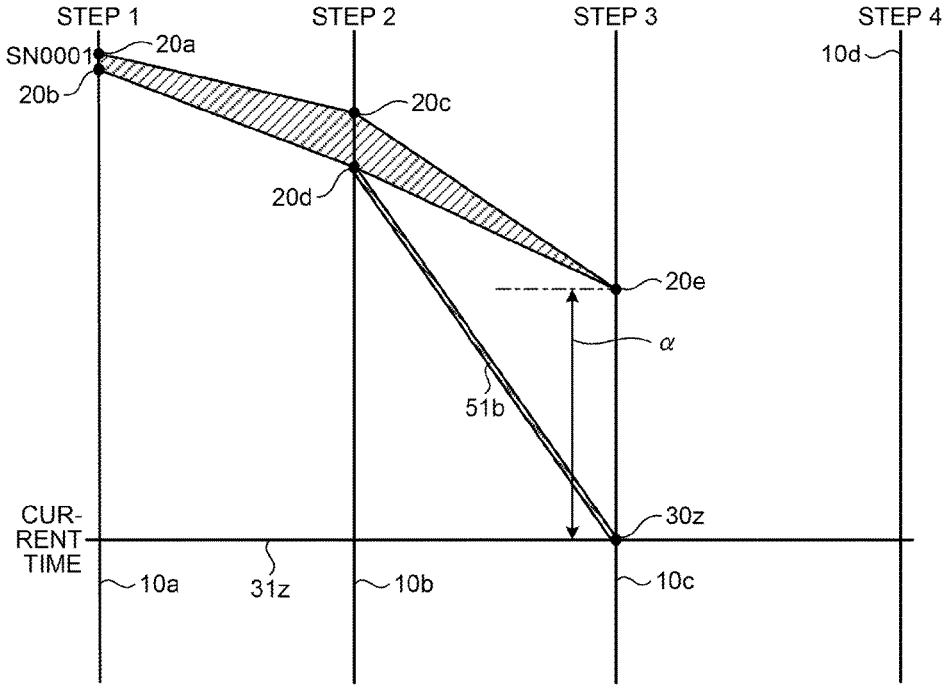
FIG. 35 is a schematic diagram illustrating a 27$^{th}$ example of a real time display of a graph according to the first embodiment.

FIG. 35 is a schematic diagram illustrating a 27$^{th}$ example of a real time display of a graph. FIG. 35 is a display example associated with NO. 6 in Table 1 illustrated in FIG. 6. The log data 121*j* indicated by the example illustrated in FIG. 35 is the same as the log data 121*j* related to FIG. 34. Similarly to the example illustrated in FIG. 34, the displaying unit 113 disposes the starting points 20*a*, 20*c*, and 20*e* of the processing periods, the end points 20*b* and 20*d* of the processing periods, and an intersection point 30*z*. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference α between the starting point 20*e* of the processing period associated with the step 3 and a line 31*z* representing the current time is equal to or greater than the processing period LEVEL1 and is smaller than the processing period LEVEL2. In response to the notification from the detecting unit 112, the displaying unit 113 displays a yellow line 51*b* connecting the end point 20*d* of the processing period of the step 2 and the intersection point 30*z*. The displaying unit 113 displays the yellow line 51*b* in accordance with the magnitude of the difference α such that the thickness of the yellow line 51*b* is increased as the magnitude of the difference α is increased.

Figure 36:
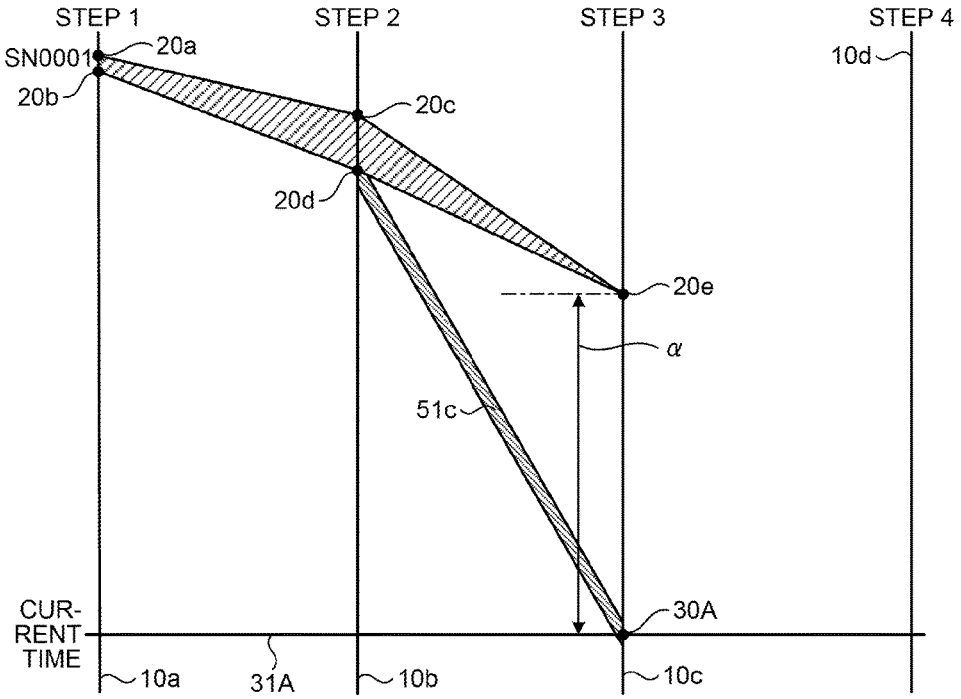
FIG. 36 is a schematic diagram illustrating a 28$^{th}$ example of a real time display of a graph according to the first embodiment.

FIG. 36 is a schematic diagram illustrating a 28$^{th}$ example of a real time display of a graph. FIG. 36 is a display example associated with NO. 7 in Table 1 illustrated in FIG. 6. The log data 121*j* indicated by the example illustrated in FIG. 36 is the same as the log data 121*j* related to FIG. 34. Similarly to the example illustrated in FIG. 34, the displaying unit 113 disposes the starting points 20*a*, 20*c*, and 20*e* of the processing periods, the end points 20*b* and 20*d* of the processing periods, and an intersection point 30A. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference α between the starting point 20*e* of the processing period associated with the step 3 and a line 31A representing the current time is equal to or greater than the LEVEL2. In response to the notification from the detecting unit 112, the displaying unit 113 displays a red line 51*c* connecting the end point 20*d* of the processing period of the step 2 and the intersection point 30A. The displaying unit 113 displays the red line 51*c* in accordance with the magnitude of the difference α such that the thickness of the red line 51*c* is increased as the magnitude of the difference α is increased.

Because the magnitude of the difference α is increased in the order of the examples illustrated in FIGS. 34, 35, and 36, the displaying unit 113 accordingly displays the line by increasing the thickness of the dotted line 51*a*, the yellow line 51*b*, and the red line 51*c* in this order. Consequently, the displaying unit 113 can display the degree of delay of the start time of the subsequent step in an easily and visually understandable manner.

Another Example of a Real Time Display (8)

Figure 37:
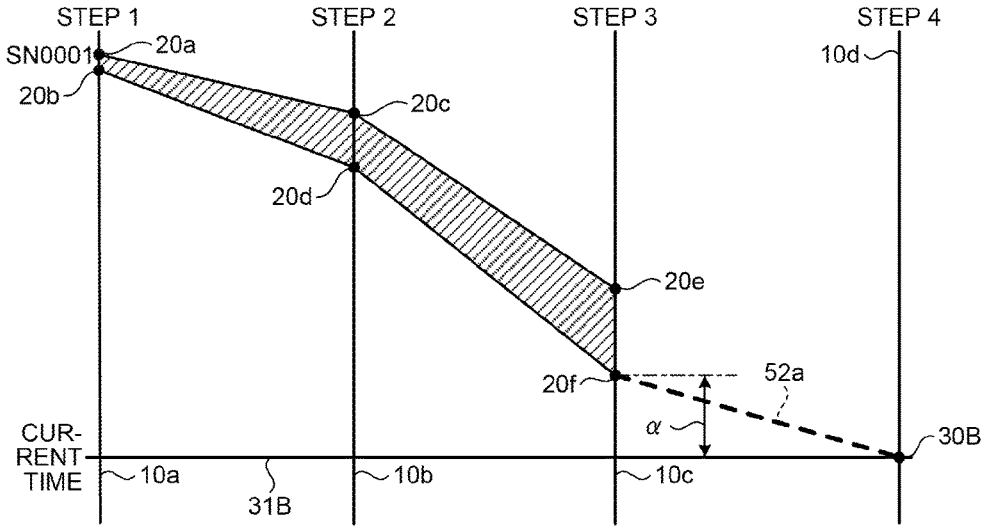
FIG. 37 is a schematic diagram illustrating a 29$^{th}$ example of a real time display of a graph according to the first embodiment.

FIG. 37 is a schematic diagram illustrating a 29$^{th}$ example of a real time display of a graph. FIG. 37 is a display example associated with NO. 2 in Table 1 illustrated in FIG. 6. Log data 121*k* indicated by the example illustrated in FIG. 37 is the same as the log data 121*b* related to FIG. 8.

The displaying unit 113 disposes, on the time axis 10*a* of the step 1, the starting point 20*a* and the end point 20*b* of the processing period based on the log data 121*k*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30B of a line 31B representing the current time and the time axis 10*d* of the step 4.

The displaying unit 113 displays the strip that is formed by the line connecting the starting points 20*a*, 20*c*, and 20*e* of the processing periods and the line connecting the end points 20*b*, 20*d*, and 20*f* of the processing periods. The displaying unit 113 adds the normal color in the strip.

Because the difference α between the end point 20*f* of the processing period associated with the step 3 and the line 31B representing the current time is smaller than the waiting period LEVEL1, the detecting unit 112 does not send a notification to the displaying unit 113. Because no notification is sent from the detecting unit 112, the displaying unit 113 determines that the difference α is smaller than the waiting period LEVEL1. The displaying unit 113 displays, based on the determination result, a dotted line 52*a* connecting the end point 20*f* of the processing period of the step 3 and the intersection point 30B.

Figure 38:
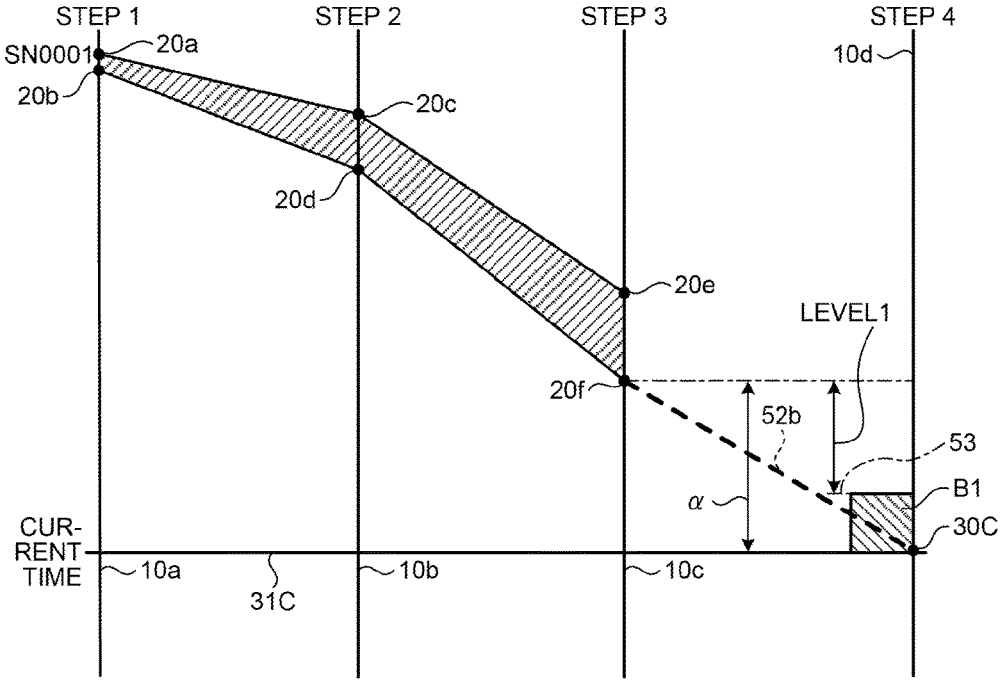
FIG. 38 is a schematic diagram illustrating a 30$^{th}$ example of a real time display of a graph according to the first embodiment.

FIG. 38 is a schematic diagram illustrating a $30^{th}$ example of a real time display of a graph. FIG. 38 is a display example associated with NO. 3 in Table 1 illustrated in FIG. 6. The log data 121*k* indicated by the example illustrated in FIG. 38 is the same as the log data 121*k* related to FIG. 37. Similarly to the example illustrated in FIG. 38, the displaying unit 113 disposes the starting points 20*a*, 20*c*, and 20*e* of the processing periods, the end points 20*b*, 20*d*, and 20*f* of the processing periods, and an intersection point 30C. Furthermore, the displaying unit 113 adds the normal color in the strip that is formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31C representing the current time is equal to or greater than the waiting period LEVEL1 and is smaller than the waiting period LEVEL2. In response to the notification from the detecting unit 112, the displaying unit 113 displays a dotted line 52*b* connecting the end point 20*f* of the processing period of the step 3 and the intersection point 30C. The displaying unit 113 displays a bar graph B1 between a line 53 that perpendicularly extends from the step 4 and that represents the elapsed time of the waiting period LEVEL1 from the end time of the step 3 and the line 31C that represents the current time. The displaying unit 113 adds yellow to the bar graph B1. Consequently, the displaying unit 113 can display the graph such that the length of time elapsed from the waiting period LEVEL1 can be displayed in an easily understandable manner.

Figure 39:
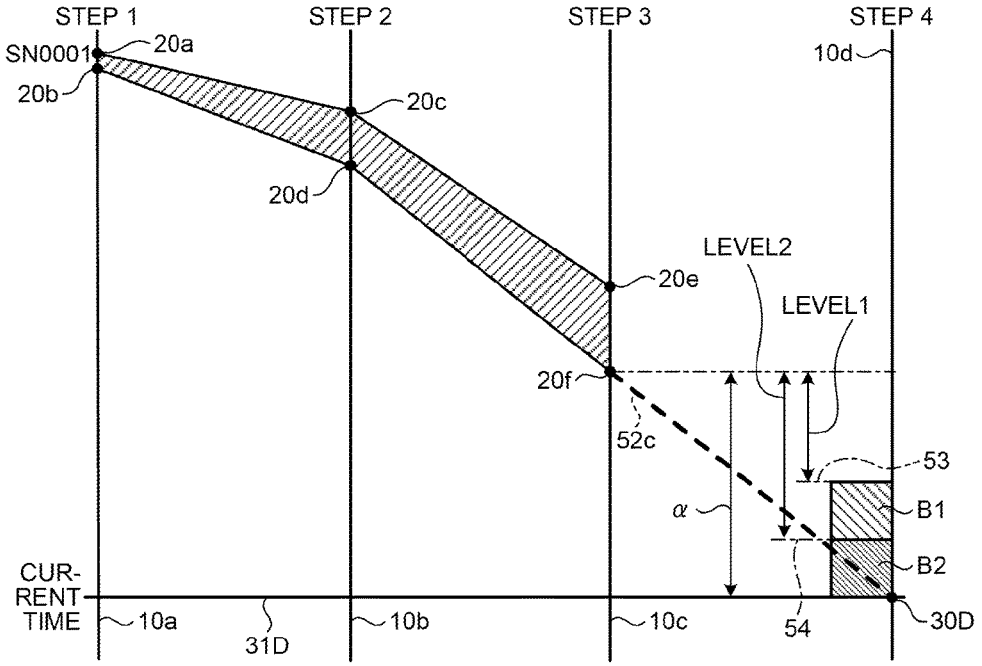
FIG. 39 is a schematic diagram illustrating a 31$^{th}$ example of a real time display of a graph according to the first embodiment.

FIG. 39 is a schematic diagram illustrating a $31^{th}$ example of a real time display of a graph. FIG. 39 is a display example associated with NO. 4 in Table 1 illustrated in FIG. 6. The log data 121*k* indicated by the example illustrated in FIG. 39 is the same as the log data 121*k* related to FIG. 37. Similarly to the example illustrated in FIG. 39, the displaying unit 113 disposes the starting points 20*a*, 20*c*, and 20*e* of the processing periods, the end points 20*b*, 20*d*, and 20*f* of the processing periods, and an intersection point 30D. Furthermore, the displaying unit 113 adds the normal color to the strip formed by the line connecting the starting points 20*a*, 20*c*, and 20*e* of the processing periods and the line connecting the end points 20*b*, 20*d*, and 20*f* of the processing periods.

The detecting unit 112 sends a notification indicating that the difference α between the end point 20*f* of the processing period associated with the step 3 and a line 31D representing the current time is equal to or greater than the waiting period LEVEL2. In response to the notification from the detecting unit 112, the displaying unit 113 displays a dotted line 52*c* connecting the end point 20*f* of the processing period of the step 3 and the intersection point 30D. The displaying unit 113 displays the bar graph B1 between the line 53 that perpendicularly extends from the step 4 and that represents the elapsed time of the waiting period LEVEL1 from the end time of the step 3 and a line 54 that represents the elapsed time of the waiting period LEVEL2 from the end time of the step 3. The displaying unit 113 adds yellow in the bar graph B1. Furthermore, the displaying unit 113 displays a bar graph B2 between the line 54 that perpendicularly extends from the step 4 and that represents the elapsed time of the waiting period LEVEL2 from the end time of the step 3 and the line 31D that represents the current time. The displaying unit 113 adds red in the bar graph B2. Consequently, the displaying unit 113 can display the graph such that the length of time elapsed from the waiting period LEVEL2 can be displayed in an easily understandable manner.

Another Example of a Real Time Display (9)

Figure 40:
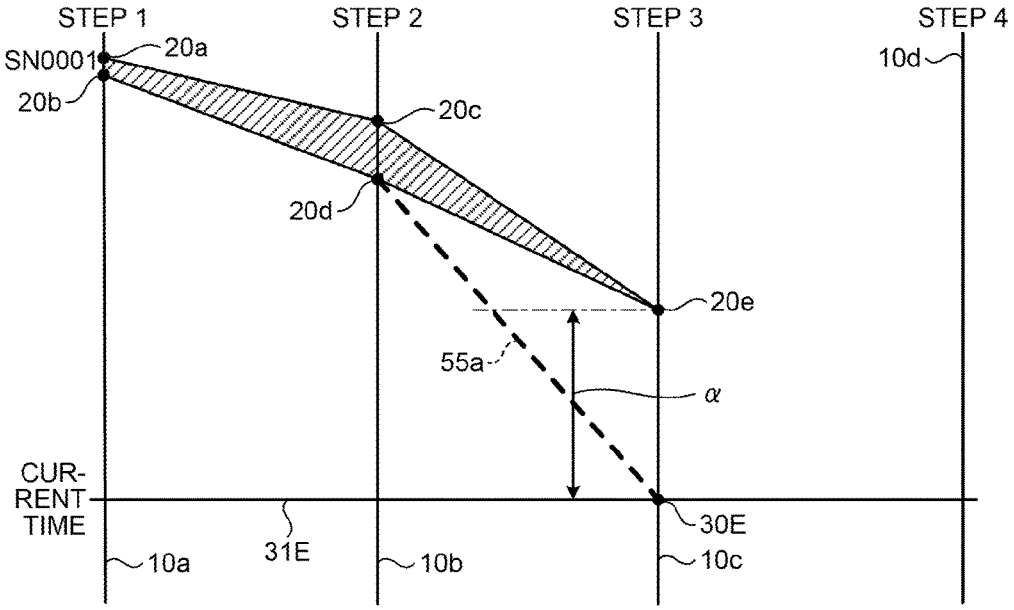
FIG. 40 is a schematic diagram illustrating a 32$^{th}$ example of a real time display of a graph according to the first embodiment.

FIG. 40 is a schematic diagram illustrating a $32^{th}$ example of a real time display of a graph. FIG. 40 is a display example associated with NO. 5 in Table 1 illustrated in FIG. 6. Log data 121*l* indicated by the example illustrated in FIG. 40 is the same as the log data 121*c* related to FIG. 11.

The displaying unit 113 disposes, on the time axis 10*a* of the step 1, the starting point 20*a* and the end point 20*b* of the processing period based on the log data 121*l*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* of the processing period. The displaying unit 113 disposes an intersection point 30E of a line 31E representing the current time and the time axis 10*c* of the step 3.

The displaying unit 113 displays the strip that is formed by the line connecting the starting points 20*a*, 20*c*, and 20*e* of the processing periods and the line connecting the end points 20*b* and 20*d* and the starting point 20*e* of the processing periods. The displaying unit 113 adds the normal color to the strip.

Because the difference α between the starting point 20*e* of the processing period associated with the step 3 and the line 31E representing the current time is smaller than the processing period LEVEL1, the detecting unit 112 does not send a notification to the displaying unit 113. Because no notification is sent from the detecting unit 112, the displaying unit 113 determines that the difference α is smaller than the processing period LEVEL1. The displaying unit 113 displays, based on the determination result, a dotted line 55*a* connecting the end point 20*d* of the processing period of the step 2 and the intersection point 30E.

Figure 41:
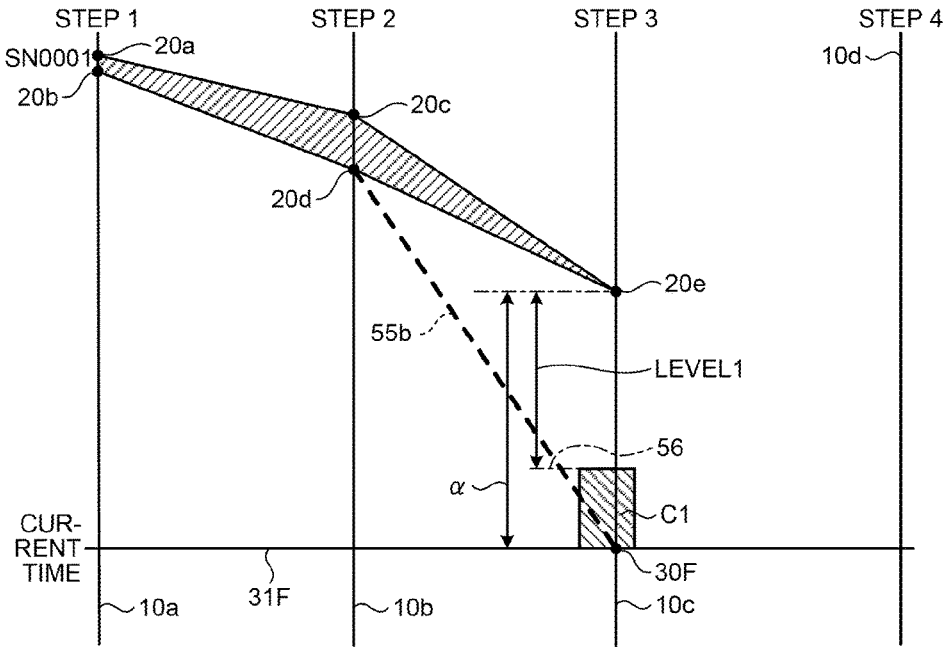
FIG. 41 is a schematic diagram illustrating a 33$^{th}$ example of a real time display of a graph according to the first embodiment.

FIG. 41 is a schematic diagram illustrating a $33^{th}$ example of a real time display of a graph. FIG. 41 is a display example associated with NO. 6 in Table 1 illustrated in FIG. 6. The log data 121*l* indicated by the example illustrated in FIG. 41 is the same as the log data 121*l* related to FIG. 40. Similarly to the example illustrated in FIG. 41, the displaying unit 113 disposes the starting points 20*a*, 20*c*, and 20*e* of the processing periods, the end points 20*b* and 20*d* of the processing period, and an intersection point 30F. Furthermore, the displaying unit 113 adds the normal color to the strip that is formed by the line connecting the starting points 20*a*, 20*c*, and 20*e* of the processing periods and the line connecting the end points 20*b* and 20*d* and the starting point 20*e* of the processing periods.

The detecting unit 112 sends a notification indicating that the difference α between the starting point 20*e* of the processing period associated with the step 3 and a line 31F representing the current time is equal to or greater than the processing period LEVEL1 and is smaller than the processing period LEVEL2. In response to the notification from the detecting unit 112, the displaying unit 113 displays a dotted line 55*b* connecting the starting point 20*e* of the processing period of the step 3 and the intersection point 30F. The displaying unit 113 displays a bar graph C1 between a line 56 that perpendicularly extends from the step 3 and that represents the elapsed time of the processing period LEVEL1 from the start time of the step 3 and the line 31F representing the current time. The displaying unit 113 adds yellow to the bar graph C1. Consequently, the displaying unit 113 can display the graph such that the length of time elapsed from the processing period LEVEL1 can be displayed in an easily understandable manner.

Figure 42:
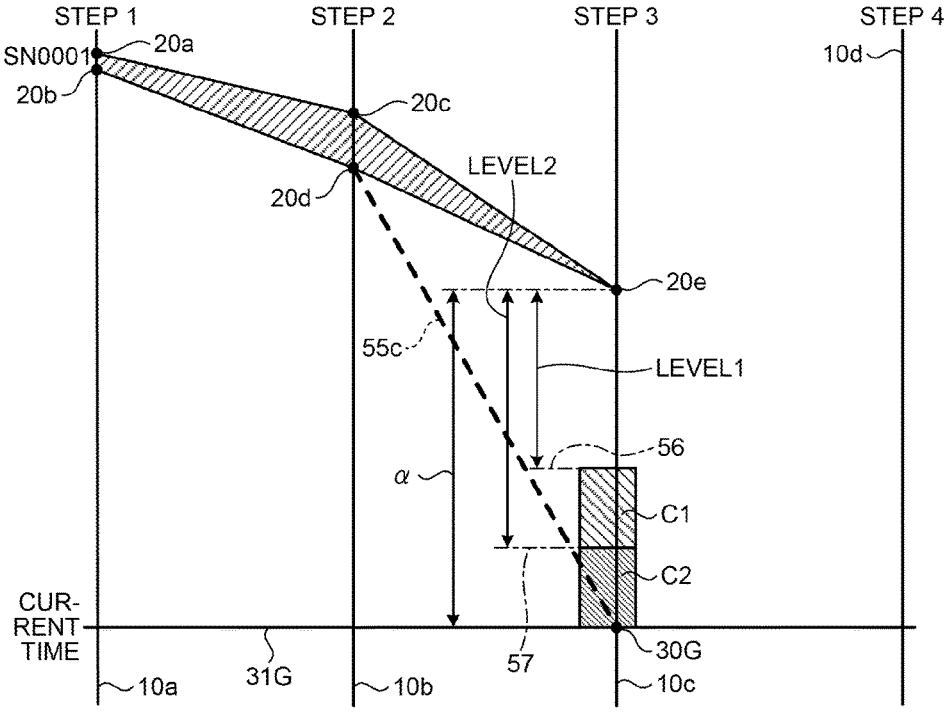
FIG. 42 is a schematic diagram illustrating a 34$^{th}$ example of a real time display of a graph according to the first embodiment.

FIG. 42 is a schematic diagram illustrating a $34^{th}$ example of a real time display of a graph. FIG. 42 is a display example associated with NO. 7 in Table 1 illustrated in FIG. 6. The log data 121*l* indicated by the example illustrated in FIG. 42 is the same as the log data 121*l* related to FIG. 40. Similarly to the example illustrated in FIG. 40, the displaying unit 113 disposes the starting points 20*a*, 20*c*, and 20*e* of the processing periods, the end points 20*b* and 20*d* of the processing period, and an intersection point 30G. Furthermore, the displaying unit 113 adds the normal color to the strip formed by the line connecting the line connecting the starting points 20*a*, 20*c*, and 20*e* of the processing periods and the end points 20*b* and 20*d* and the starting point 20*e* of the processing periods.

The detecting unit 112 sends a notification indicating that the difference α between the starting point 20*e* of the processing period associated with the step 3 and a line 31G representing the current time is equal to or greater than the processing period LEVEL2. In response to the notification from the detecting unit 112, the displaying unit 113 displays a dotted line 55*c* connecting the end point 20*d* of the processing period of the step 2 and the intersection point 30G. The displaying unit 113 displays a bar graph C1 between a line 56 that perpendicularly extends from the step 3 and that represents the elapsed time of the processing period LEVEL1 from the start time of the step 3 and a line 57 that perpendicularly extends from the step 3 and that represents the elapsed time of the processing period LEVEL2 from the start time of the step 3. The displaying unit 113 adds yellow in the bar graph C1. The displaying unit 113 displays a bar graph C2 between the line 57 that represents the elapsed time of the processing period LEVEL2 from the start time of the step 3 and the line 31G that represents the current time. The displaying unit 113 adds red to the bar graph C2. Consequently, the displaying unit 113 can display the graph such that the length of time elapsed from the processing period LEVEL2 can be displayed in an easily understandable manner.

Comparison of Visual Effects

Figure 43:
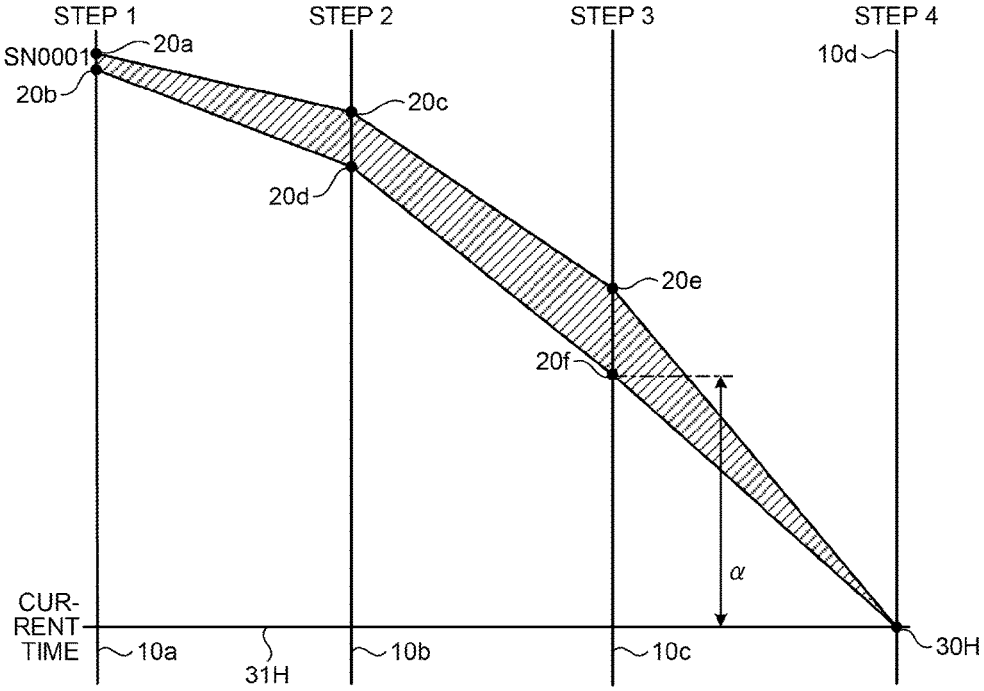
FIG. 43 is a schematic diagram for comparing visual effects of a real time display.

Visual effects of the other examples (1) to (9) of the real time displays described above will be described with reference to FIG. 43. FIG. 43 is a schematic diagram for comparing visual effects of a real time display. Log data 121*m* indicated by the example illustrated in FIG. 43 relates to the product number "SN0001". In the log data 121*m*, the start time and the end time of all of the steps 1 to 3 are stored, but the start time and the end time of the step 4 are not stored. The displaying unit 113 disposes, on the time axis 10*a* of the step 1, the starting point 20*a* and the end point 20*b* of the processing period based on the log data 121*m*. The displaying unit 113 disposes, on the time axis 10*b* of the step 2, the starting point 20*c* and the end point 20*d* of the processing period. The displaying unit 113 disposes, on the time axis 10*c* of the step 3, the starting point 20*e* and the end point 20*f* of the processing period. The displaying unit 113 disposes an intersection point 30H of a line 31H representing the current time and the time axis 10*d* of the step 4.

The displaying unit 113 displays the strip that is formed by the line connecting the starting points 20*a*, 20*c*, and 20*e* of the processing periods and the line connecting the end points 20*b*, 20*d*, and 20*f* of the processing periods. The displaying unit 113 adds the normal color to the strip.

In the first embodiment, for example, the displaying unit 113 displays the strip that is formed by the line connecting the starting point 20*e* of the processing period of the step 3 and the intersection point 30H and the line connecting the end point 20*f* and the intersection point 30H. In this case, the area of the triangle with the vertices of the starting point 20*e*, the end point 20*f*, and the intersection point 30H is not changed even if the magnitude of the difference α is increased.

In contrast, in the other examples (1) to (9) of the real time display, because the area of the diagram or the thickness of a line displayed together with a strip is changed in accordance with the magnitude of the difference α such that the area is increased or the thickness of the line is increased as the magnitude of the difference α is increased, it is possible to display the degree of delay in a step or between steps, in an easily and visually understandable manner, by using the diagram or the line.

User Interface

Figure 44:
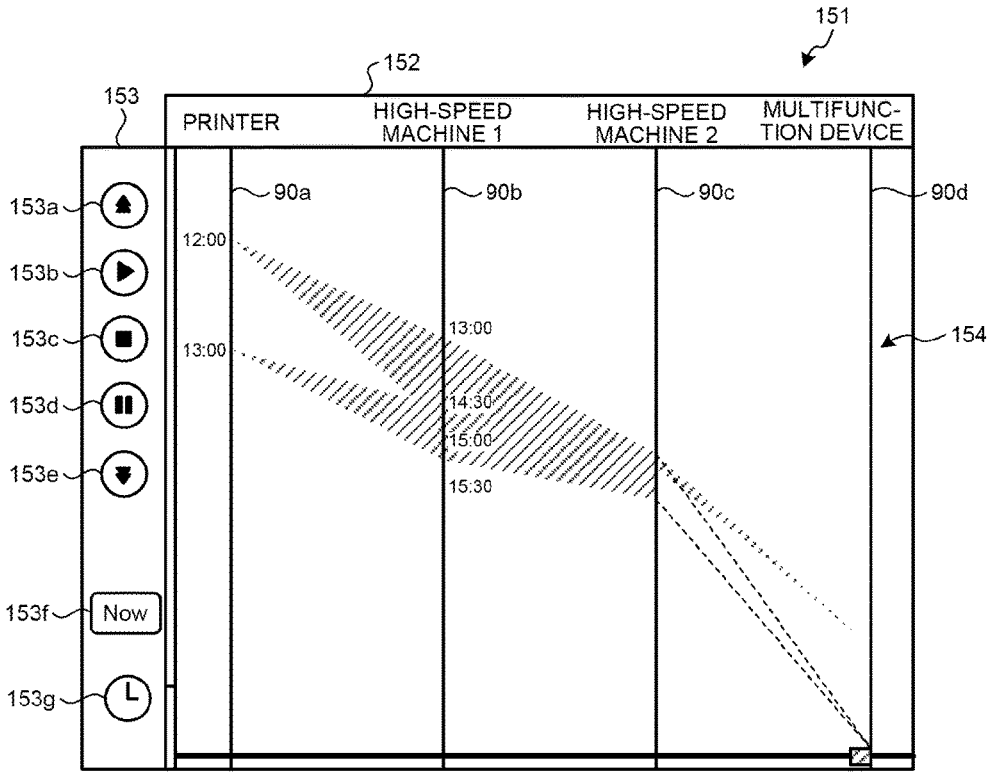
FIG. 44 is a schematic diagram illustrating a first display example of a user interface according to the first embodiment.

FIG. 44 is a schematic diagram illustrating a first display example of a user interface according to the first embodiment. As indicated by the example illustrated in FIG. 44, a display screen 151 includes a process equipment field 152, an operation button field 153, and a graph display field 154. In the process equipment field 152, a printer, a high-speed machine 1, a high-speed machine 2, and a multifunction device are listed in the order the devices perform a production process on a product. Furthermore, a time axis 90*a* is provided with the printer, a time axis 90*b* is provided with the high-speed machine 1, a time axis 90*c* is provided with the high-speed machine 2, and a time axis 90*d* is provided with the multifunction device. The output unit 102 displays a graph at the time specified by the operation of the operation button field 153.

The operation button field 153 includes a rewind button 153*a*, a playback button 153*b*, a stop button 153*c*, a pause button 153*d*, a fast forward button 153*e*, a current button 153*f*, and a time display switch button 153*g*. For example, if the rewind button 153*a* is pressed, the output unit 102 displays the graph by going back into the past state. The output unit 102 may also increase the rewind speed in accordance with the number of times the rewind button 153*a* is pressed.

If the playback button 153*b* is pressed, the output unit 102 plays back the way the graph is created over time from past to present. If the stop button 153*c* is pressed, the output unit 102 stops the playback of the graph. If the pause button 153*d* is pressed, the output unit 102 stops the playback of the graph. If the fast forward button 153*e* is pressed, the output unit 102 fast forwards the way the graph is created. The output unit 102 may also increase the speed of the fast forward playback in accordance with the number of times the fast forward button 153*e* is pressed. If the current button 153*f* is pressed, the output unit 102 displays a current-state graph. If the time display switch button 153*g* is pressed, the output unit 102 switches a display or non-display of the time associated with the displayed graph.

Figure 45:
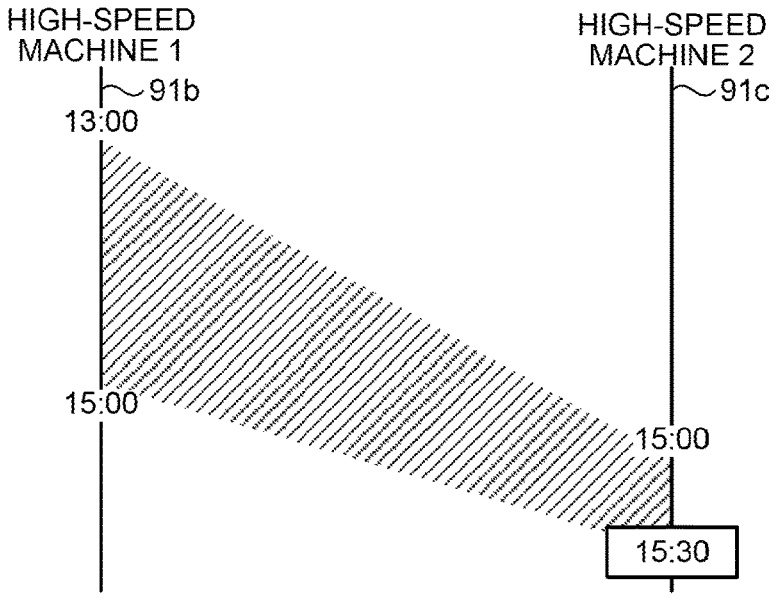
FIG. 45 is a schematic diagram illustrating a second display example of the user interface according to the first embodiment.

FIG. 45 is a schematic diagram illustrating a second display example of the user interface according to the first embodiment. In the example illustrated in FIG. 45, a time axis 91*b* of the high-speed machine 1 and a time axis 91*c* of the high-speed machine 2 on the display screen 151 are displayed in close up. In addition to the strip representing the processing period of each product, the displaying unit 113 may also display the start time and the end time of the process performed by each device. For example, the displaying unit 113 displays the start time "13:00" and the end time "15:00" of the process performed by the high-speed machine 1. Furthermore, the displaying unit 113 displays the start time "15:00" and the end time "15:30" of the process performed by the high-speed machine 2. If end time of the process performed by the high-speed machine 2 is delayed, the displaying unit 113 displays the end time "15:30" by surrounding the time by a frame or by changing the display state by using a different color.

Figure 46:
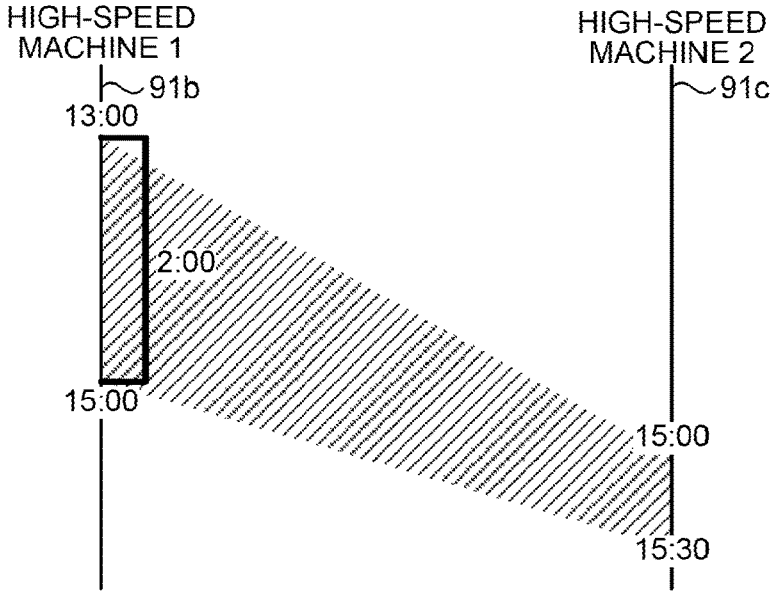
FIG. 46 is a schematic diagram illustrating a third display example of the user interface according to the first embodiment.

FIG. 46 is a schematic diagram illustrating a third display example of the user interface according to the first embodiment. In the example illustrated in FIG. 46, similarly to FIG. 45, the displaying unit 113 displays the start time "13:00" and the end time "15:00" of the process performed by the high-speed machine 1. The displaying unit 113 calculates a processing period "2:00" of the high-speed machine 1 by subtracting the start time "13:00" from the end time "15:00". Then, the displaying unit 113 may also display the processing period "2:00" of the high-speed machine 1.

Advantage of the First Embodiment

The abnormality detecting device 100 includes the storing unit 120 that stores therein log data, which is related to each of the production devices that are included in a production line and that produce a product by sequentially performing processes, and in which, for a process related to the production of a product performed by each of the production devices, at least a production device number is associated with the event date and time. The abnormality detecting device 100 includes the calculating unit 111 that refers to the log data stored in the storing unit and that calculates temporal relationship, which is used when the same product is produced, between a first device and a second device that subsequently performs a process after the first device from among the plurality of the production devices. The abnormality detecting device 100 includes the detecting unit 112 that detects elapse of a reference time that is obtained from both the latest log data from among the pieces of log data related to the first device stored in the storing unit and the temporal relationship calculated by the calculating unit 111 and that detects that new log data related to the second device is not stored in the storing unit 120. The abnormality detecting device 100 includes the displaying unit 113 that displays an alarm when detection is obtained by the detecting unit 112. The abnormality detecting device 100 is an example of an abnormality detection system.

The displaying unit 113 further includes a creating unit that creates, based on the log data stored in the storing unit, one or more strip graphs representing a processing period or a waiting period for a product in each of the production devices. As the method of displaying the alarm, the creating unit displays, on the strip graph, a strip representing, in a state in which the strip can be distinguished from a strip that represents a normal flow of a process, the processing period or the waiting period of a process that has been normally performed. Consequently, the degree of delay actually occurring in each of the devices can be displayed in an easily understandable manner.

In addition to the production device number and the event date and time, information indicating the distinction between the start and the end may also be included in the log data. Consequently, it is possible to specify the processing period and the waiting period in each device or each step.

The calculating unit 111 calculates one or a plurality of a time difference between the time at which the first device starts the production and the time at which the second device starts the production, a time difference between the time at which the first device ends the production and the time at which the second device ends the production, and a time difference between the time at which the first device ends the production and the time at which the second device starts the production. Consequently, it is possible to accurately control the time at which an alarm is displayed.

The calculating unit 111 further calculates a time difference between the time at which the first device starts the production and the time at which the first device ends the production. The detecting unit 112 further detects that timing, which is obtained from both start log data from among the pieces of the log data related to the first device stored in the storing unit 120 and the time difference calculated by the calculating unit 111, has elapsed and detects that end log data related to the first device is not updated in the storing unit 120. Consequently, it is possible to accurately control the time at which an alarm is displayed.

The displaying unit 113 displays an alarm in accordance with the difference between the timing and the current time. Consequently, the degree of abnormality can be displayed. The degree of abnormality indicates, for example, the degree of delay in start or end of the process.

The displaying unit 113 displays a diagram whose area is increased or displays a line whose thickness is increased as a time difference between the timing and the current time is increased. Consequently, the degree of abnormality can be displayed in an easily and visually understandable manner.

The displaying unit 113 displays a different alarm in accordance with whether log data indicating the start or the end of the production in a device is updated. Consequently, the type of abnormality can be displayed. For example, by using a line when an alarm indicating a delay in start of a process is displayed and by using a triangle diagram or the like when an alarm indicating a delay in end of a process is displayed, it is possible to distinguishably display the alarm indicating a delay in start of a process or a delay in end of a process.

Based on a log output in accordance with execution of a process event related to a specific product in the first device, the displaying unit 113 performs a display associated with the process event performed in the first device by associating the display with the first time on the time axis. The displaying unit 113 updates, in accordance with elapse of time, a display that indicates the current time on the time axis such that a gap between the first time and the current time is increased. Before the reference time calculated based on the log output from the first device exceeds, if a log associated with the execution of the process event related to the specific product is not output from the second device that subsequently performs a process after the process related to the specific product performed in the first device, the displaying unit 113 performs a display associated with a planned process event by associating the display with an estimated occurrence time of the planned process event in the second device related to the specific product. Before the reference time calculated based on the log output from the first device exceeds, if the log associated with the execution of the process event related to the specific product is output from the second device, instead of performing the display associated with the planned process event that is associated with the reference time in the second device related to the specific product, the displaying unit 113 performs a display associated with the process event performed in the second device by associating the display with a second time on the time axis based on the log output from the second device. Consequently, it is possible to display, in real time, a delay in a processing period or a waiting period in each device in an easily and visually understandable manner.

Comparison of a Graph with Another Display Example

Figure 47:
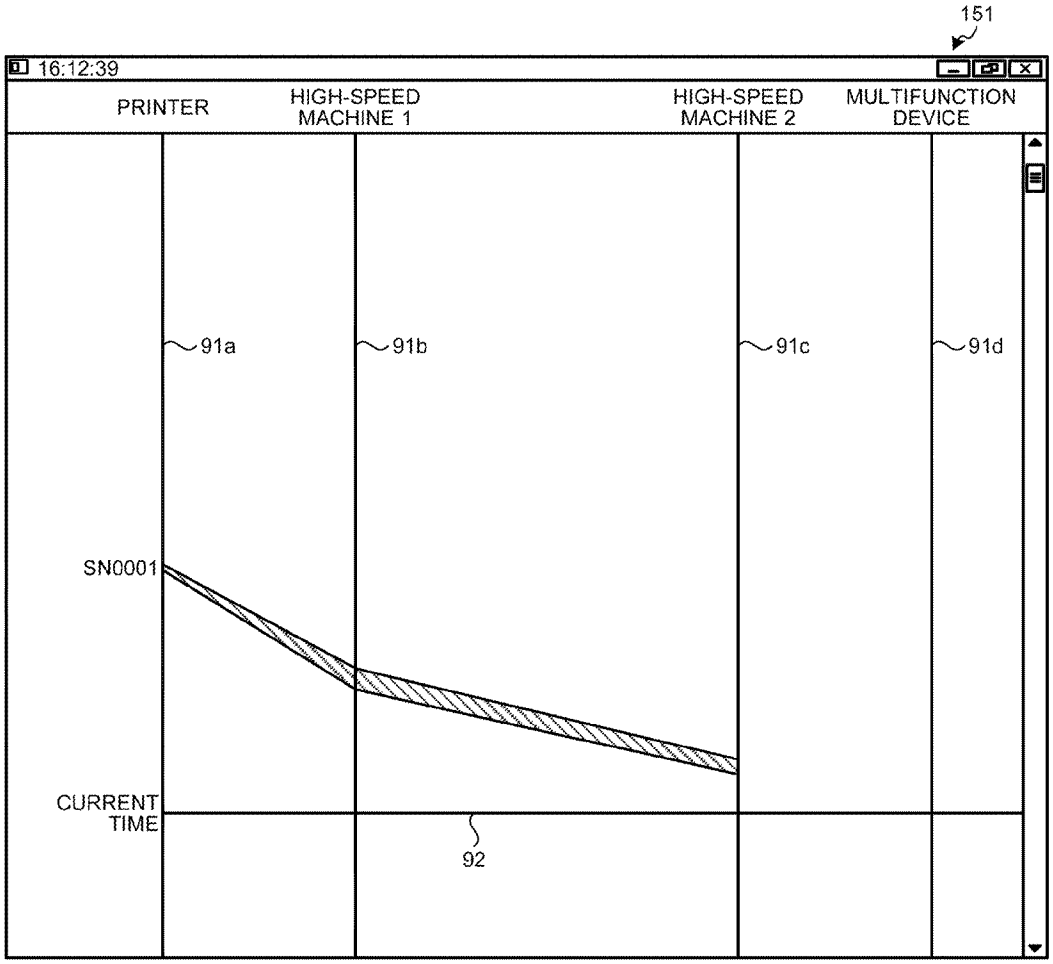
FIG. 47 is a schematic diagram illustrating another display example of a graph.

FIG. 47 is a schematic diagram illustrating another display example of a graph. In the example illustrated in FIG. 47, the strip is displayed in the graph based on the steps, in the log data 121, in each of which the start time and the end time are stored. In contrast, for a step, the log data 121, in which both or one of the start time and the end time are not stored, a strip is not displayed.

As indicated by the example illustrated in FIG. 47, the graph is displayed on the display screen 151. In the graph, a time axis 91*a* of the printer, a time axis 91*b* of the high-speed machine 1, the time axis 91*c* of the high-speed machine 2, and a time axis 91*d* of the multifunction device are provided in parallel and the strip indicating the processing periods of "SN0001" is displayed.

In the log data 121 (not illustrated), for "SN0001", the start time and the end time of each of the printer, the high-speed machine 1, and the high-speed machine 2 are stored, but both or one of the start time and the end time of the multifunction device are not stored. In this case, in the graph, for "SN0001", the strip is displayed among the axis 91*a*, the axis 91*b*, and the axis 91*c*, but nothing is displayed between the axis 91*c* and the axis 91*d*. Consequently, it is unable to determine from the graph, in the multifunction device, whether the production of "SN0001" has not been started or whether the production of "SN0001" has been started but not been ended.

In contrast, the abnormality detecting device 100 according to the first embodiment displays a different diagram or line between the axis 91*c* and the axis 91*d* between a case in which the production of "SN0001" has been started in the multifunction device and a case in which the production of "SN0001" has not been started. Consequently, by displaying the diagram or the line between the axis 91*c* and the axis 91*d*, the abnormality detecting device 100 can display the production of "SN0001" in a visually distinguishable manner indicating whether the production of "SN0001" has been started or the production of "SN0001" has been started but not been ended.

Second Embodiment

In a second embodiment, similarly to the first embodiment, the start time and the end time for each step is also specified, for each product, based on the log data 121. Based on the specified start time and the end time, processing periods are disposed and a strip formed by connecting the processing periods is displayed in a graph. In contrast, the second embodiment differs from the first embodiment in that, when a processing period or a waiting period of a product is disposed on the time axis associated with each step, a mark representing the processing period or the waiting period of the product is disposed. Because the functional configuration of an abnormality detecting device according to the second embodiment is the same as that in the first embodiment; therefore, a description thereof will be omitted.

Display Example of a Graph According to the Second Embodiment

Figure 48:
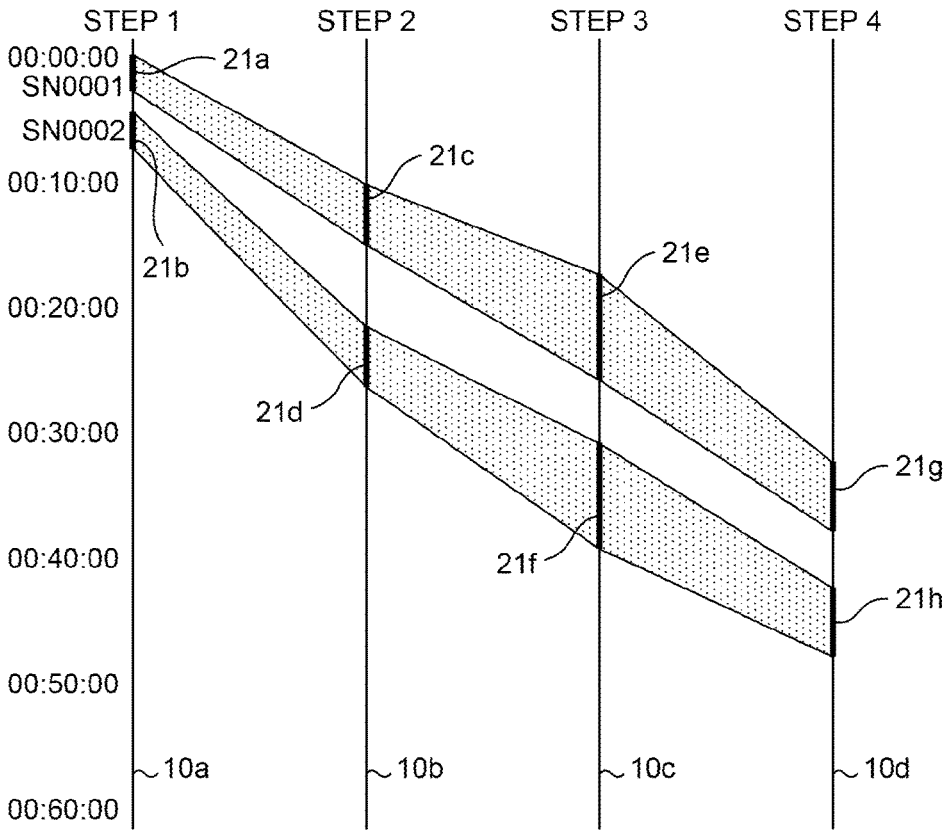
FIG. 48 is a schematic diagram illustrating a first example of a real time display of a graph according to a second embodiment.

A display example of a graph according to the second embodiment will be described. FIG. 48 is a schematic diagram illustrating a first example of a real time display of a graph according to a second embodiment. In the example illustrated in FIG. 48, the log data 121 includes, for "SN0001" and "SN0002", the start time and the end time of all of the steps 1 to 4.

In such a case, the displaying unit 113 disposes a mark 21*a* based on the start time and the end time of the step 1 for "SN0001". The displaying unit 113 disposes a mark 21*b* based on the start time and the end time of "SN0002" in the step 1. Similarly, the displaying unit 113 disposes marks 21*c* to 21*h* based on the start time and the end time of each product in the steps 2 to 4. For example, as indicated by the mark 21*a*, in a single step, the time period indicated by the line segment starting from the start time to the end time corresponds to the processing period of the production in that step.

The displaying unit 113 creates a line segment connecting the start time of each of the mark 21*a*, the mark 21*c*, the mark 21*e*, and the mark 21*g* associated with "SN0001". Furthermore, the displaying unit 113 creates a line segment connecting the end time of each of the mark 21*a*, the mark 21*c*, the mark 21*e*, and the mark 21*g* associated with "SN0001". The displaying unit 113 adds the normal color to the strip represented by the created two line segments. In this way, the displaying unit 113 displays the strip for "SN0001". Furthermore, in a similar manner as for the strip related to "SN0001", the displaying unit 113 displays the strip for "SN0002".

Figure 49:
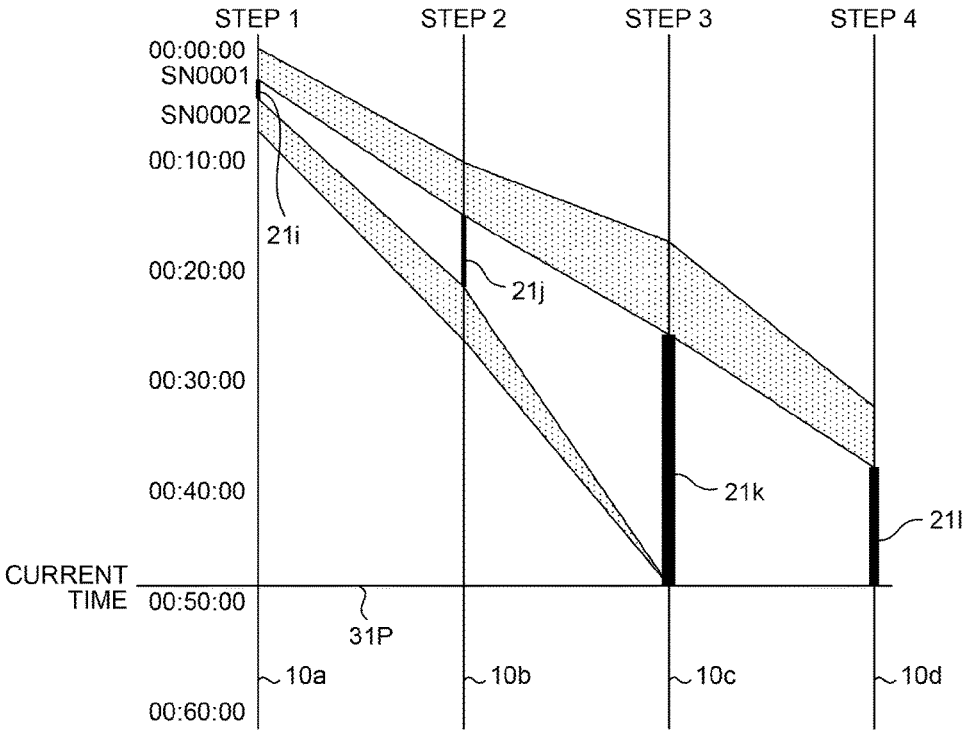
FIG. 49 is a schematic diagram illustrating a second example of a real time display of a graph according to the second embodiment.

FIG. 49 is a schematic diagram illustrating a second example of a real time display of a graph according to the second embodiment. In the example illustrated in FIG. 49, for "SN0001", the log data 121 includes the start time and the end time related to all of the steps 1 to 4. In contrast, for "SN0002", the log data 121 includes the start time and the end time of the step 1 and the step 2, but does not include the log data of the start time of the step 3 and the subsequent steps.

The displaying unit 113 disposes a mark indicating a waiting period in each step based on the end time of a certain product and the start time of the subsequent product. For example, the displaying unit 113 disposes a mark 21*i* indicating the waiting period based on the end time of "SN0001" in the step 1 and the start time of "SN0002" in the step 1. Furthermore, the displaying unit 113 disposes a mark 21*j* indicating the waiting period based on the end time of "SN0001" in the step 2 and the start time of "SN0002" in the step 2. For example, as indicated by the mark 21*i*, in a single step, the time period indicated by a line segment starting from the end time of the production of a certain product to the start time of the production of a product that is subsequently processed next to the certain product corresponds to the waiting period of that step.

In contrast, if a log of the end time of a certain product is recorded but a log of the start time of the subsequent product is not recorded, the displaying unit 113 performs the following process. The displaying unit 113 disposes a mark indicating the waiting period based on the end time and the current time of the certain product. For example, the displaying unit 113 disposes a mark 21*k* based on a line 31P representing the end time and the current time of "SN0001" in the step 3. Furthermore, the displaying unit 113 disposes a mark 21*l* based on the end time and the current time of "SN0001" in the step 4.

Consequently, the displaying unit 113 can display the step in which the start of the production of a product in real time in a visually distinguishable manner.

Figure 50:
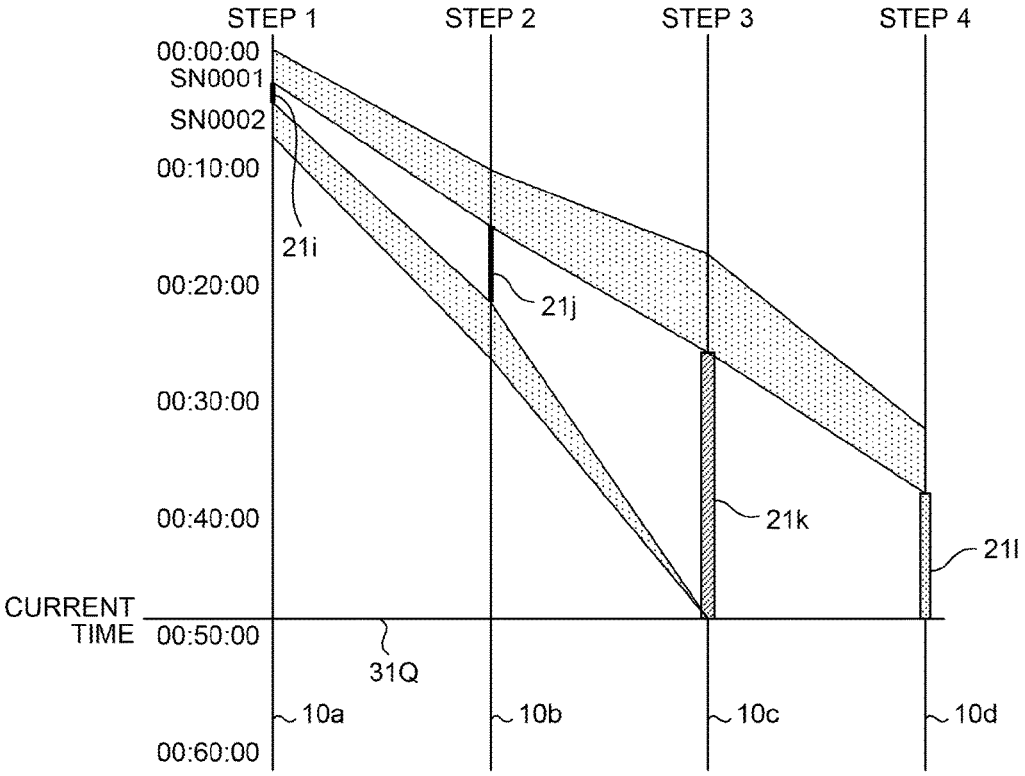
FIG. 50 is a schematic diagram illustrating a third example of a real time display of a graph according to the second embodiment.

FIG. 50 is a schematic diagram illustrating a third example of a real time display of a graph according to the second embodiment. The example illustrated in FIG. 50 differs from the example illustrated in FIG. 49 in that a color is added to each of the mark 21*k* and the mark 21*l*. As indicated by the example illustrated in FIG. 50, if the waiting period still currently continues, by adding a color in accordance with the length of the waiting period, it is possible to display, for each step, the degree of prolonged duration of the waiting period in an easily understandable manner.

Figure 51:
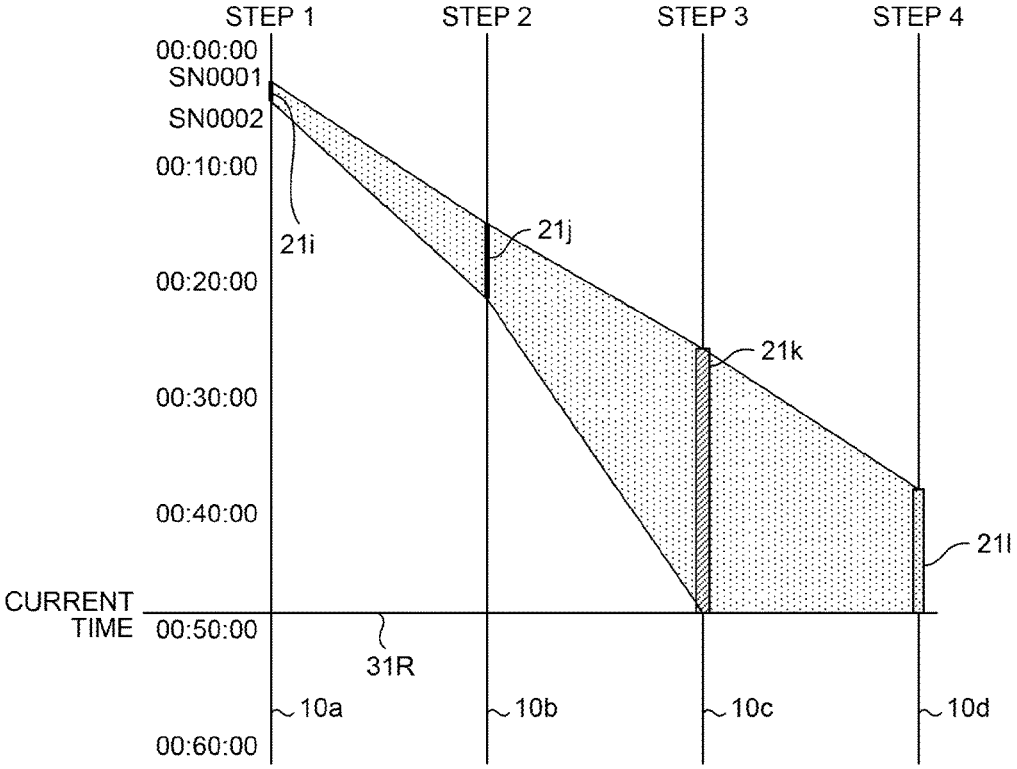
FIG. 51 is a schematic diagram illustrating a fourth example of a real time display of a graph according to the second embodiment.

FIG. 51 is a schematic diagram illustrating a fourth example of a real time display of a graph according to the second embodiment. In the example illustrated in FIG. 51, the strips related to "SN0001" and "SN0002" are not displayed, but the strip indicating the waiting period is displayed. As indicated by the example illustrated in FIG. 51, similarly to the example illustrated in FIG. 49, the displaying unit 113 disposes the mark 21*i*, the mark 21*j*, the mark 21*k*, and the mark 21*l*.

The displaying unit 113 creates a line segment connecting the upper ends of the mark 21*i*, the mark 21*j*, the mark 21*k*, and the mark 21*l*. The displaying unit 113 creates a line segment connecting the lower ends of the mark 21*i*, the mark 21*j*, the mark 21*k*, and the mark 21*l*. The displaying unit 113 adds a color to the strip represented the created two line segments. In this way, the displaying unit 113 displays the strip indicating the waiting period.

Consequently, the displaying unit 113 can display the step having a long unwanted waiting time in an easily and visually understandable manner. Furthermore, if each of the steps proceeds without any delay, the strip indicating the waiting period has a thin and linear shape.

Figure 52:
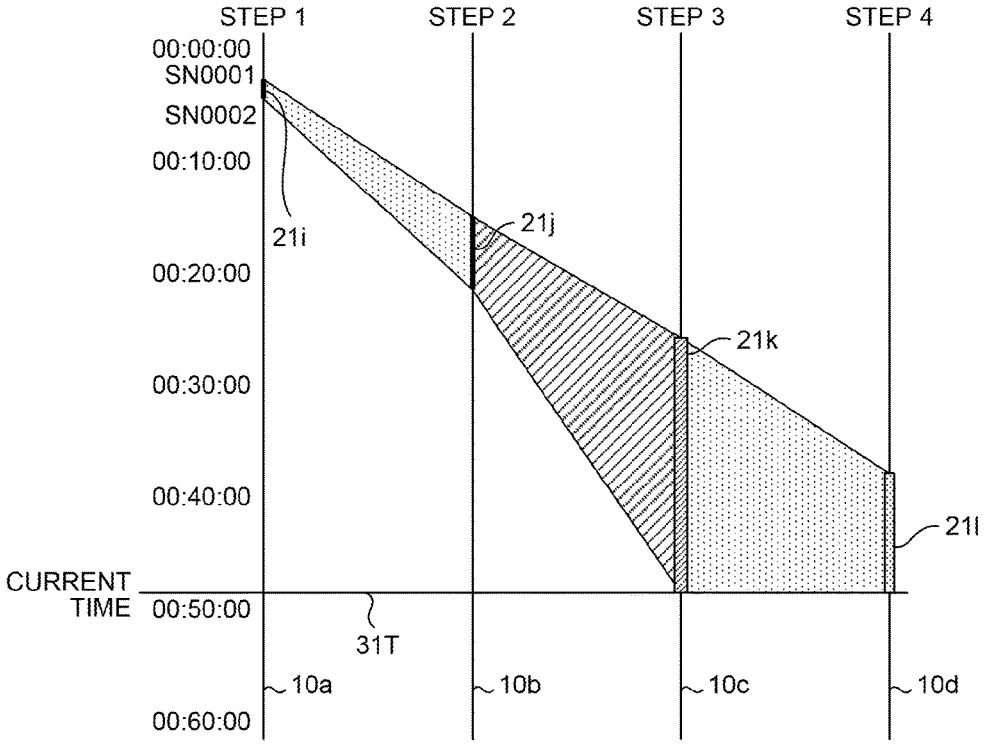
FIG. 52 is a schematic diagram illustrating a fifth example of a real time display of a graph according to the second embodiment.

FIG. 52 is a schematic diagram illustrating a fifth example of a real time display of a graph according to the second embodiment. The example illustrated in FIG. 52 differs from the example illustrated in FIG. 51 in that, in the strip representing the waiting period, a different color from another region is particularly used for the region between the step 2 and the step 3 in which a delay occurs. In this way, the displaying unit 113 may also add a different color from the other portion to the region, in the strip indicating the waiting period, that is associated with the steps in which the waiting time is particularly great.

Furthermore, the degree of delay in an own step tends to be increased as the shape of the region between the step 2 and the step 3 with the different color is closer to the triangle. Furthermore, the degree of effect from the previous step tends to be increased as the shape of the region filled with different color is closer to a parallelogram. In this way, the displaying unit 113 can distinguishably display the delayed step by not only using a color but also using the shape of the region between the steps.

Figure 53:
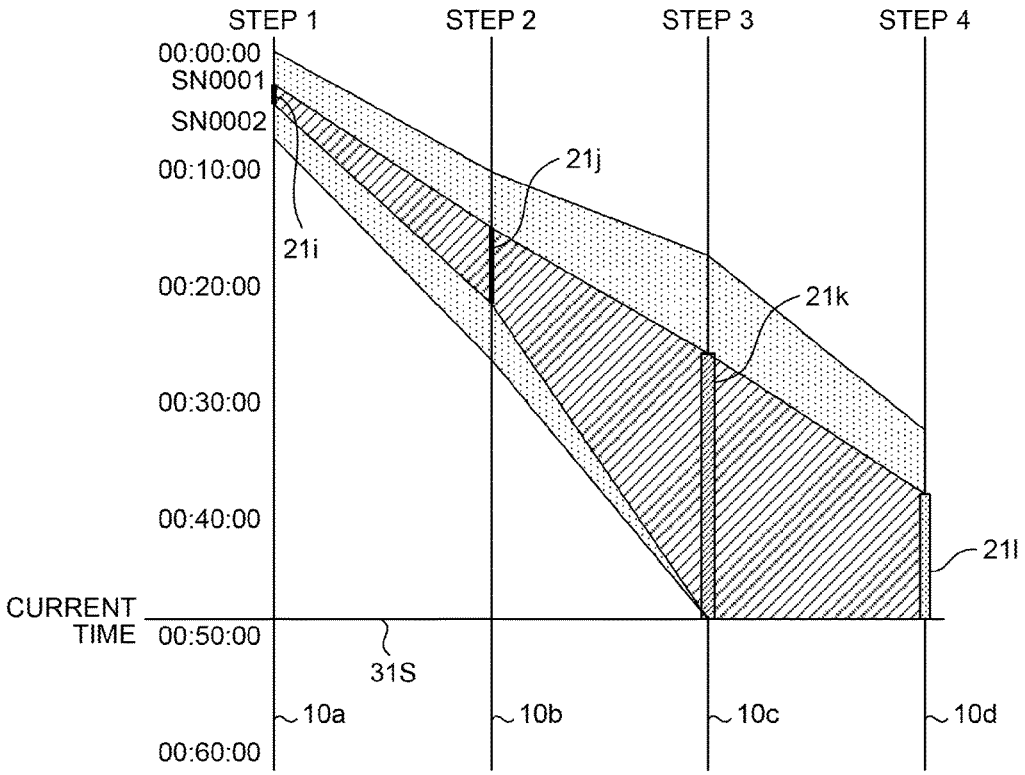
FIG. 53 is a schematic diagram illustrating a sixth example of a real time display of a graph according to the second embodiment.

FIG. 53 is a schematic diagram illustrating a sixth example of a real time display of a graph according to the second embodiment. In the example illustrated in FIG. 53, similarly to FIG. 51 or the like, in addition to the strip indicating the waiting period is displayed, the strips each indicating the processing period of each step. The displaying unit 113 displays, by using different colors, the strip indicating the processing period and the strip indicating the waiting period. For example, the displaying unit 113 displays each of the strips in the graph by adding a light color to the strip indicating the processing period of "SN0001" and "SN0002" and adding a dark color to the strip indicating the waiting period of "SN0001" and "SN0002".

[c] Third Embodiment

In the first embodiment, a description has been given of a case in which the production devices 300*a* to 300*d* illustrated in FIG. 2 output both the start time and the end time to the log data 121; however, the embodiment is not limited thereto. The production devices 300*a* to 300*d* may also output one of the start time and the end time to the log data 121. A description will be given of an example, as a third embodiment, in which the production devices 300*a* to 300*d* outputs one of the start time and the end time.

In such a case, the log data 121 stores therein only the start time or only the end time of each step. The calculating unit 111 calculates, based on the log data 121, the time difference between the time at which the first device starts the production and the time at which the second device starts the production or the time difference between the time at which the first device ends the production and the time at which the second device ends the production. If the start time is stored, the sum of the average length of the processing period in the first device and the average length of the waiting period between the first device and the second device is represented as the time difference. In contrast, if the end time is stored, the sum of the average length of the waiting period between the first device and the second device and the average length of the processing period in the second device is represented as the time difference.

The detecting unit 112 obtains the timing from the latest log data among the pieces of log data related to the first device stored in the storing unit 120 and the time difference calculated by the calculating unit 111. After the latest log data related to the first device is updated, the detecting unit 112 detects that the log data related to the second device is not updated even if the timing has elapsed. In response to the detection result from the detecting unit 112, the displaying unit 113 displays an alarm.

If the start time is stored as the log data, this timing is, for example, the timing that corresponds to the start time assumed, in the second device, when the second device starts the production at the time difference obtained from the data on the start time stored in the log data 121. Namely, the timing is, if a production process is performed in the first device and the second device in line with the state of the production line stored in the log data 121, the time at which the production needs to be started in the second device. In contrast, if the end time is stored as the log data, this timing is the timing that corresponds to, for example, the end time that is assumed, in the second device, when the second device ends the production at the time difference obtained from the data of the end time stored in the log data 121. Namely, the timing is, if a production process is performed in the first device and the second device in line with the state of the production line stored in the log data 121, the time at which the production needs to be ended in the second device.

Figure 54:
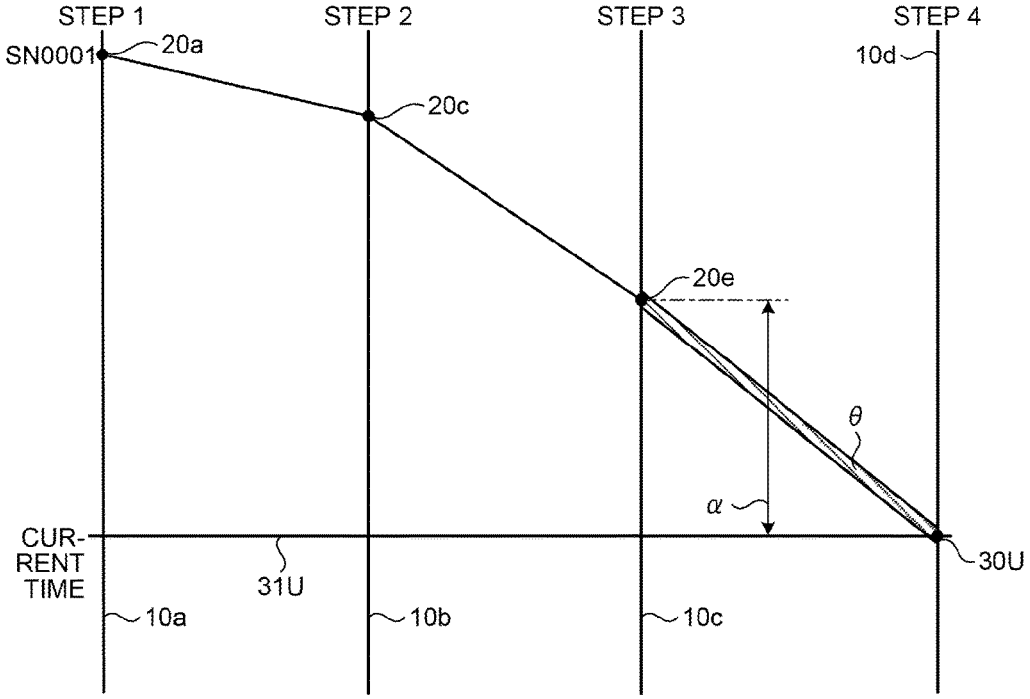
FIG. 54 is a schematic diagram illustrating a first example of a real time display of a graph according to a third embodiment.

Displaying of a graph when the log data 121 stores therein only the start time or the end time of each step will be described below with a specific example. FIG. 54 is a schematic diagram illustrating a first example of a real time display of a graph according to a third embodiment. Log data 121*n* stores therein only the start time of each step and does not store therein the end time of each step. Furthermore, as indicated by the example illustrated in FIG. 54, in the log data 121, the start time of each of the step 1 to the step 3 is stored, but the start time of the step 4 is not stored.

The displaying unit 113 disposes, on the time axis 10*a* of the step 1, the starting point 20*a* of the processing period based on the log data 121*n*. The displaying unit 113 disposes, on the time axis 10*b*, the starting point 20*c* of the processing period. The displaying unit 113 disposes, on the time axis 10*c*, the starting point 20*e* of the processing period.

The displaying unit 113 disposes an intersection point 30U of a line 31U representing the current time and the time axis 10*d* of the step 4.

The displaying unit 113 displays the line connecting the starting points 20*a*, 20*c*, and 20*e* of the processing periods. The displaying unit 113 displays a line θ connecting the starting point 20*e* of the processing period and the intersection point 30U. Similarly to the first embodiment, the displaying unit 113 displays the line θ such that the thickness of the line θ is increased in accordance with the magnitude of the difference α between the start time 20*e* of the step 3 and the line 31U representing the current time.

Furthermore, as the same representation method as in the first embodiment, multiple stages may also be used as the reference related to the time difference. For example, a time difference that is the sum of the average of the processing periods calculated by the calculating unit 111 and the average of the waiting periods may be defined as a difference LEVEL1, whereas the sum of the value of the $80^{th}$ percentile in the probability distribution of the processing periods and the value of the $80^{th}$ percentile in the probability distribution of the waiting periods may be defined as a difference LEVEL2. The references of the difference LEVEL1 and the difference LEVEL2 described above is only examples and the references of the difference LEVEL1 and the difference LEVEL2 may also be appropriately be changed.

If the difference α is smaller than the difference LEVEL1, i.e., if the intersection point 30U does not meet the timing calculated by the calculating unit 111, the displaying unit 113 makes the line θ the dotted line. Furthermore, if, for example, the difference α is equal to or greater than the difference LEVEL1 and is smaller than the difference LEVEL2, the displaying unit 113 adds yellow to the line θ. Furthermore, if, for example, the difference α is equal to or greater than the difference LEVEL2, i.e., if a delay occurs because the intersection point 30U exceeds the value of the $80^{th}$ percentile in the probability distribution of the timing calculated by the calculating unit 111, the displaying unit 113 adds yellow to the line θ. In the example illustrated in FIG. 54, because the difference α is equal to or greater than the difference LEVEL1 and is smaller than the difference LEVEL2, yellow is added to the line θ.

Figure 55:
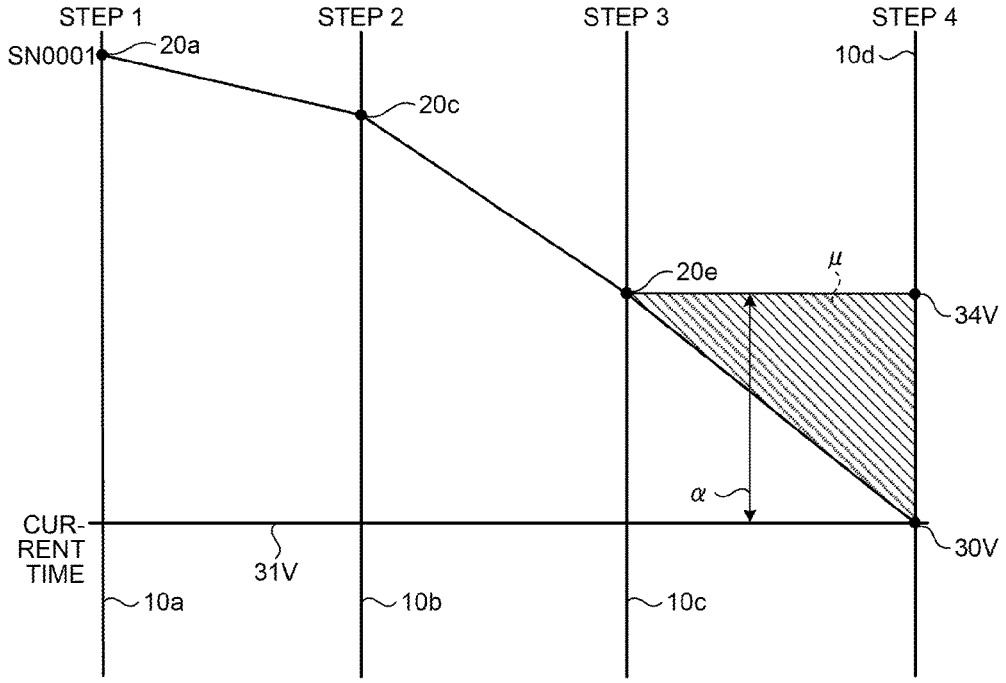
FIG. 55 is a schematic diagram illustrating a second example of a real time display of a graph according to the third embodiment.

FIG. 55 is a schematic diagram illustrating a second example of a real time display of a graph according to the third embodiment. The log data 121*n* is the same as the log data 121*n* related to the example illustrated in FIG. 54.

The displaying unit 113 disposes, on the time axis 10*a* of the step 1, the starting point 20*a* of the processing period based on the log data 121*n*. The displaying unit 113 disposes, on the time axis 10*b*, the starting point 20*c* of the processing period. The displaying unit 113 disposes, on the time axis 10*c*, the starting point 20*e* of the processing period. The displaying unit 113 disposes an intersection point 30V of a line 31V representing the current time and the time axis 10*d* of the step 4. The displaying unit 113 disposes an intersection point 34V of the perpendicular line extending from the starting point 20*e* of the processing period of the step 3 to the time axis 10*d* and the time axis 10*d*.

The displaying unit 113 displays the triangle μ with the vertices of the starting point 20*e* of the processing period, the intersection point 30V, and the intersection point 34V. If, for example, the difference α is equal to or greater than the difference LEVEL1 and is smaller than the difference LEVEL2, the displaying unit 113 adds white to the triangle μ. If, for example, the difference α is equal to or greater than the difference LEVEL1 and is smaller than the difference LEVEL2, the displaying unit 113 adds yellow to the triangle μ. If, for example, the difference α is equal to or greater than the difference LEVEL2, the displaying unit 113 adds red to the triangle μ with. In the example illustrated in FIG. 55, because the difference α is equal to or greater than the difference LEVEL1 and is smaller than the difference LEVEL2, yellow is added to the triangle μ. Furthermore, in the third embodiment, the displaying unit 113 displays the magnitude of the difference α by using a triangle; however, the method is not limited thereto. The displaying unit 113 may also represent the magnitude of the difference α by using another diagram.

Another Embodiment

Here, one of the waiting period LEVEL1, the processing period LEVEL1, and the difference LEVEL1 is represented by LEVEL1, whereas one of the waiting period LEVEL2, the processing period LEVEL2, and the difference LEVEL2 is represented by LEVEL2. A description has been given of a case in which, if the difference α is equal to or greater than the LEVEL1 and is smaller than LEVEL2, the displaying unit 113 adds yellow to the line or the diagram, and, if the difference α is equal to or greater than LEVEL2, the displaying unit 113 adds red to the line or the diagram; however, the method is not limited thereto. The displaying unit 113 may also add another color to the line or the diagram in accordance with the magnitude of the difference α.

Furthermore, instead of two stages, such as LEVEL1 and LEVEL2, the calculating unit 111 may also display an alarm further in detail by providing LEVEL3 and the subsequent LEVELs.

In the first to the third embodiments, a description has been given of a case in which the displaying unit 113 displays, in a graph, a diagram with each side represented by the dotted line; however, the line is only an example. The displaying unit 113 may use any type of line for the diagram displayed in the graph.

Hardware Configuration of a Display Terminal

Figure 56:
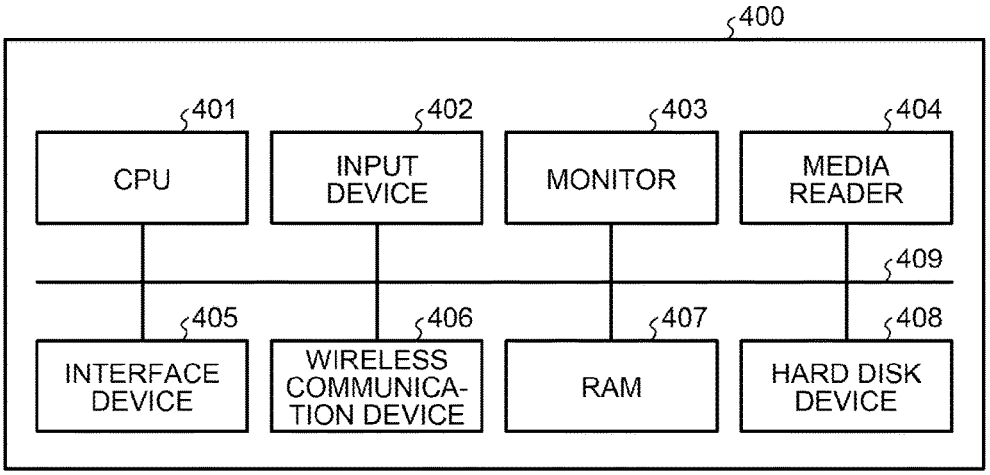
FIG. 56 is a block diagram illustrating the hardware configuration of a computer related to an abnormality detecting device according to each of the first to the third embodiments.

FIG. 56 is a block diagram illustrating the hardware configuration of a computer related to an abnormality detecting device according to each of the first to the third embodiments. As illustrated in FIG. 56, a computer 400 includes a CPU 401 that executes various arithmetic processing, an input device 402 that receives an input of data from a user, and a monitor 403. Furthermore, the computer 400 includes a media reader 404 that reads a program or the like from a storage medium, an interface device 405 for connecting to another device, and a wireless communication device 406 that connects to the other device in a wireless manner. Furthermore, the computer 400 includes a random access memory (RAM) 407 that temporarily stores various kinds of information and a hard disk device 408. Each of the devices 401 to 408 is connected to a bus 409.

The hard disk device 408 stores therein a display program having the same function as that performed by each of the processing units, such as the calculating unit 111, the detecting unit 112, and the displaying unit 113 in the control unit 110 illustrated in FIG. 1. Furthermore, the hard disk device 408 stores therein various kinds of data that implements the display program.

The CPU 401 reads each of the programs stored in the hard disk device 408, loads the programs in the RAM 407, and executes the programs, thereby performing various processes. Furthermore, these programs allow the computer 400 to function as the calculating unit 111, the detecting unit 112, and the displaying unit 113 in the control unit 110 illustrated in FIG. 1.

The display program is not always stored in the hard disk device 408. For example, the computer 400 may also read and execute the program stored in a computer readable recording medium. Examples of the computer recording medium include a portable recording medium, such as a CD-ROM, a DVD disk, or a universal serial bus (USB) memory, a semiconductor memory, such as a flash memory, and a hard disk drive. Furthermore, the program may also be stored in a device connected to, for example, a public circuit, the Internet, a local area network (LAN), or the like and the computer 400 may also read and execute the program from the recording medium described above.

According to an aspect of an example of the present invention, an advantage is provided in that an abnormality related to a production system can be detected in real time.

All examples and conditional language recited herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An abnormality detection system comprising:

a storage; and a processor coupled to the storage, the processor configured to execute a process including:

calculating a time relationship between a first device and a second device in accordance with log data stored in the storage, the log data being related to each of a plurality of production devices that are included in a production line, a product being produced by sequential processes performed by the plurality of production devices, the first device and the second device being included in the plurality of production devices, the second device performing a process among the sequential processes after the first device;

detecting an elapse of a reference time that is obtained from both the latest log data from among the pieces of log data related to the first device stored in the storage and the time relationship and that new log data related to the second device is not newly stored in the storage; and displaying an alarm when a detection is obtained at the detecting, wherein the displaying includes adding a color to a region corresponding to a gap between strips, each of the strips represents a processing period of each step, and the region corresponding to the gap between the strips represents a waiting period of each step.

2. The abnormality detection system according to claim 1, wherein the displaying includes:

creating, based on the log data stored in the storage, on a time axis disposed for each of the production devices, a visible display object that indicates a processing period or a waiting period of the product in each of the production devices; and displaying, on the time axis associated with the second device, in addition to the visible display object created at the creating, a display object, in a state in which the created visible display object is distinguished from the display object, that indicates a time range of the processing period of the product in the second device when the processing period in the second device is started or ended within the reference time that is obtained from both the latest processing period in the first device included in the log data and the time relationship.

3. The abnormality detection system according to claim 1, wherein the log data includes therein, in addition to the production device number and the event date and time, information indicating a distinction between a start and an end of a process in a production device.

4. The abnormality detection system according to claim 1, wherein the calculating includes calculating one or a plurality of a time difference between the time at which the first device starts the production and the time at which the second device starts the production, a time difference between the time at which the first device ends the production and the time at which the second device ends the production, and a time difference between the time at which the first device ends the production and the time at which the second device starts the production.

5. The abnormality detection system according to claim 4, wherein the calculating includes calculating a time difference between the time at which the first device starts the production and the time at which the first device ends the production, and the detecting includes detecting elapse of timing, which is obtained from both start log data from among the log data related to the first device stored in the storage and the time difference calculated at the calculating, and that end log data from among the log data related to the first device is not updated in the storage.

6. The abnormality detection system according to claim 1, wherein the displaying includes displaying an alarm in accordance with a difference between a timing and a current time.

7. The abnormality detection system according to claim 6, wherein the displaying includes displaying, for a strip representing a processing period or a waiting period, a diagram whose area is increased or a line whose thickness is increased, in accordance with elapse of the processing period or the waiting period, as the difference between the timing and the current time is increased.

8. The abnormality detection system according to claim 1, wherein the displaying includes displaying a different alarm depending on whether one of start log data and end log data of the product in the device is not updated.

9. An abnormality detection method comprising:

disposing, by a processor, when log data related to a process in a first device that is included in a production line is received, a processing period in the first device specified by the log data on a first time axis that indicates the processing period in the first device and displaying, by the processor, the processing period in the first device;

disposing, by the processor, when log data related to a process in a second device that is included in the production line and that performs a process subsequent to the first device is received, a processing period in the second device specified by the log data on a second time axis that indicates the processing period in the second device and that is parallel to the first time axis and displaying, by the processor, the processing period in the second device;

forming, by the processor, a first band that couples, from among the processing periods disposed on the first time axis and the second time axis, processing periods related to a common product between the first device and the second device and displaying, by the processor, the first band; and specifying, by the processor, based on the log data related to the first device and the log data related to the second device, a time difference of processing timing related to the common product between the first device and the second device, forming, by the processor, when a second processing period, in the second device, that is associated with a first processing period disposed on the first time axis and that is related to the common product is not present even when timing specified based on both the first processing period and the time difference has elapsed, a second band that couples the first processing period on the first time axis and a position indicating the timing on the second time axis, and displaying, by the processor, a strip graph.

10. A display device comprising:

a storage; and a processor coupled to the storage, the processor configured to execute a process including:

performing, based on a log output in accordance with execution of a process event in a first device related to a specific product, a display associated with the process event performed in the first device by associating the display with a first time on a time axis;

updating, in accordance with elapse of time, a display indicating a current time on the time axis such that a gap between the first time and the current time is increased;

performing, before a reference time calculated based on a log output from the first device exceeds, when a log associated with the execution of a process event related to the specific product is not output from a second device that subsequently performs a process related to the specific product after the process performed in the first device, a display associated with a planned process event by associating the display with an estimated occurrence time of the planned process event in the second device related to the specific product; and performing, before the reference time calculated based on the log output from the first device exceeds, when the log associated with the execution of the process event related to the specific product is output from the second device, without performing the display associated with the planned process event that is associated with the reference time in the second device related to the specific product, a display associated with the process event performed in the second device by associating the display with a second time on the time axis based on the log output from the second device.

* * * * *